US008438955B2

(12) United States Patent
Wilson, Jr. et al.

(10) Patent No.: US 8,438,955 B2
(45) Date of Patent: May 14, 2013

(54) UTILITY TOOLS AND MOUNTING ADAPTATION FOR A NUT DRIVING TOOL

(75) Inventors: David Wilson, Jr., Fort Collins, CO (US); Brent A. Sigmon, Windsor, CO (US)

(73) Assignee: American Power Tool Company, Fort Collins, CO (US)

( * ) Notice: Subject to any disclaimer, the term of this patent is extended or adjusted under 35 U.S.C. 154(b) by 666 days.

(21) Appl. No.: 12/386,952

(22) Filed: Apr. 24, 2009

(65) Prior Publication Data

US 2010/0269638 A1 Oct. 28, 2010

(51) Int. Cl.
*B25B 21/00* (2006.01)

(52) U.S. Cl.
USPC ..... 81/57.36; 81/185.2

(58) Field of Classification Search ..... 81/467, 81/429, 57.36, 54–56, 57.11, 57.14, 57.3, 81/180.1, 185.2, 177.85, 121.1
See application file for complete search history.

(56) References Cited

U.S. PATENT DOCUMENTS 4,620,460 A * 11/1986 Gonzales, Jr. ..... 81/124.4
5,460,062 A 10/1995 Wilson, Jr.
6,029,546 A 2/2000 Gibson et al.
6,742,417 B2 * 6/2004 Ha ..... 81/57.36
7,311,025 B1 12/2007 Wilson, Jr.
7,513,179 B2 4/2009 Wilson, Jr.
2004/0074344 A1 * 4/2004 Carroll ..... 81/121.1
2006/0048609 A1 * 3/2006 Shih ..... 81/60
2007/0157772 A1 * 7/2007 Parker ..... 81/177.85
2010/0095810 A1 * 4/2010 MacArthur et al. ..... 81/55

OTHER PUBLICATIONS

U.S. Appl. No. 12/380,216, filed Feb. 25, 2009, Wilson, Jr.

* cited by examiner

*Primary Examiner* — Robert Scruggs
(74) *Attorney, Agent, or Firm* — Harold A. Burdick

(57) ABSTRACT

Adaptations, apparatus and methods are disclosed for associating various utility tools with a nut driving tool. The adaptation of includes a receiver connectable to one side of the nut driving tool adjacent to a socket driver. A utility tool mounting body includes a base portion releasably engageable with the receiver and a station portion on the base portion releasably engageable with the selected utility tool. The utility tool of this invention includes a head having a mounting interface, the station portion releasably engageable with the mounting interface of the utility tool head. In one embodiment, the utility tool is reaction unit for engaging a nut or a fitting body. In other embodiments, utility tools for tube cutting, sawing, and/or bending, and/or grasping of adjacent fitting types or fitting sizes are provided.

22 Claims, 72 Drawing Sheets

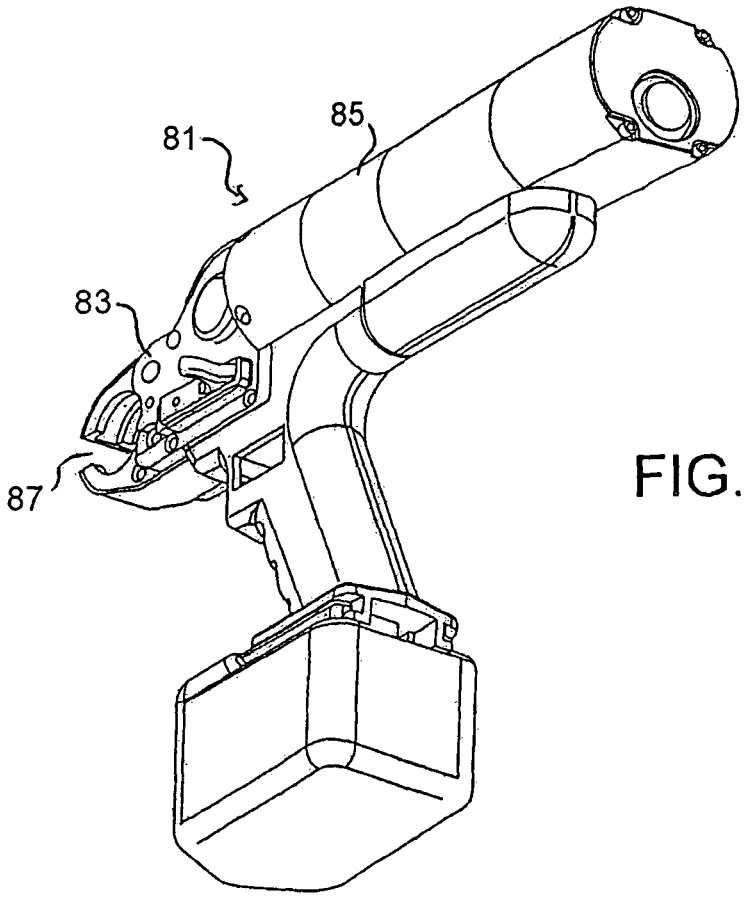
FIG. 1
FIG. 2
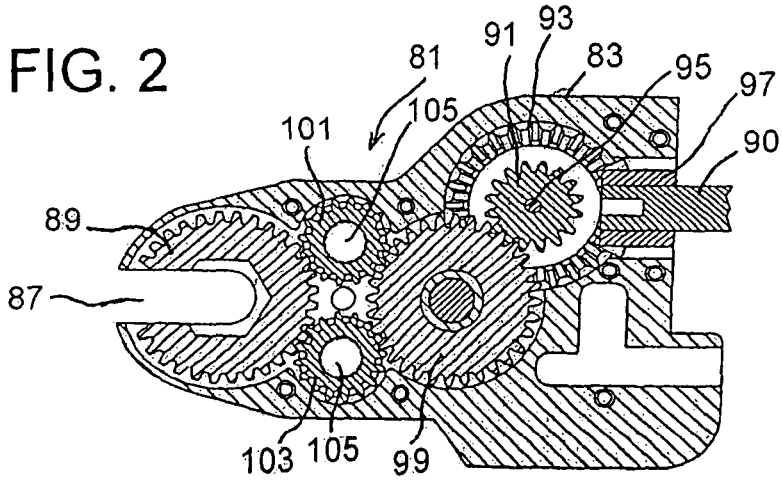

UTILITY TOOLS AND MOUNTING ADAPTATION FOR A NUT DRIVING TOOL

FIELD OF THE INVENTION

This invention relates to nut driving tools and methods and, more particularly, to associated appliances used on tube nut drivers.

BACKGROUND OF THE INVENTION

Powered drivers, both pneumatic and electrical, for manipulation of various types of tools (such as sockets for threaded connectors) are widely utilized. In many applications, such as manipulation of threaded line fittings (i.e., unions or the like) found in all gas or liquid processing or delivery operations and assemblies, correct tightness of the fitting is critical to assure a sound connection and to avoid leakage (which may occur if line fittings are either over or under tightened thus damaging internal ferrules for example). This precision can be adversely impacted by tubing damage and/or deformity. Moreover, a number of different types of operations and fabrication steps in addition to nut tightening and/or removal are often required to be performed in the field under various circumstances. Such operations have not always been well accommodated.

For example, in the past, torque reaction tools for nut drivers have relied on engagement with a polygonal feature of a fitting (see U.S. Pat. Nos. 6,029,546 and 5,460,062). In most cases reaction tool wrenches utilized are larger than the fitting of body feature they are engaging, often leading to difficulty in use of the driving and reaction tool pair, particularly where space is limited (as it often is in such installations). Other reaction tools integrated with the nut driver body have been suggested and utilized, but have required reaction tool mounting features at both sides of the driver thus requiring additional clearance for tool use (see U.S. Pat. No. 7,311,025). Moreover, adaptability of driving tools for use in performing other operations or fabrication steps, while suggested, could be better accommodated and is in need of improvement.

SUMMARY OF THE INVENTION

This invention provides apparatus (various tools and adaptations) and methods for associating various utility tools with a nut driving tool. The apparatus accommodate precision facilities fabrication in the field while reducing damage and/or deformity to critical facility components (such as tubing, compression nuts/ferules and the like). The apparatus and methods are well adapted to use with a highly diverse selection of utility tool types thus providing for multifarious fabricating options using a single tool driver. The apparatus, mounting and utility tools of this invention are conducive to use in limited space and are located at only one side of the driving tool.

The adaptation of this invention accommodates mounting and positioning a selected utility tool at one side of a nut driving tool that has a main drive gear operationally associated with a socket driver. The adaptation includes a receiver connectable to the one side of the nut driving tool adjacent to the socket driver. A utility tool mounting body is receivable at the one side of the nut driving tool for utility tool positioning at a location relative to the socket driver, a base portion thereof being releasably engageable with the receiver and a station portion on the base portion releasably engageable with the selected utility tool.

The utility tool of this invention is maintainable entirely at one side of the nut driving tool and includes a head having a mounting interface. The base portion thereof is releasably engageable at the one side of the nut driving tool for utility tool positioning at a location relative to the socket driver, the station portion releasably engageable with the mounting interface of the utility tool head. In one embodiment, the utility tool is reaction unit for engaging a nut or a fitting body. Other embodiments provide utility tools for tube cutting, sawing, and/or bending, and/or grasping of adjacent fitting types or fitting sizes.

The methods of this invention provide for adaptation of such nut driving tools for utilization and operation of any of a plurality of utility tools. The methods include releasably receiving a selected utility tool at one side of the nut driving tool in a receiver adapted to entirely reside at the one side of the nut driving tool adjacent to the socket driver. Movement of the selected utility tool is effected in conjunction with operation of the socket driver.

It is therefore an object of this invention to provide apparatus (various tools and adaptations) and methods for associating various utility tools with a nut driving tool.

It is another object of this invention to provide apparatus for associating various utility tools with a nut driving tool that accommodate precision facilities fabrication in the field while reducing damage and/or deformity to critical facility components.

It is still another object of this invention to provide apparatus and methods for associating various utility tools with a nut driving tool that are well adapted to use with a highly diverse selection of utility tool types.

It is yet another object of this invention to provide apparatus and methods for associating various utility tools with a nut driving tool that are conducive to use in limited space and are located at only one side of the driving tool.

It is still another object of this invention to provide apparatus and methods for use with nut driving tool that accommodate interchangeable use of utility tools including some or all of torque reaction units, tube cutting, sawing and/or bending units, and various units for grasping adjacent fitting types and/or sizes.

It is yet another object of this invention to provide an adaptation for mounting and positioning a selected utility tool at one side of a nut driving tool having a main drive gear operationally associated with a socket driver, the adaptation including a receiver adapted for connection to the one side of the nut driving tool adjacent to the socket driver, and a utility tool mounting body receivable at the one side of the nut driving tool for utility tool positioning at a location relative to the socket driver, the mounting body including a base portion releasably engageable with the receiver and a station portion on the base portion releasably engageable with the selected utility tool.

It is another object of this invention to provide a utility tool maintainable entirely at one side of a nut driving tool having a main drive gear operationally associated with a socket driver, the utility tool including a utility tool head having a mounting interface, and a mounting body including a base portion releasably engageable at the one side of the nut driving tool for utility tool positioning at a location relative to the socket driver, and a station portion on the base portion releasably engageable with the mounting interface of the utility tool head.

It is still another object of this invention to provide a utility tool maintainable entirely at one side of a nut driving tool having a main drive gear operationally associated with a socket driver, the utility tool including a reaction unit head having a mounting interface, the head for engaging a nut or a fitting body utility tool head, and a mounting body including a base portion releasably engageable at the one side of the nut driving tool for utility tool positioning at a location relative to the socket driver, and a station portion on the base portion releasably engageable with the mounting interface of the reaction unit head.

It is yet another object of this invention to provide a method for adaptation of a nut driving tool having a main drive gear operationally associated with a socket driver for utilization and operation of any of a plurality of utility tools, the method including the steps of releasably receiving a selected one of the utility tools at one side of the nut driving tool in a receiver adapted to entirely reside at the one side of the nut driving tool adjacent to the socket driver, and effecting movement of the selected one of the utility tools in conjunction with operation of the socket driver.

With these and other objects in view, which will become apparent to one skilled in the art as the description proceeds, this invention resides in the novel construction, combination, adaptation and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 is a perspective view providing background of one type of nut driving tool with which this invention can be utilized;

FIG. 2 is a partial sectional view of the nut driving head of the tool of FIG. 1;

DESCRIPTION OF THE INVENTION

Figure 3:
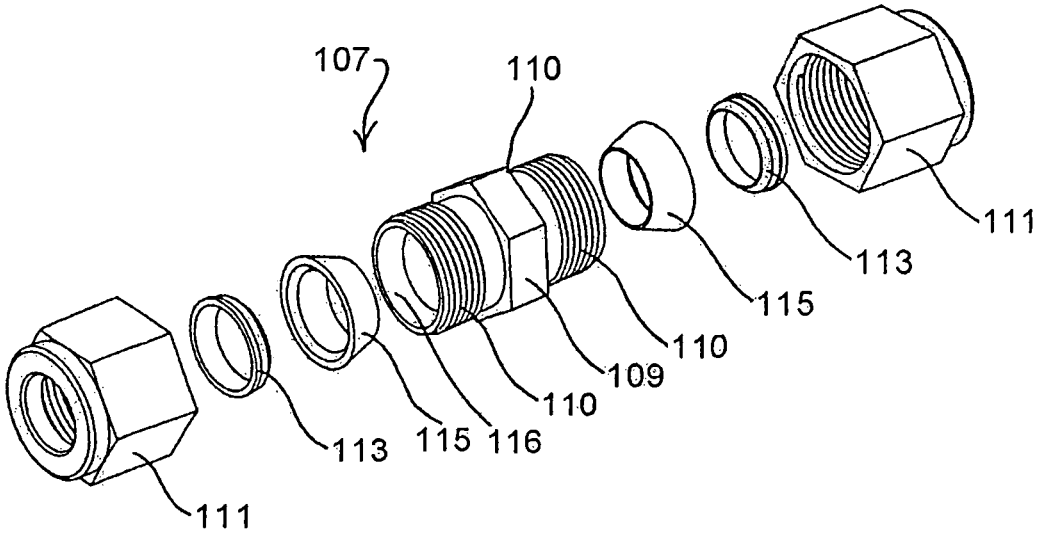
FIG. 3 is an exploded perspective view providing background regarding tube connection fittings found in a typical installation wherein this invention may be utilized.

FIGS. 1 through 4 are provided for background. FIGS. 1 and 2 show one type of nut driving tool in association with which this invention can be utilized. It should be appreciated this invention can be adapted for securement at and use with many type of nut driver while still providing the advantages as shown and described.

The powered driving tool 81 shown in FIGS. 1 and 2 is utilized for rotating sockets or the like to manipulate threaded connectors such a line fitting nuts. Driving tool 81 includes a driving head 83 connected with a motor module 85 and various electronics, switching and power units as are known. As shown in FIG. 2, head 83 has gapped jaw 87 accommodating use of a split socket driver 89 (a hex socket driver, for example) used commonly heretofore to manipulate line fittings, and herein utilized to engage and drive the appliances of this invention. As shown in FIG. 2, power is translated from output shaft 90 of motor module 85 by a drive translate assembly including stacked gears 91 and 93 on shaft 95, bevel gear 93 engaged by primary drive output gear 97 of the final output stage of motor module 85. Main drive gear 99 and idler gears 101 and 103 having center openings 105 complete the drive train.

Figure 4:
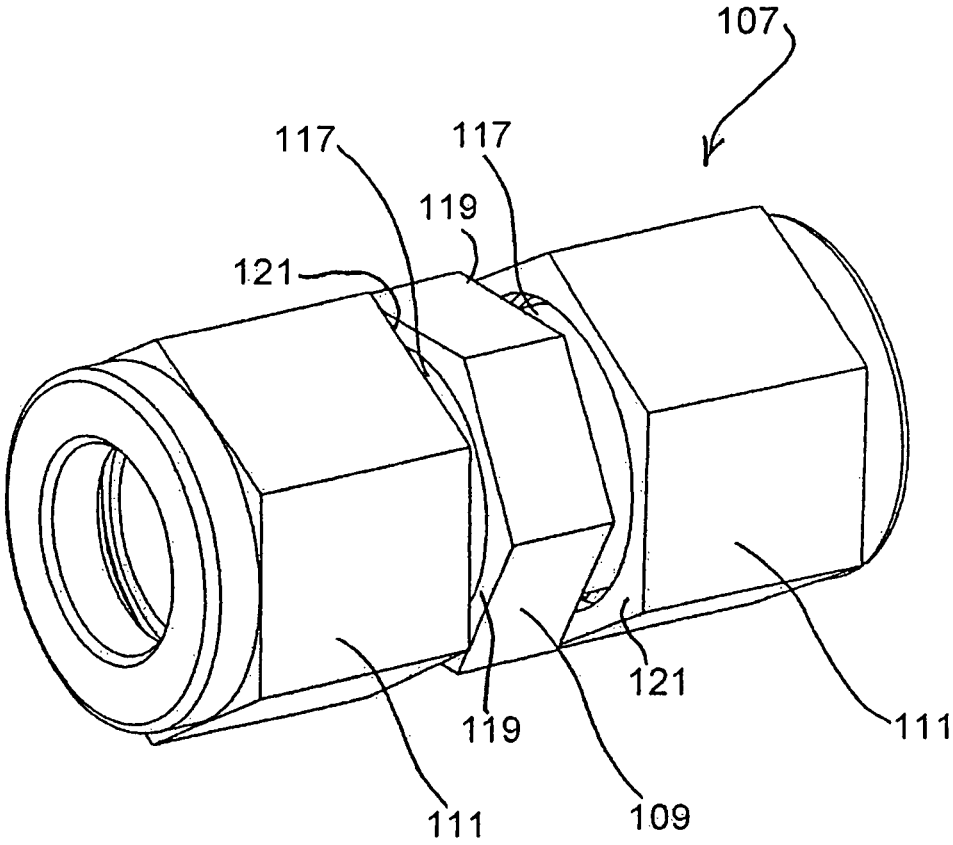
FIG. 4 is an assembled view of the fitting shown in FIG. 3.

FIGS. 3 and 4 show a typical type of tube connection fitting 107. Fitting 107 includes typically includes a center nut/fitting body 109/110 having male fitting threads 110 at each end thereof with female nuts 111 engageable thereat. The assembly is utilized to mechanically move ferule assemblies 113/115 to seal tube sections when received at each end of fitting 107 through ferule assemblies 113/115, nuts 111 and the ends of center nut 109 at conical inner chambers 116 thereof. When fully assembled as shown in FIG. 4, gaps 117 between nuts 111 and center nut 109 are defined (hereinafter called nut to body gap(s)). These gaps are defined by the space remaining between center nut 109 of body 110 and female nuts 111 when swaging a fitting (between front faces 119 of center nut 109 of fitting body 110 and inner faces 121 of female hex nuts 111), and are highly predictable in size when a correct swage is made (one which does not over or under compress ferule assemblies 113/115 and thus results in a fluid tight finished assembly).

Figure 5:
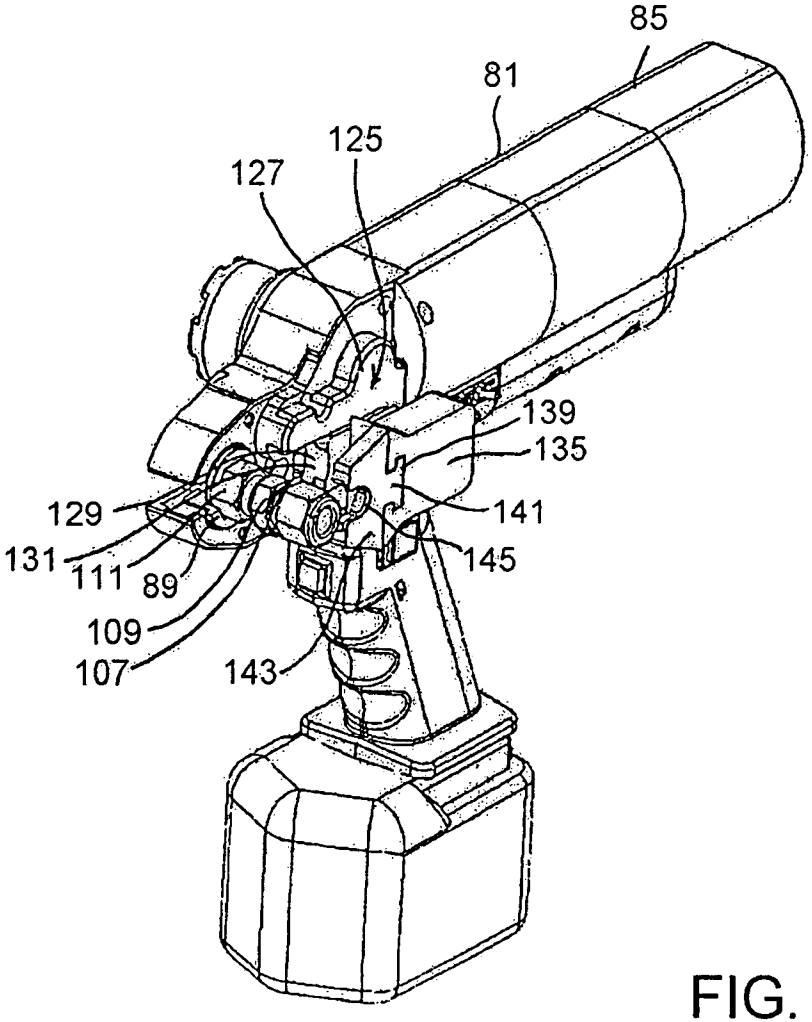
FIG. 5 is a perspective view a first embodiment of this invention.
Figure 6:
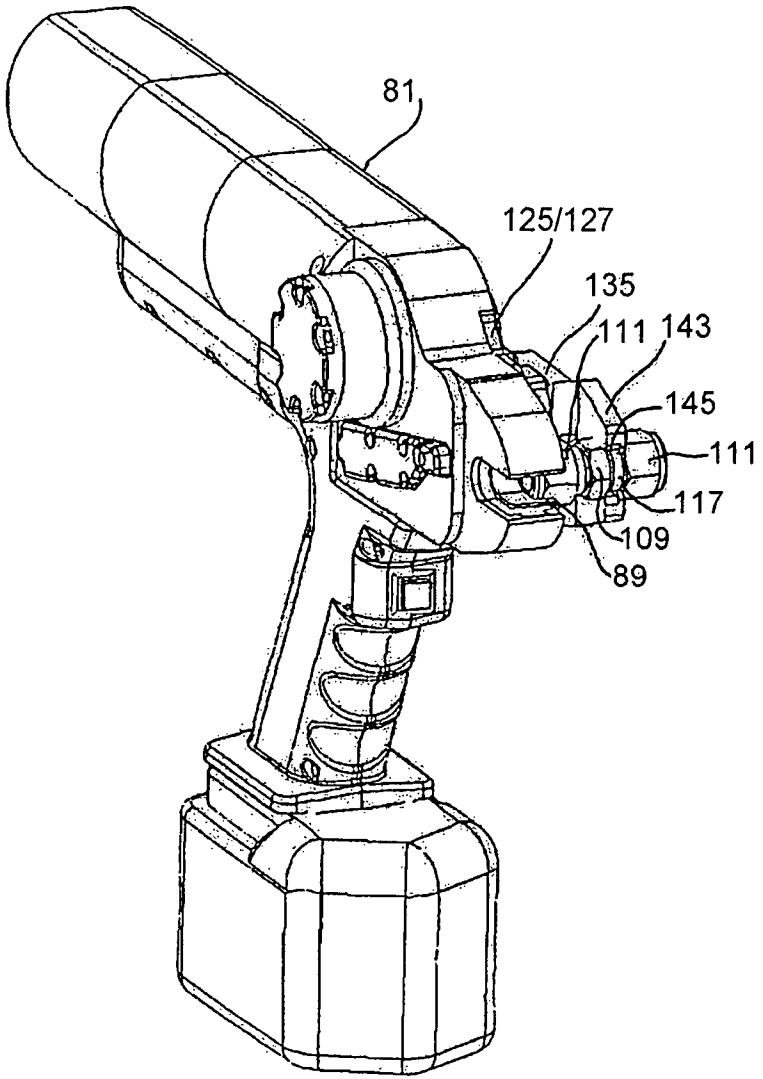
FIG. 6 is an opposite perspective view of the embodiment of FIG. 5.
Figure 7:
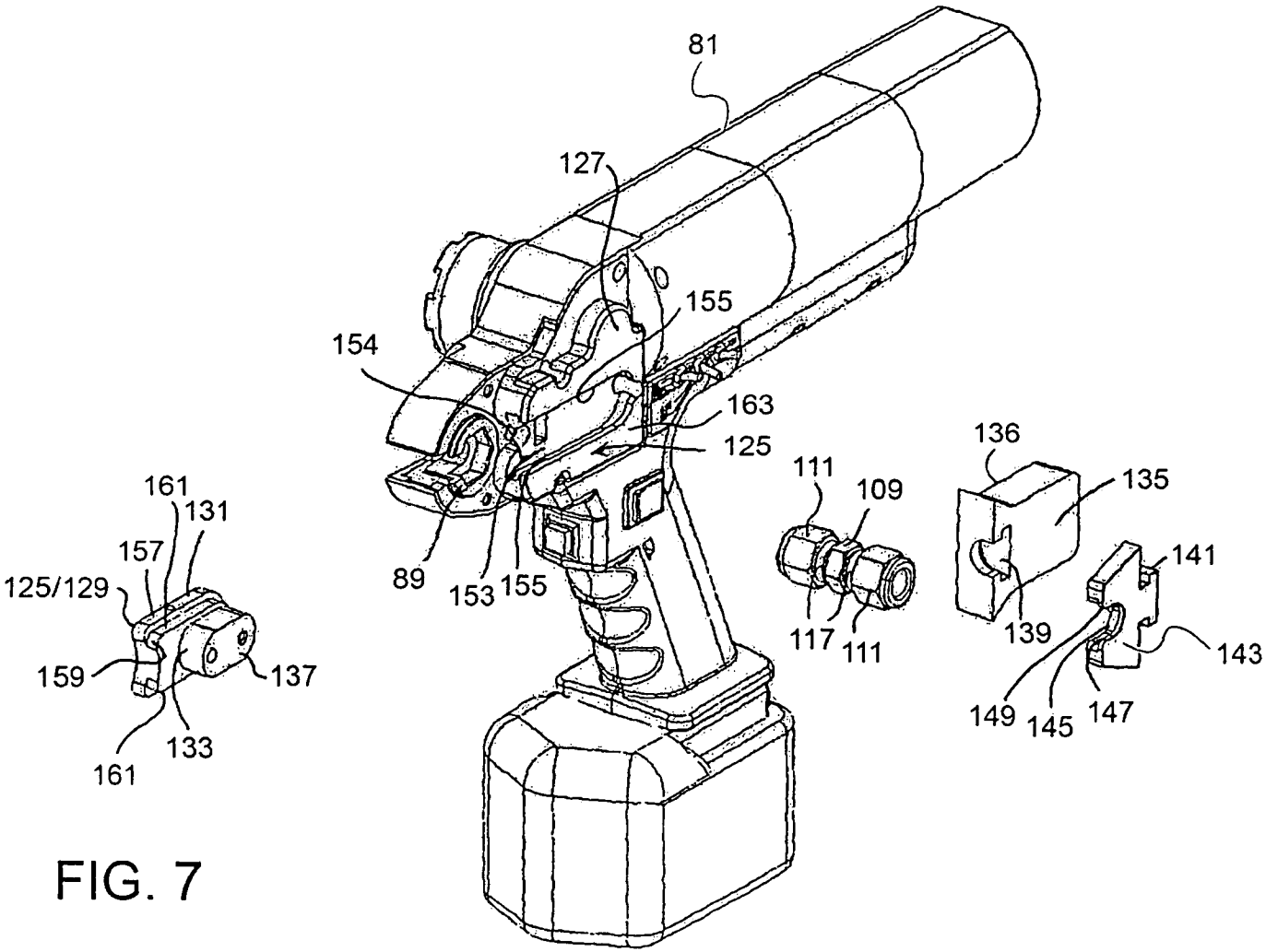
FIG. 7 is an exploded perspective view of the embodiment of FIG. 5.
Figure 9:
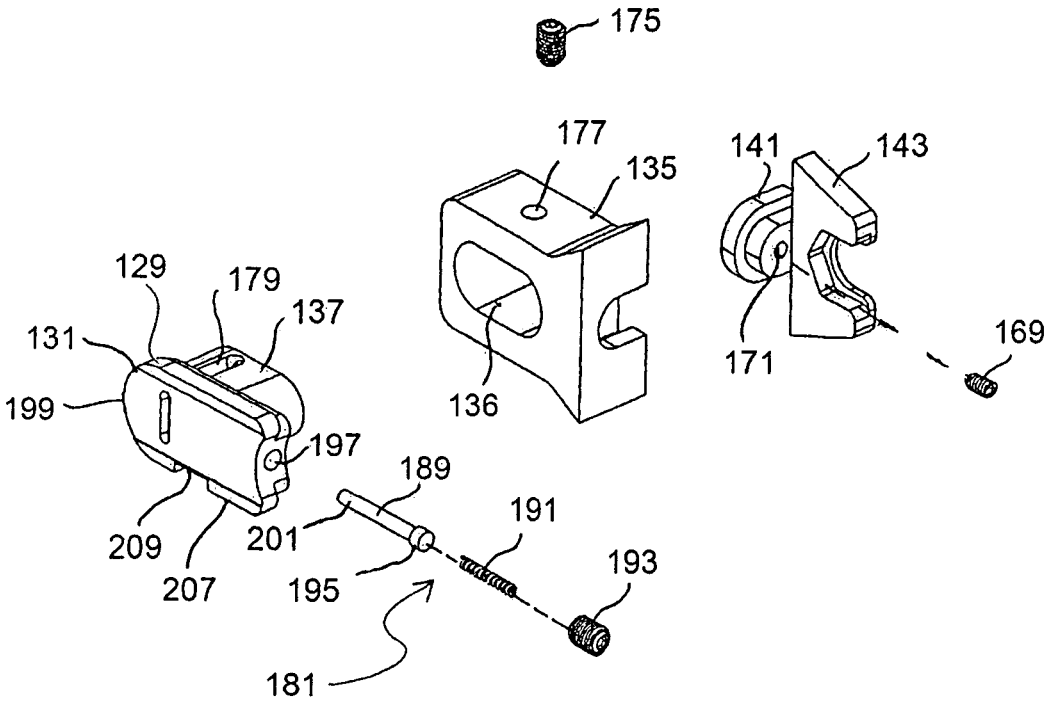
FIG. 9 is an exploded detail view taken from FIG. 8.

Turning now to FIGS. 5 through 7, a first embodiment of a utility tool and adaptation of this invention are illustrated, the adaptation shown having adaptation features common to all embodiments of utility tools disclosed hereinafter. Adaptation 125 is located entirely at one side of a nut driving tool (tool 81 for example) and includes a driver head cover 127 constituting a receiver for utility tool mounting body 129. Mounting body 129 includes a base portion 131 releasably engagable at receiver 127 and station portion 133 on base portion 129 which is releasably engageable by utility tool head 135. Tool head 135 includes mounting interface 136 (an opening for receiving station tower 137 therein; not shown in FIGS. 5 through 7 but identical to the interface identified by the same numeral in FIG. 9).

Figure 8:
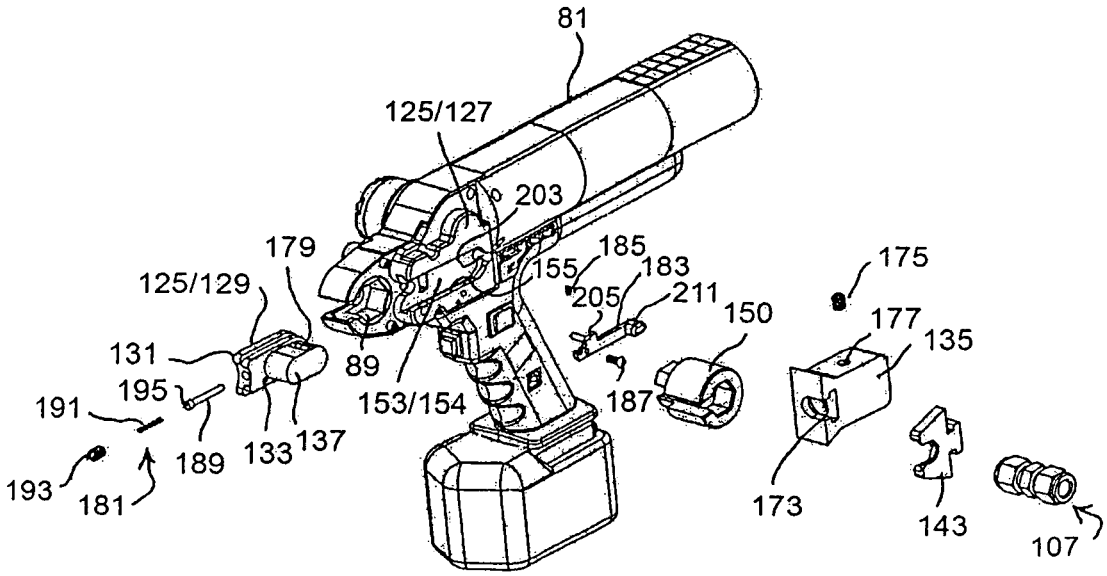
FIG. 8 is an exploded perspective view of an alternative adaptation of the embodiment of FIG. 5.
Figure 10:
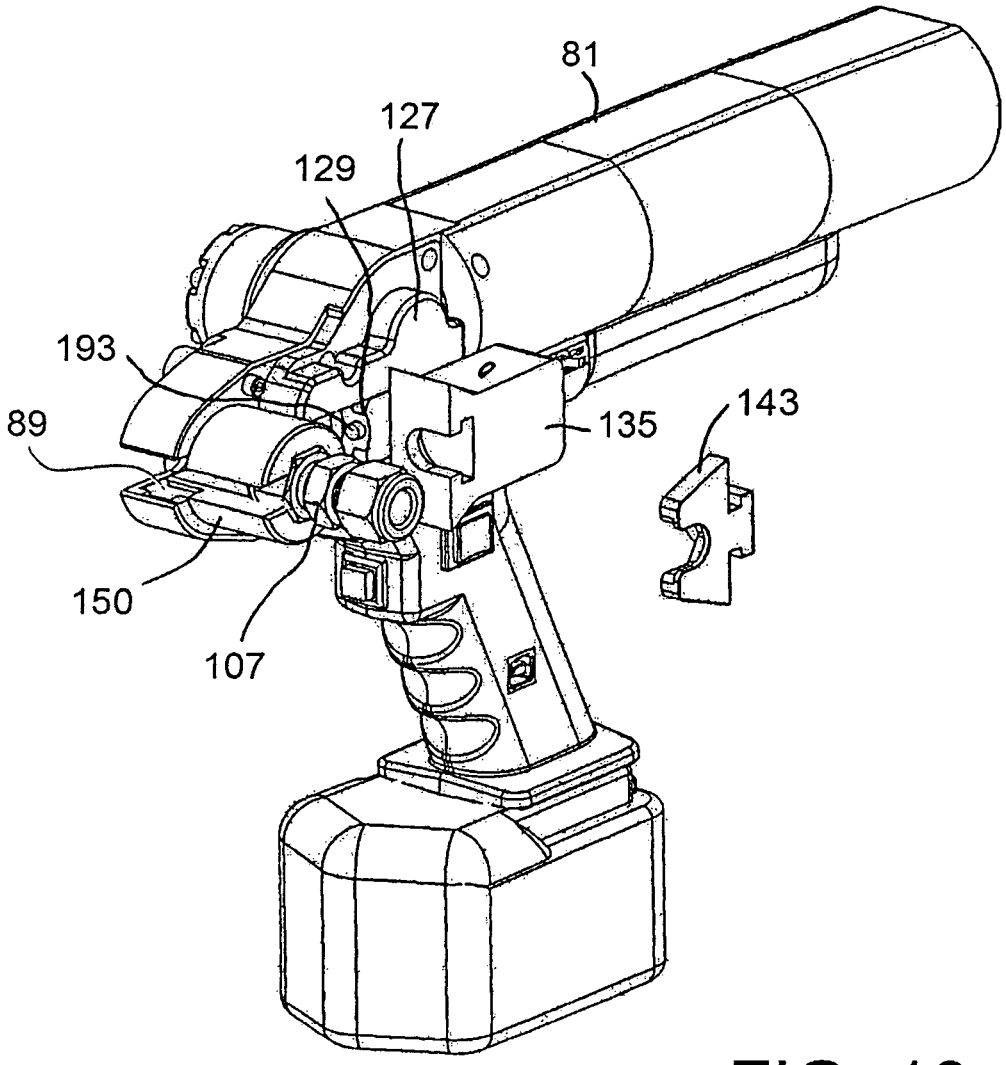
FIGS. 10 through 12 illustrate operation of the embodiment shown in FIGS. 5 and/or 8.

Reaction blade receiving slot 139 is sized for friction retention of blade stand 141 of reaction blade unit 143. Reaction blade unit 143 has opening 145 therein for receipt of center nut 109 and tubing thereat (not shown) having a portion 147 configured to grasp or engage the facets of the center nut and blade 149 of a size selected to fit in nut to body gap 117 of a correctly swaged fitting. Different sized blade units 143 (or other units as discussed hereinafter) are interchangeable in tool head 135 to accommodate fittings having different characteristics (size, shape or the like, preferably sized as wrench heads that hold the center nut of a fitting for the restriction and cancellation of torque reaction forces). Specialized reaction blade units can be utilized as shown hereinafter to hold the annular projections of a fitting body, instead of the flats of a fitting nut. When assembled on tool 81, utility tool head 143 is positioned adjacent to a fitting 107 for engagement of center nut 109, nut 111 to be driven by driver 89 (or a socket 150 received thereat as shown in FIGS. 8 and 10).

As best shown in FIG. 7, receiver 127 includes an open-ended slot 153 defining a slideway 154 having undercut edges 155. The integral slot/slideway 153/154 extends along the outer surface of receiver 127 from a position aft of drive gear 99 to a position adjacent socket driver 89. Base portion 131 of body 129 includes slide 157 slidably receivable in slideway 154 with the edges thereof received at undercut edges 155. Platform 159 of station 133 has edges 161 which are received between edges 155 and extend mounting body 129 above outer surface 163 of receiver 127.

Tower 137 slidably receives reaction unit head 135 at interface 136, thus allowing slidable movement of head 135 for adjustment in two separate axes, toward and away from receiver 127 and forward a rearward in receiver 127. This adjustability provides for ease of positioning of blade unit 143 by an operator in use to swage a fitting or the like. Once installed, mounting body 129/head 135 are retained so long as a fitting to be manipulated blocks slideway 154.

Various alternatives and enhancements for the embodiment shown in FIG. 5 may be employed as shown in FIGS. 8 through 12. Set screw 169 may be provided in threaded opening 171 through blade stand 141 of reaction blade unit 143 for engagement at detent 173 of tool head 135 to better secure unit 143 thereat. Set screw 175 may be provided for receipt in threaded opening 177 extending into interface opening 136 to guide movement of tool head 135 on tower 137 of station portion 133 of mounting body 129 via guide slot 179 receiving the end of screw 175 therein.

Figure 11:
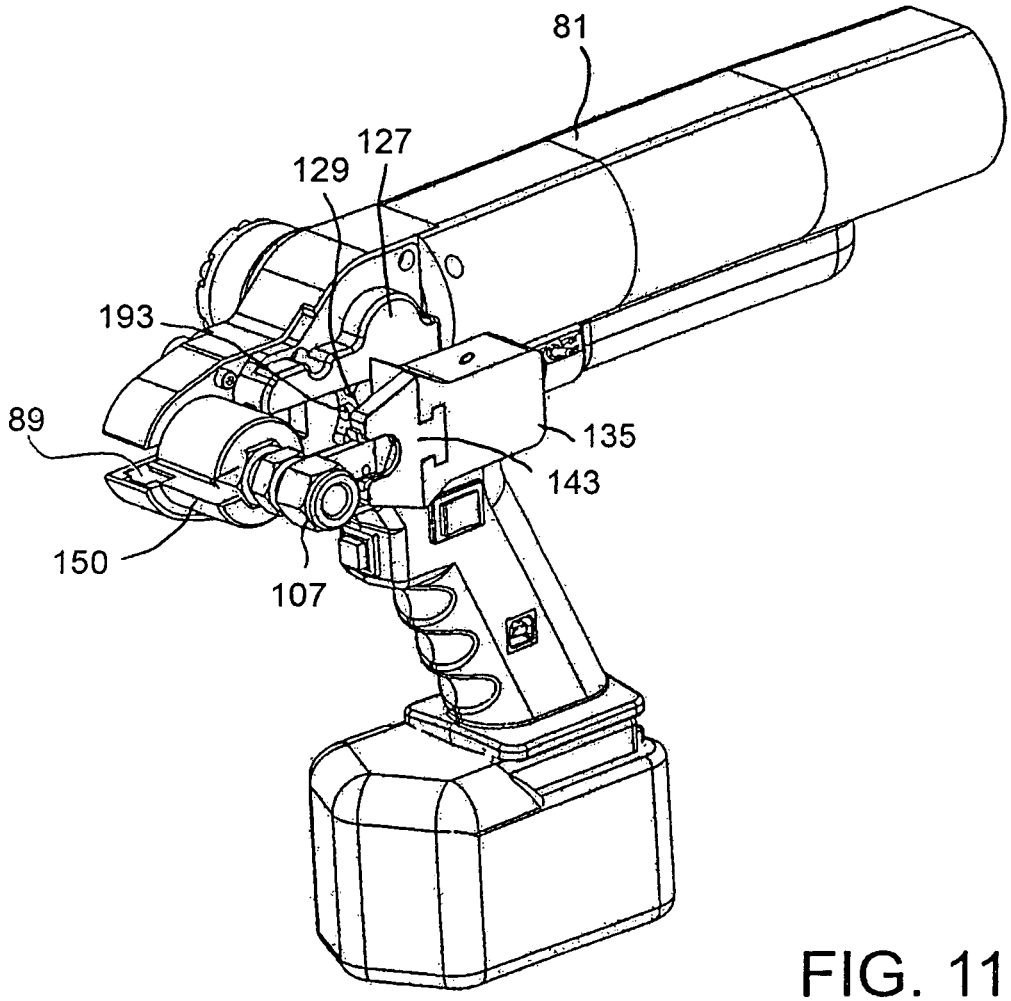
Figure 17:
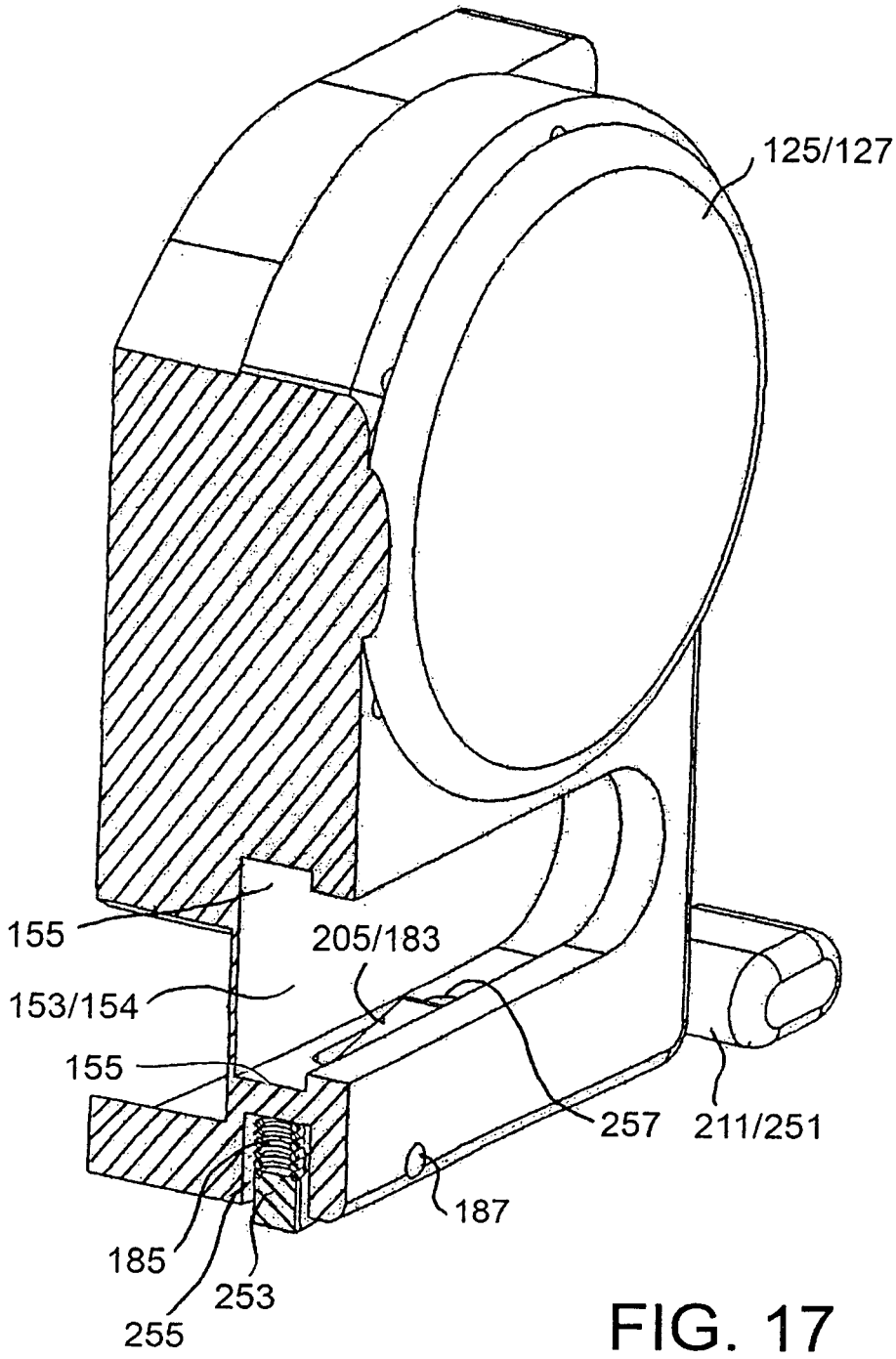
FIG. 17 is a sectional view of the receiver of the embodiment of FIG. 13.
Figure 18:
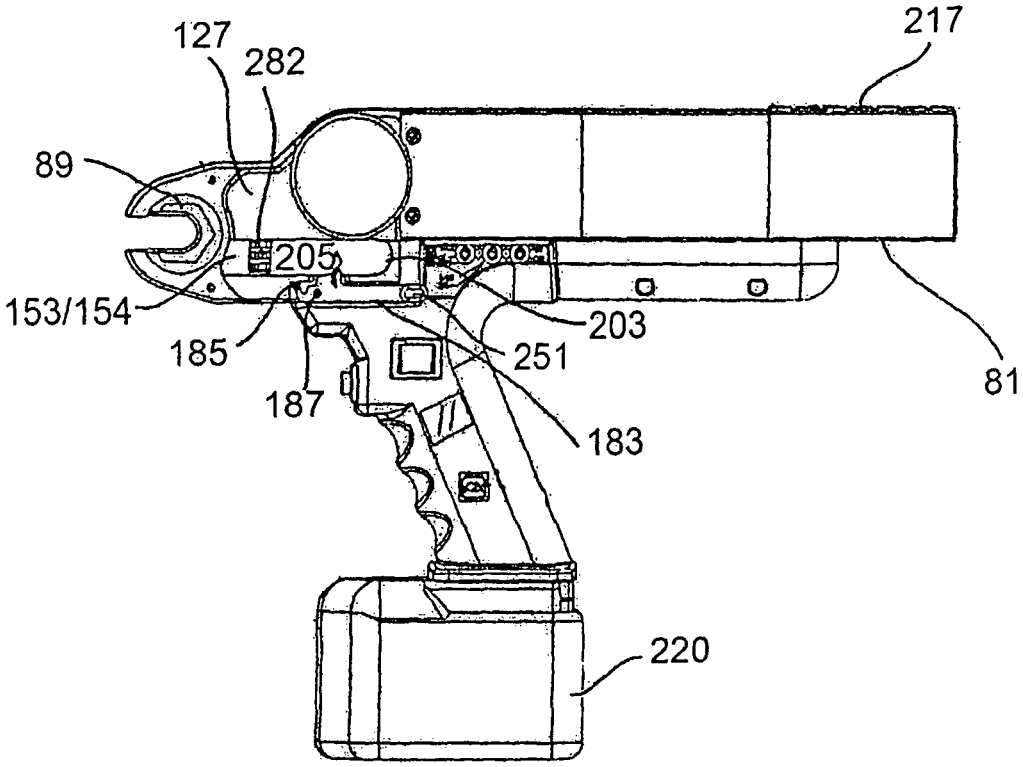
FIG. 18 is a side view illustrating the receiver of the embodiment of FIG. 13.
Figure 19:
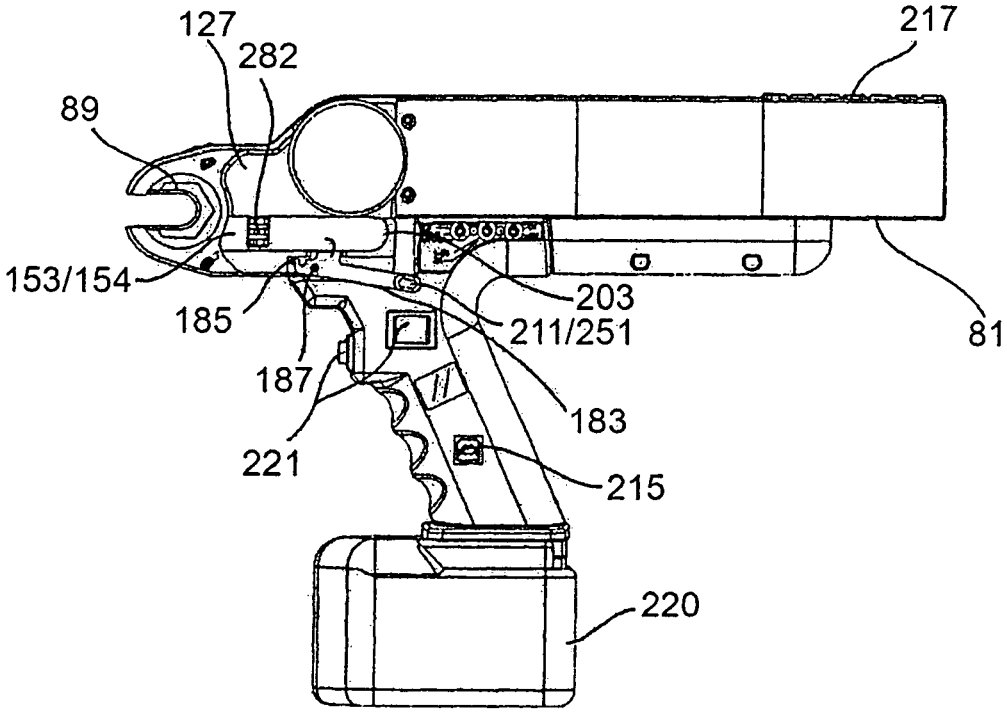
FIG. 19 is a side view illustrating latch operation at the receiver of the embodiment of FIG. 13.
Figure 20:
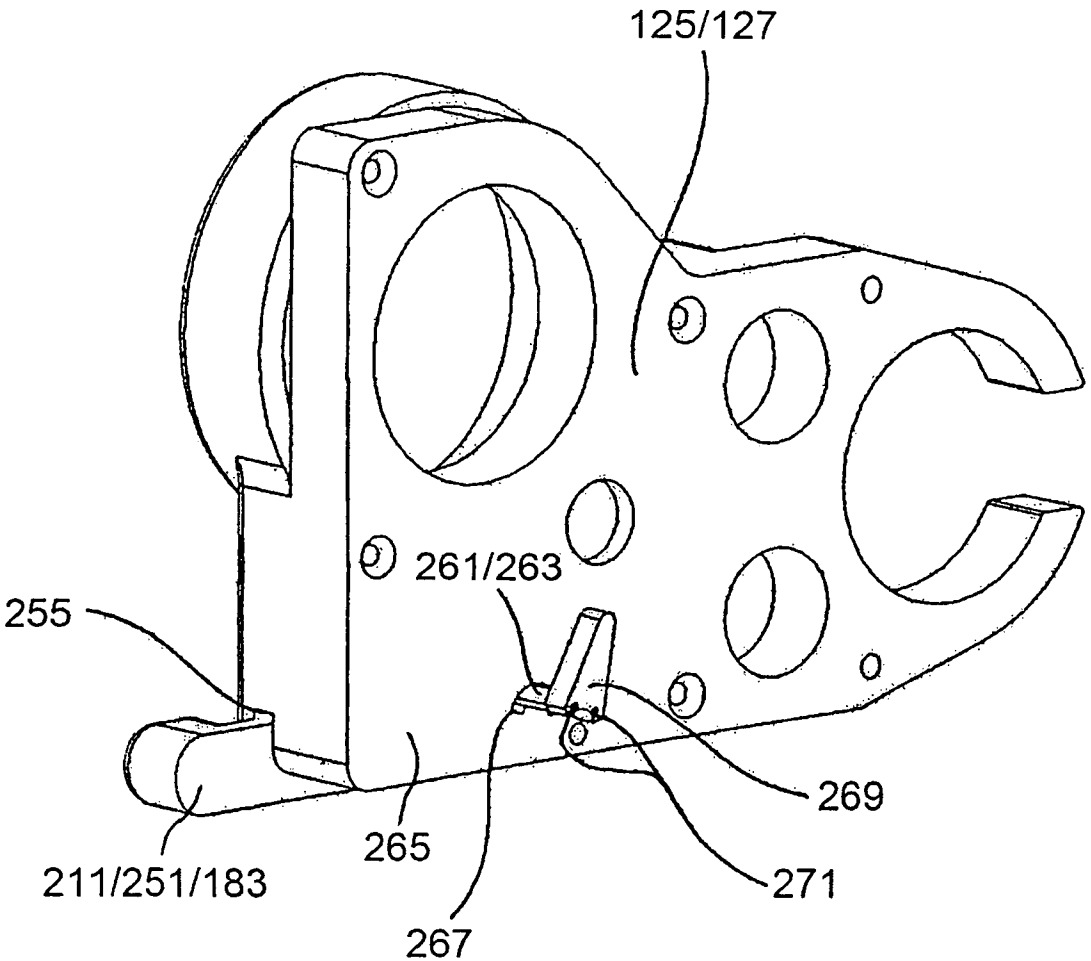
FIG. 20 is a perspective view of the reverse side of the latch and receiver shown in FIG. 19.
Figure 21:
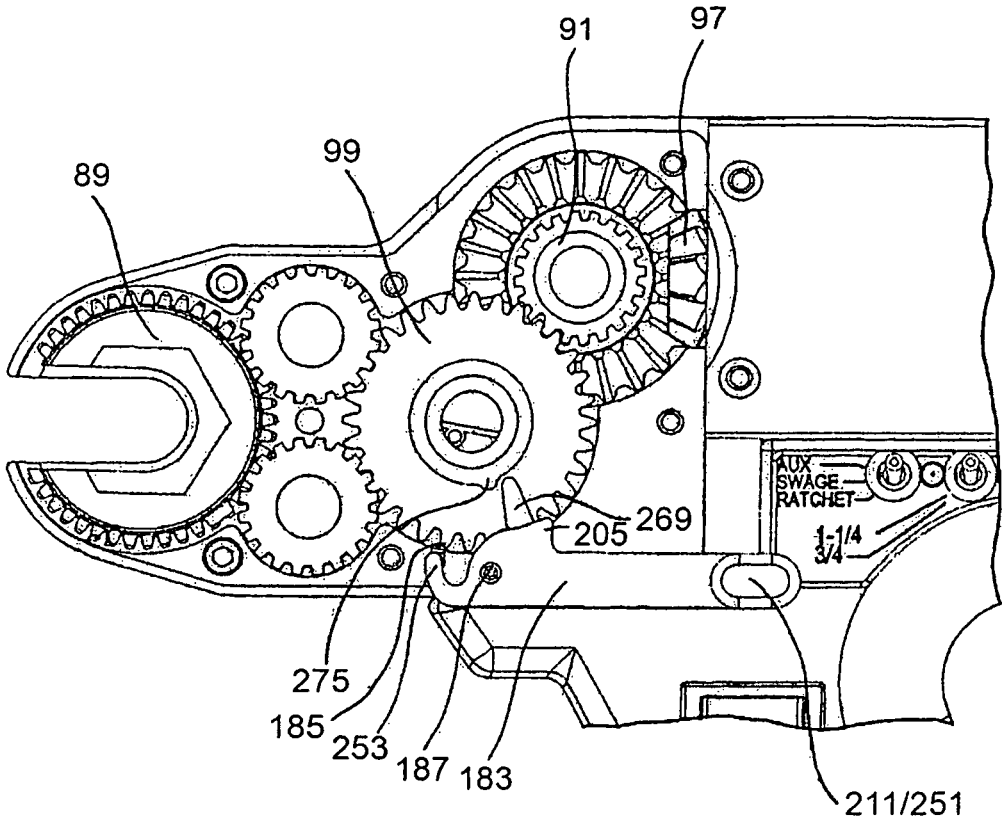
FIGS. 21 and 22 are side view illustrations showing automatic operation of the latch illustrated in FIG. 19.
Figure 22:
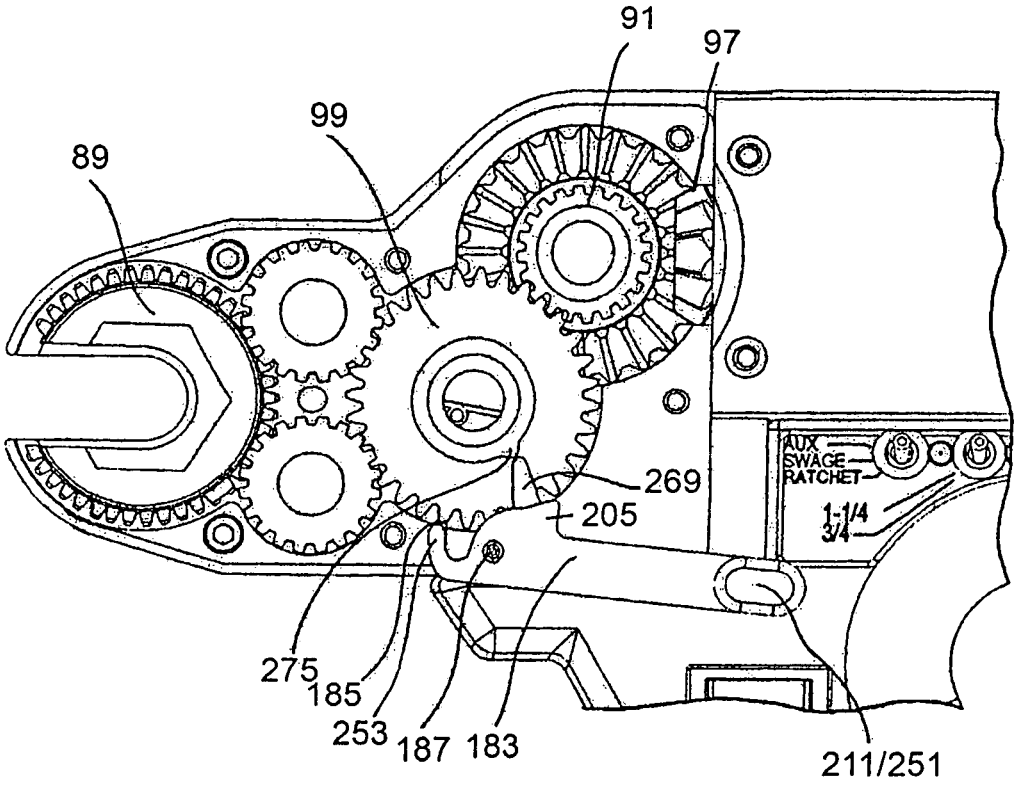
Figure 23:
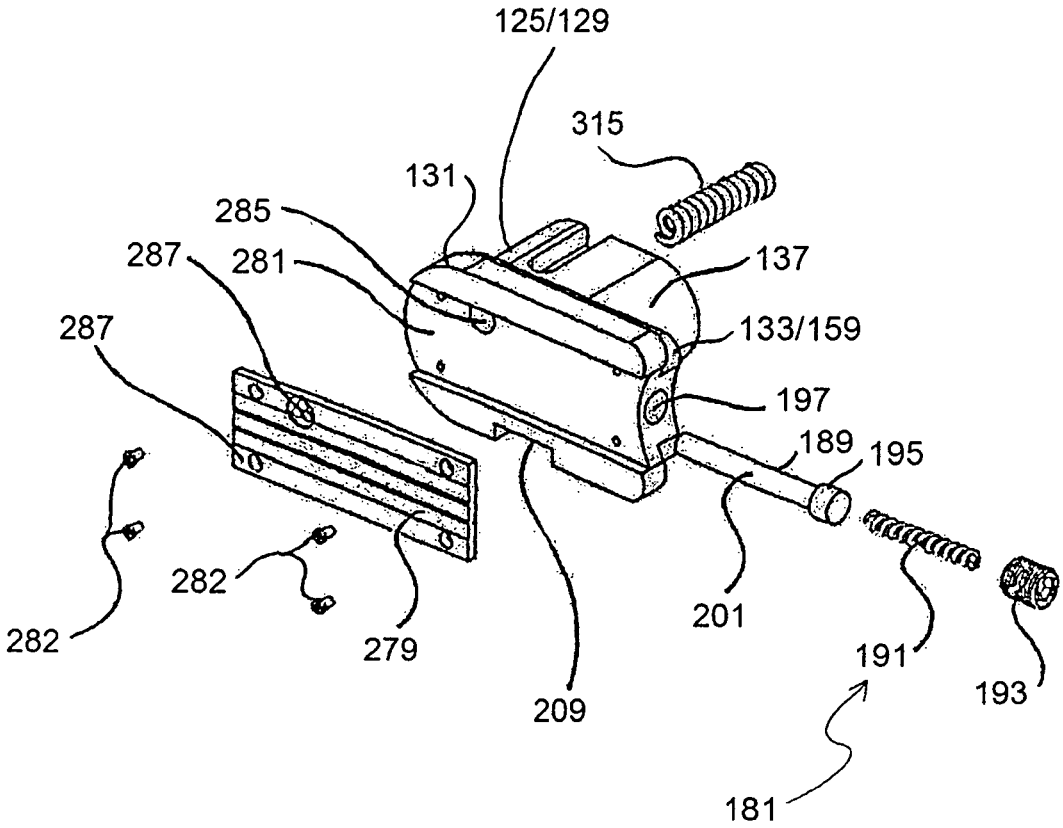
FIG. 23 is an exploded view of a utility tool mounting body of the adaptation of this invention adapted for use with the embodiment of FIG. 13.
Figure 24:
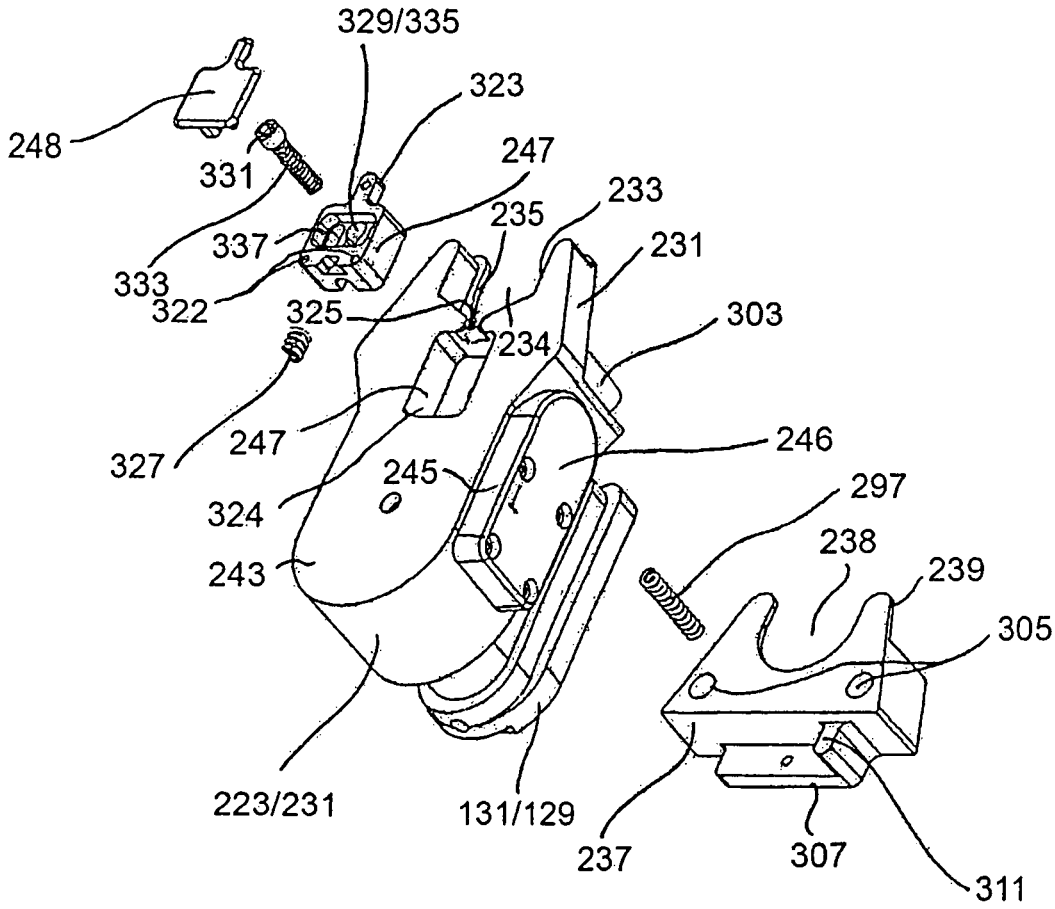
FIG. 24 is another exploded view of the embodiment of FIG. 13.
Figure 25:
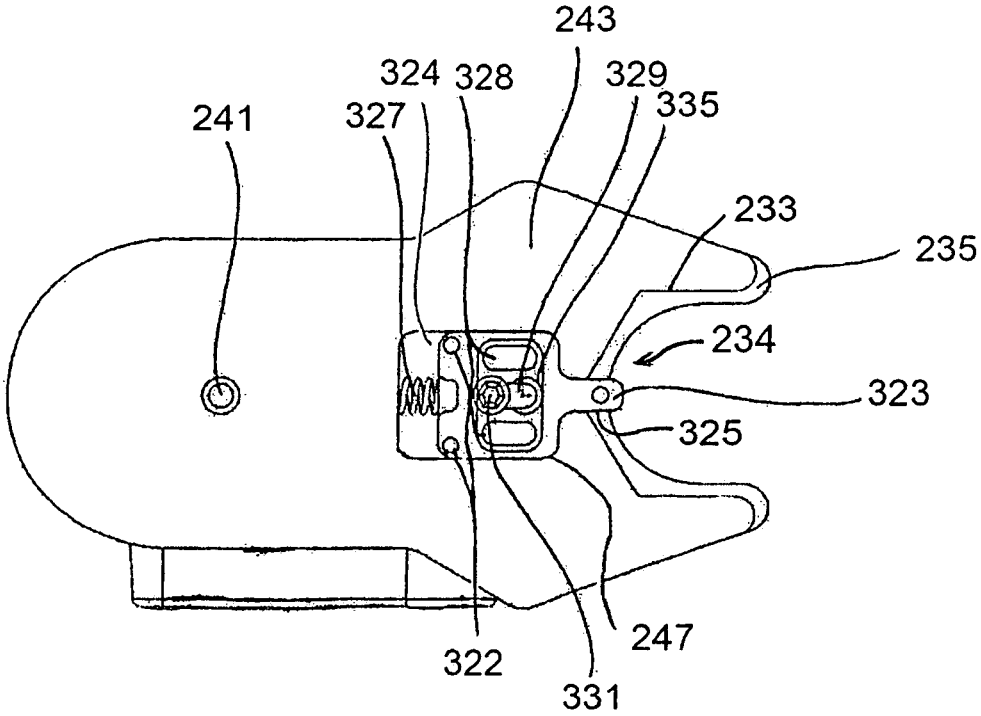
FIG. 25 is a top view of the embodiment of FIG. 13.
Figure 26:
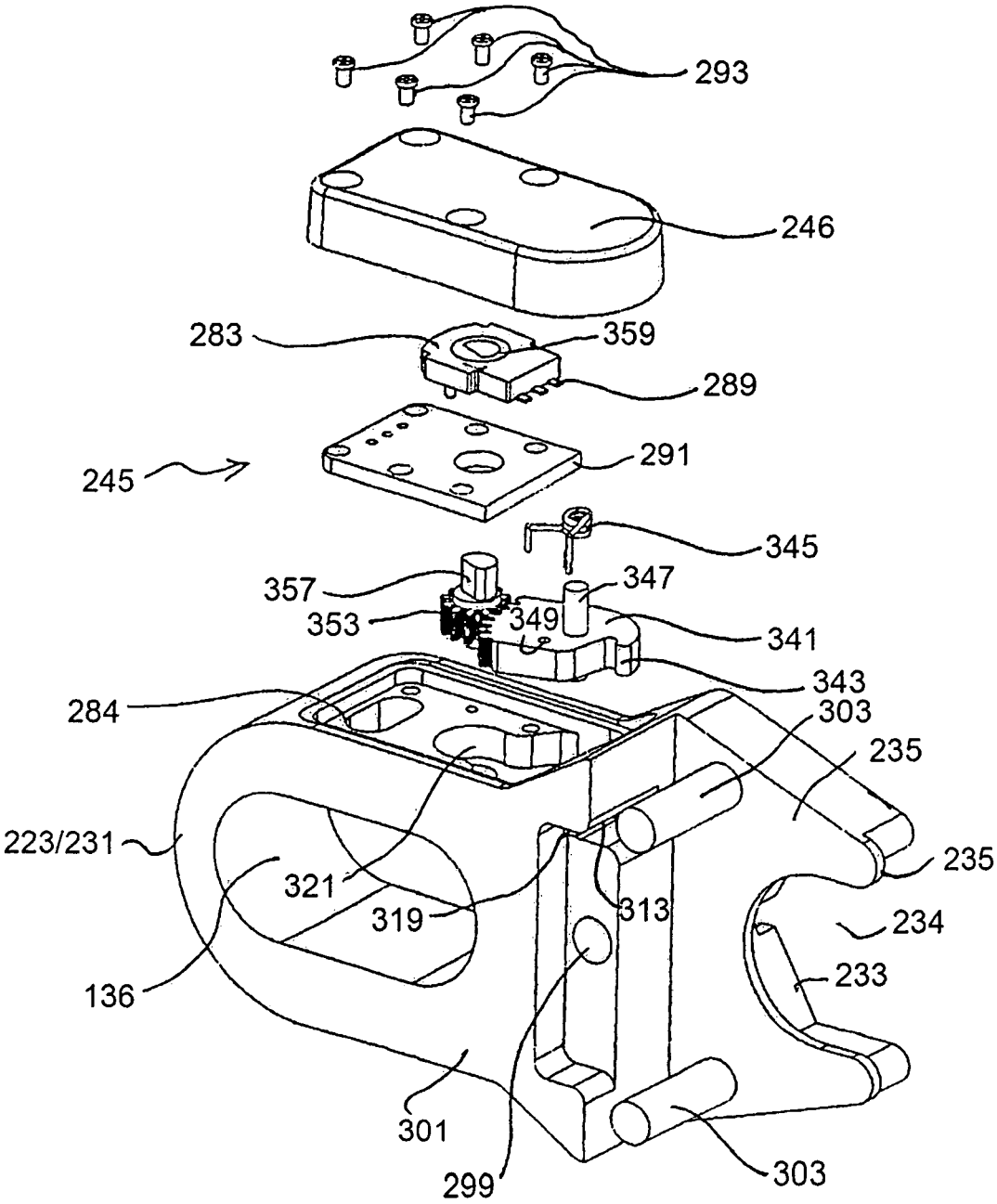
FIG. 26 is a another exploded view of the embodiment of FIG. 13.
Figure 27:
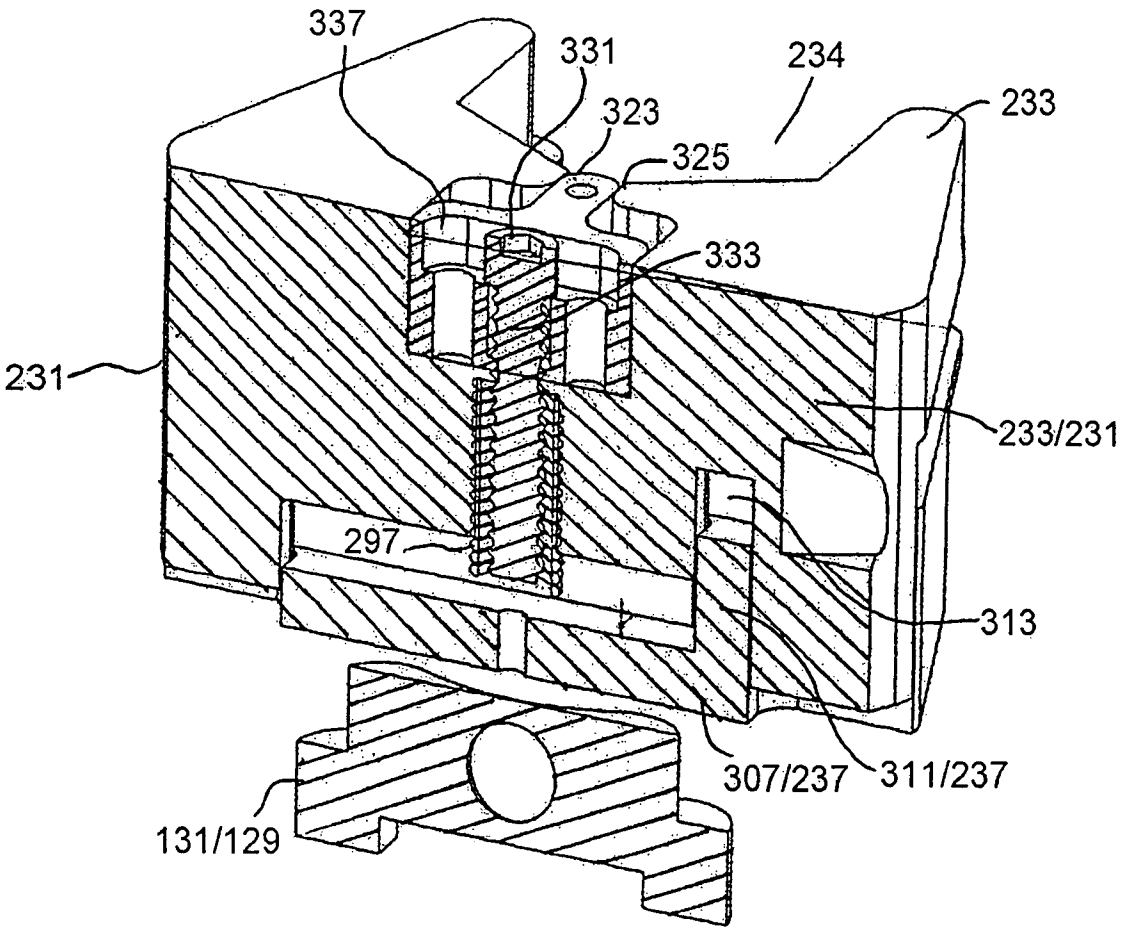
FIG. 27 is a sectional view of one portion of the embodiment of FIG. 13.
Figure 28:
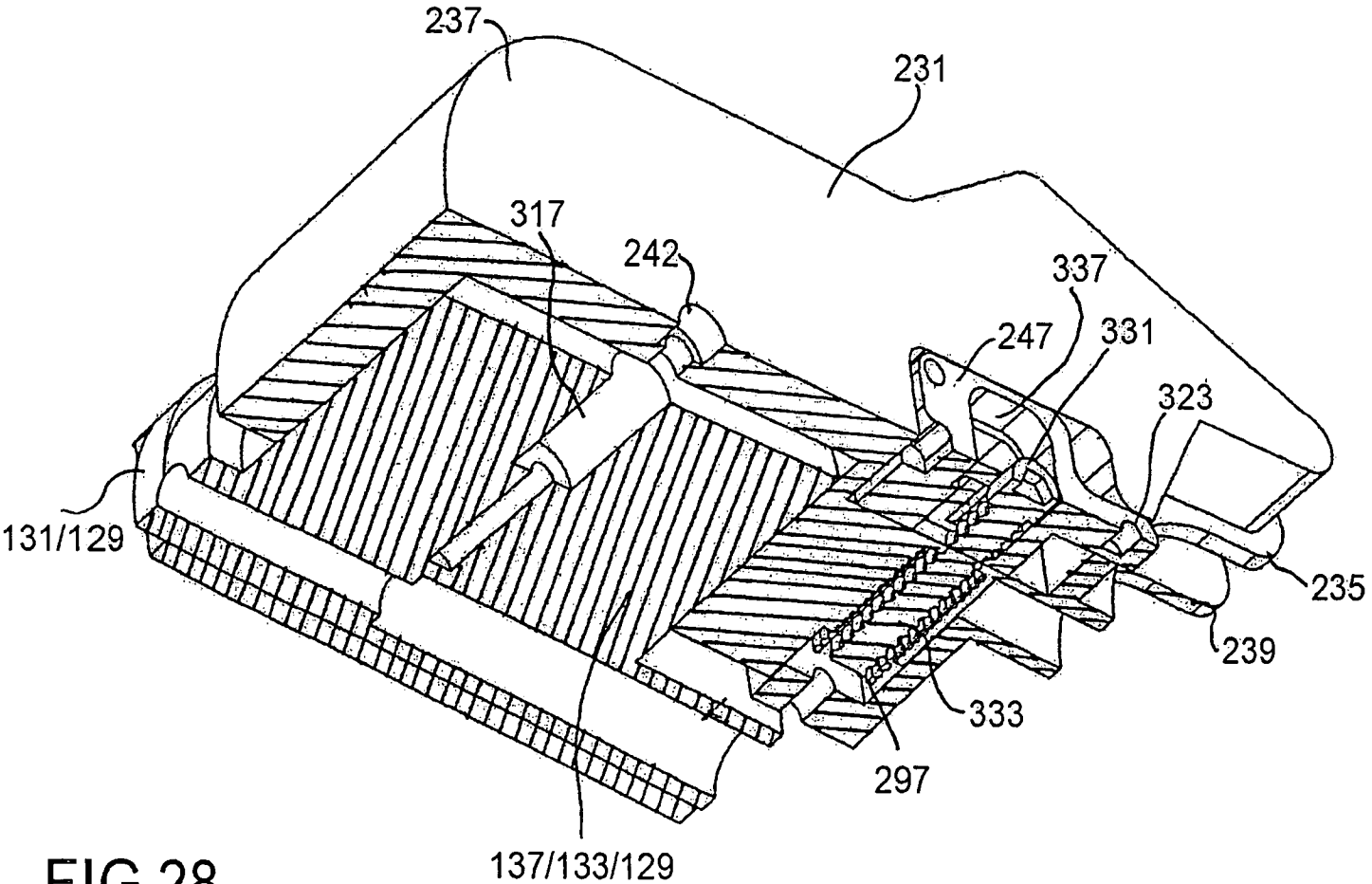
FIG. 28 is another sectional view of the portion of the embodiment of FIG. 13 shown in FIG. 27.
Figure 29:
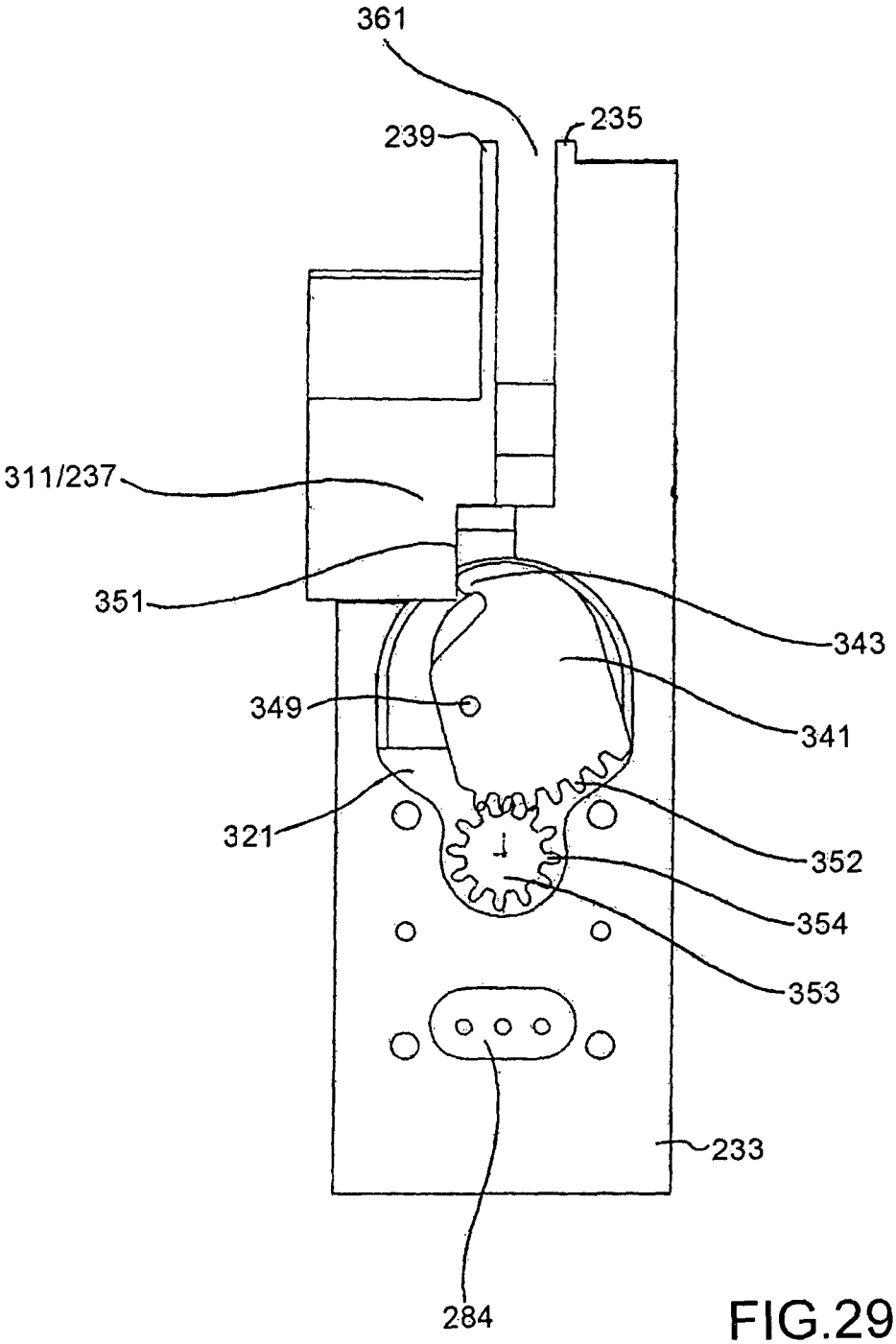
FIGS. 29 and 30 are a top view illustrations showing operation of the embodiment of FIG. 13.
Figure 30:
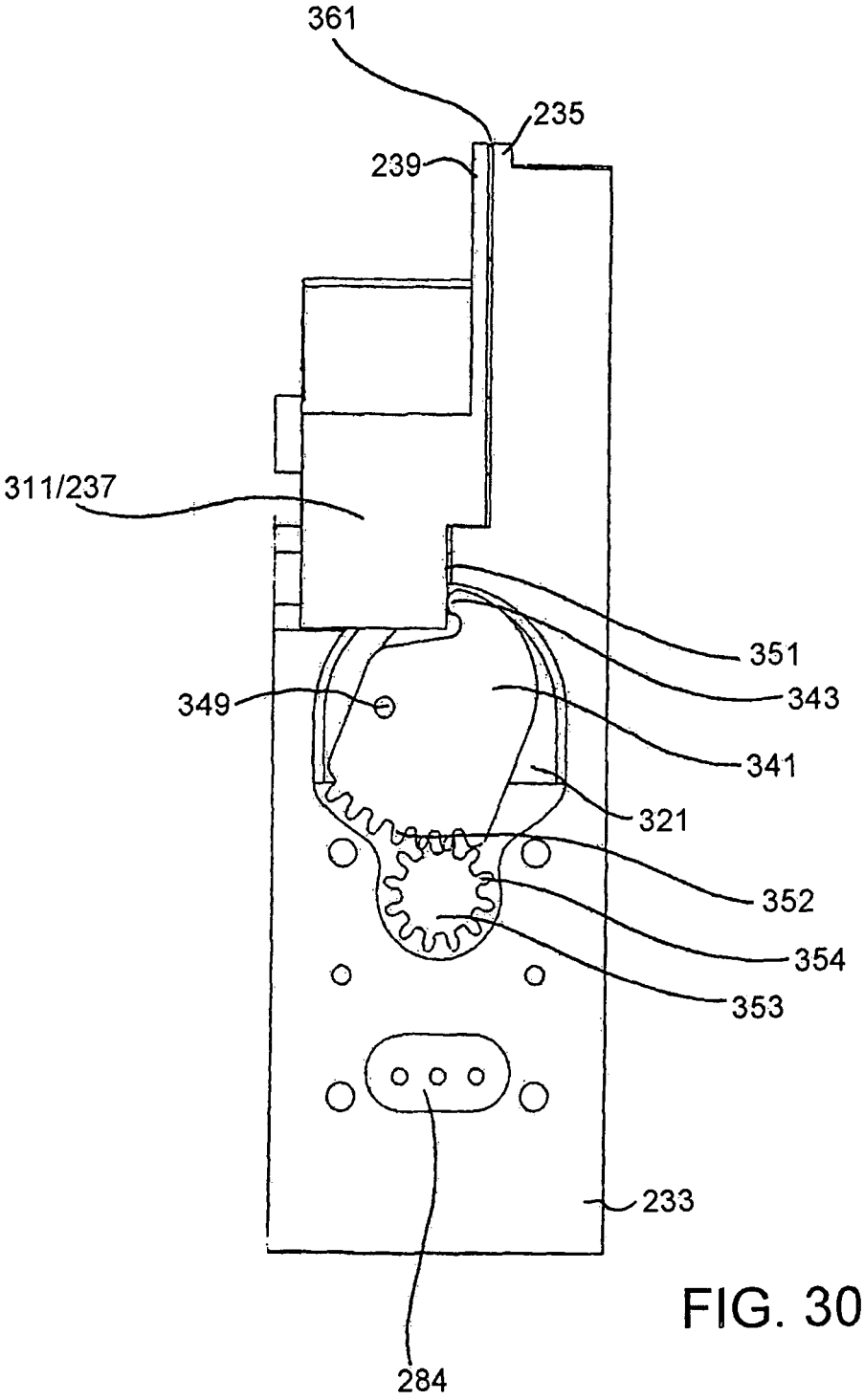
Figure 31:
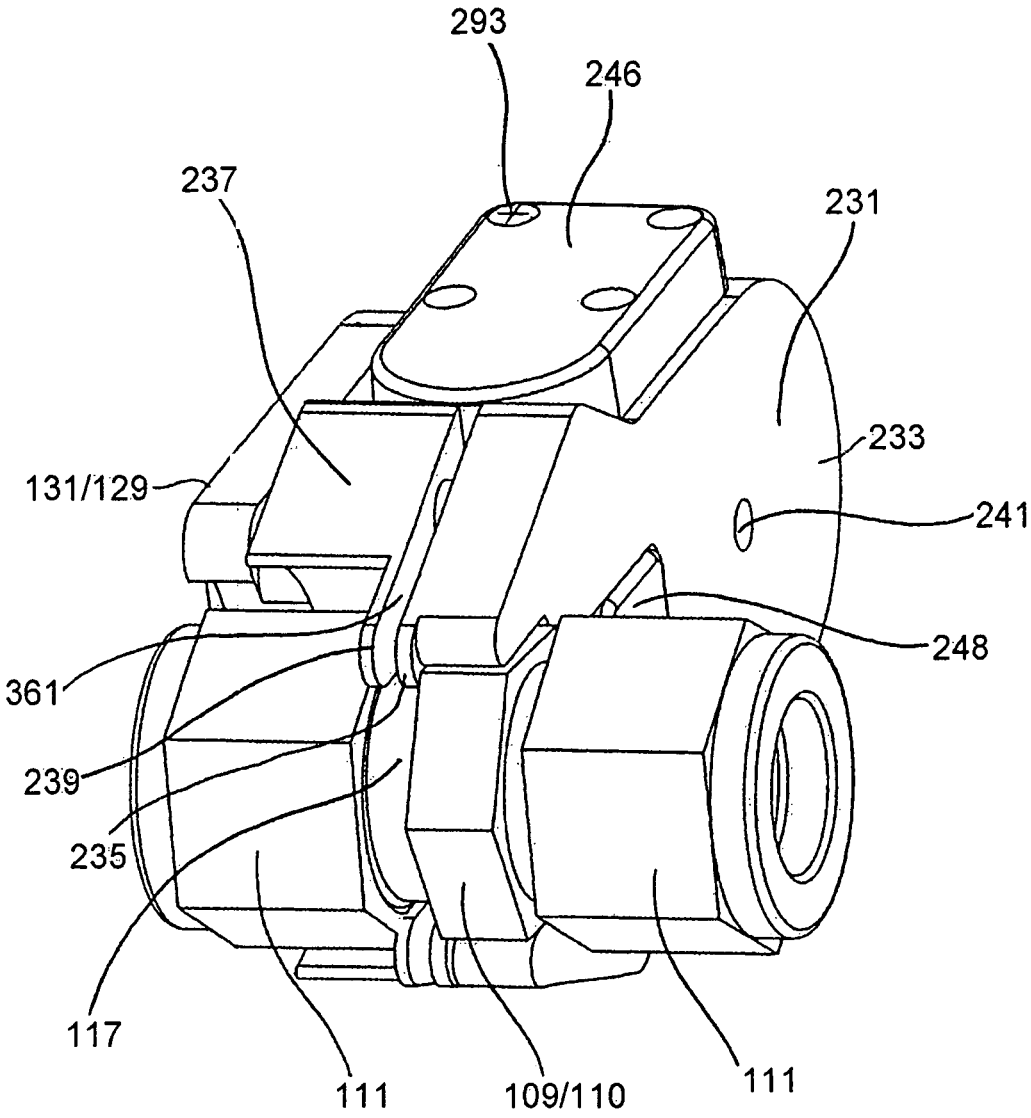
FIGS. 31 and 32 are perspective views further illustrating operation of the embodiment of FIG. 13.
Figure 32:
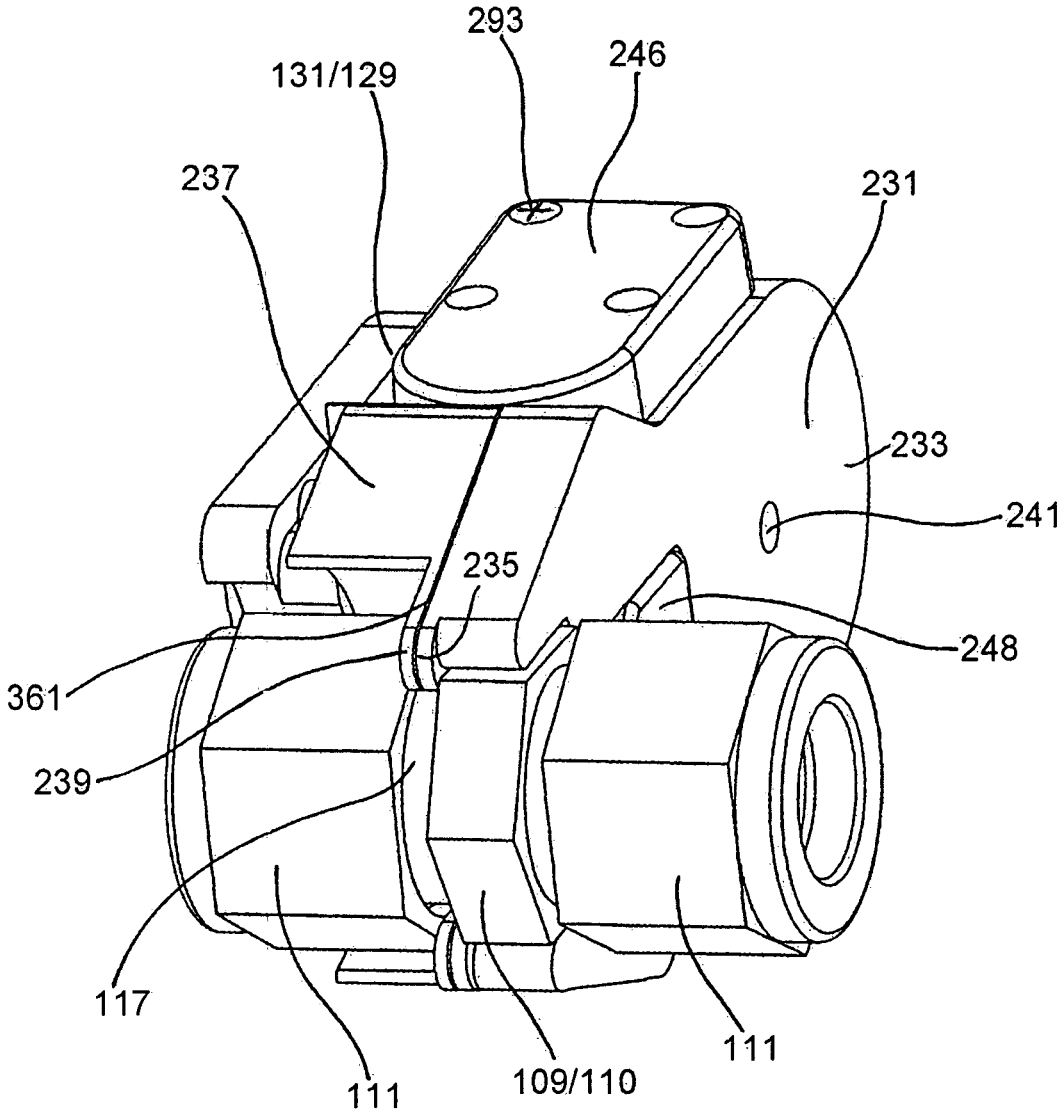
Figure 33:
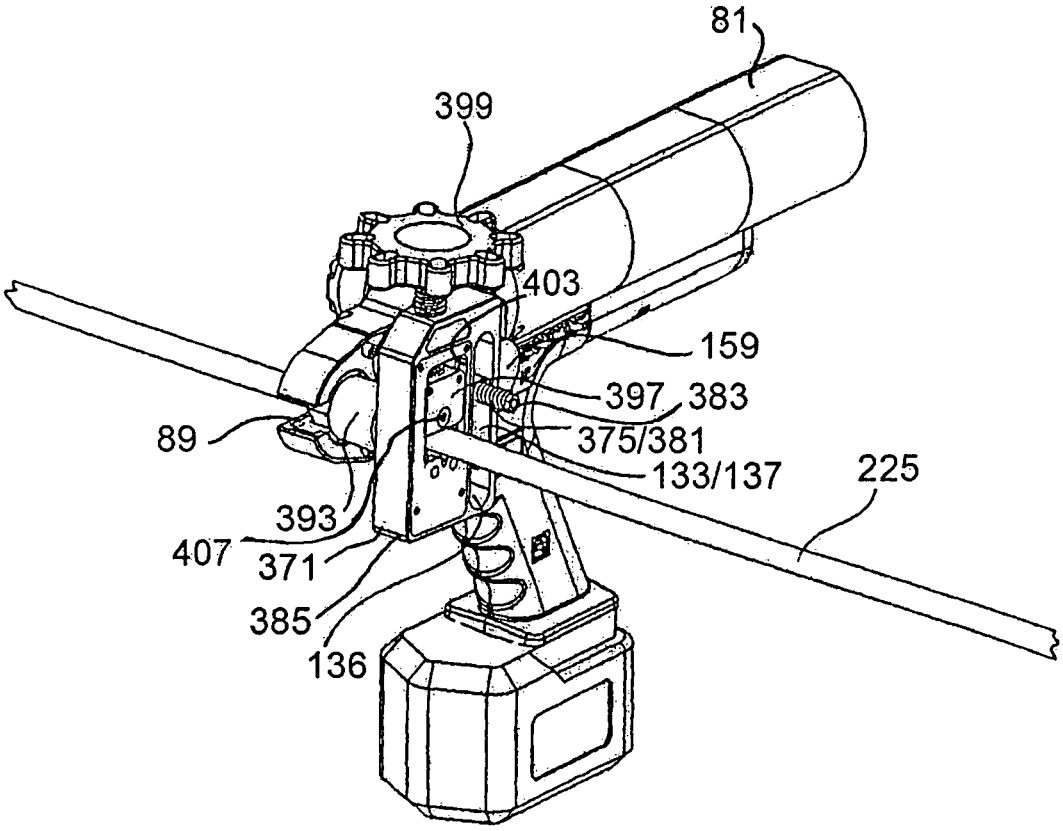
FIG. 33 is a perspective view of a third embodiment of this invention for tubing cutting using a nut driving tool.
Figure 34:
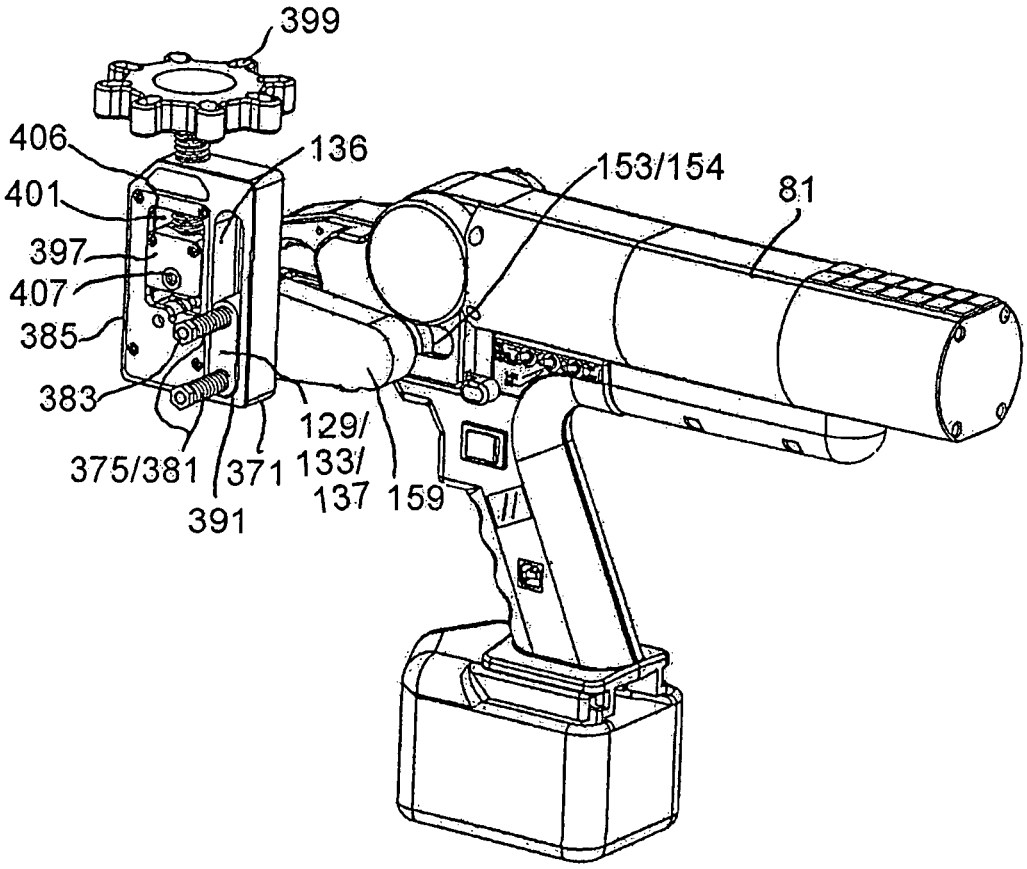
FIG. 34 is another perspective view of the embodiment of FIG. 33.
Figure 35:
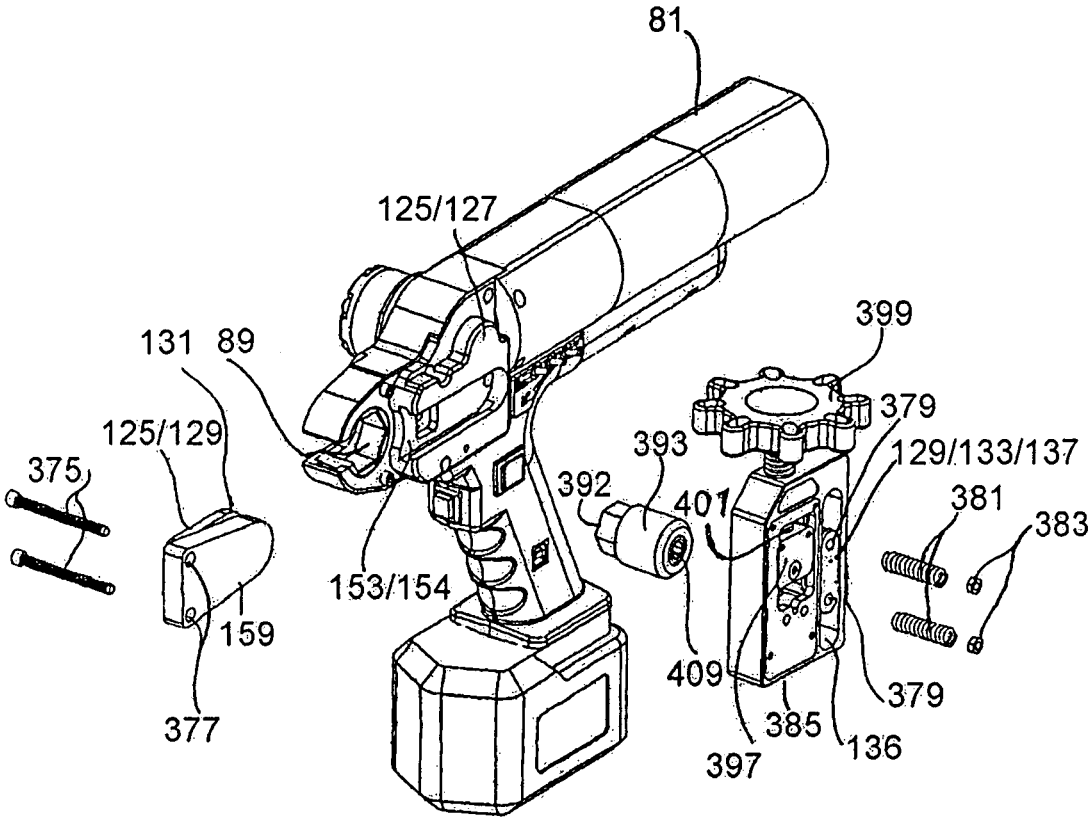
FIG. 35 is an exploded view of the embodiment of FIG. 33.
Figure 36:
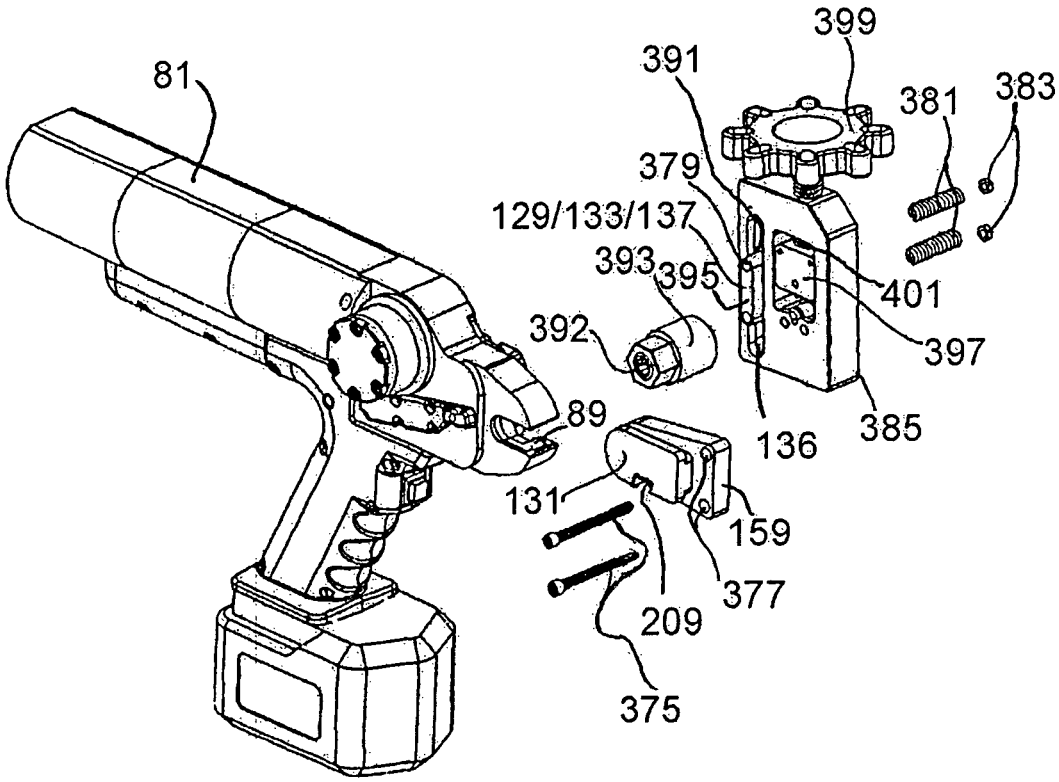
FIG. 36 is an opposite exploded view of the embodiment of FIG. 33.
Figure 37:
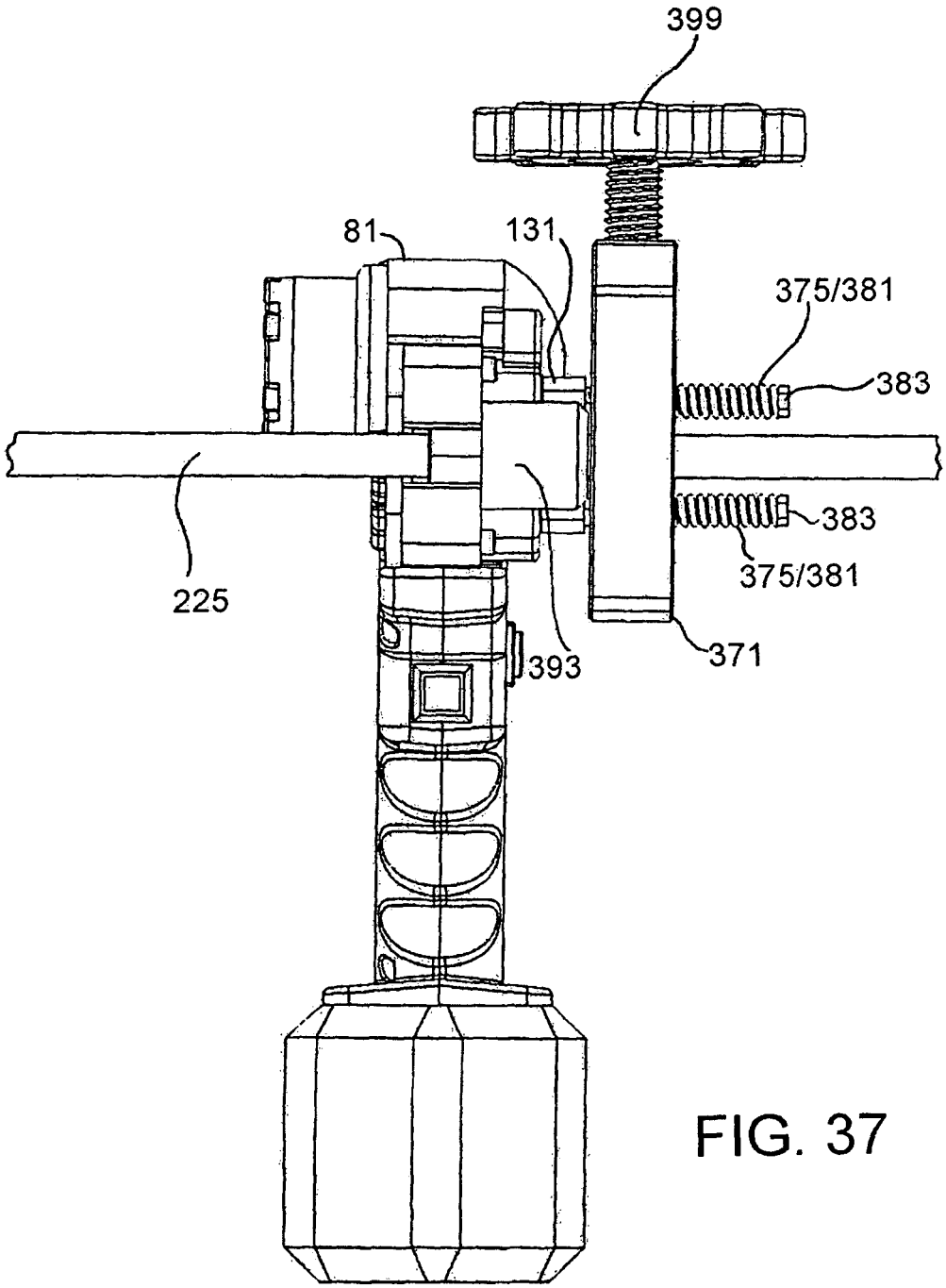
FIGS. 37 and 38 are side views of the embodiment of FIG. 33 illustrating use thereof.
Figure 38:
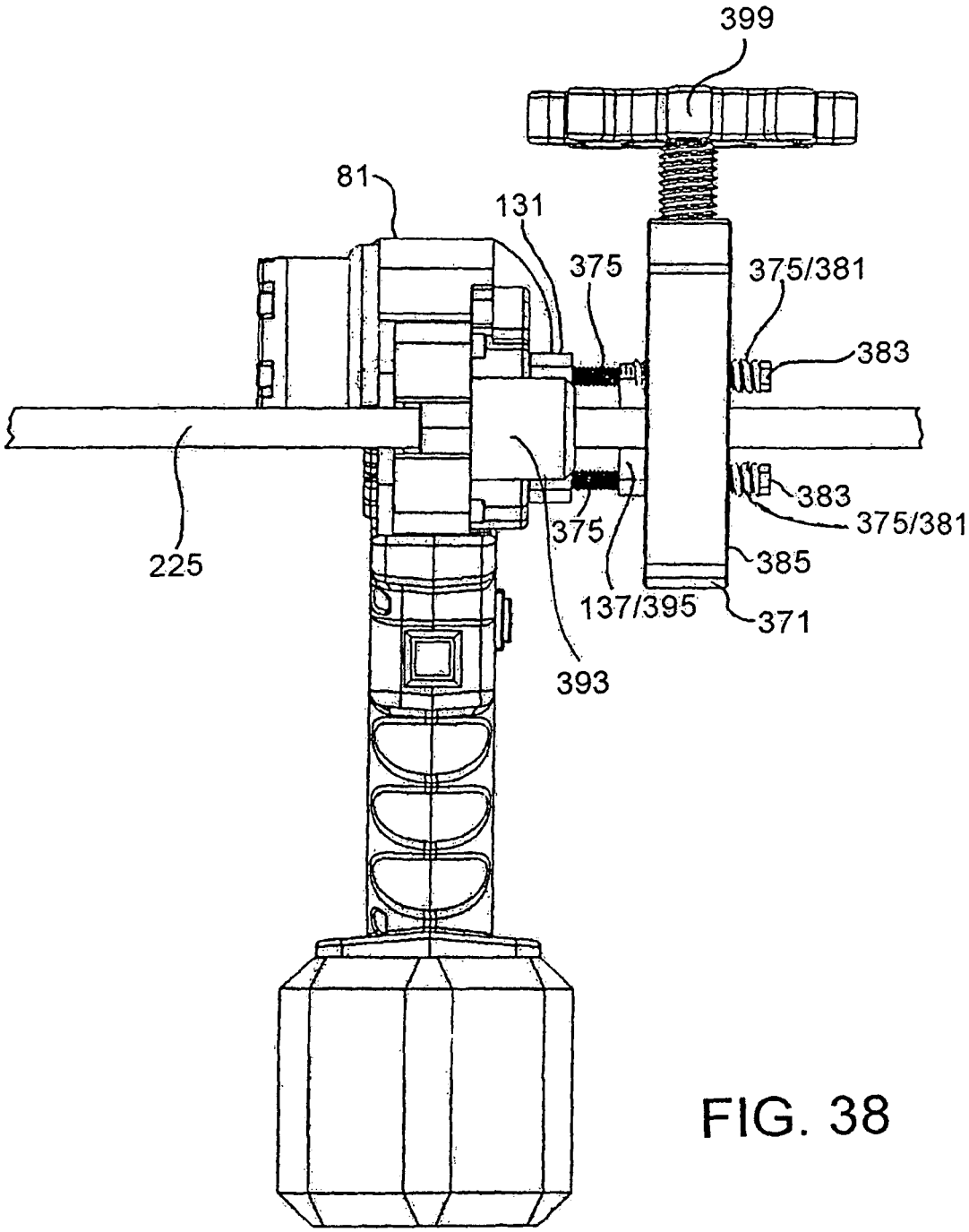

Biasing assembly 181 may be provided in combination with spring biased latch 183 including biasing spring 185 and pivot pin 187 to accommodate spring biased positioning of mounting body 129 adjacent to fitting 107 as desired. Assembly 181 includes pin 189, biasing spring 191 and set screw 193, pin 189 having an enlarged head 195. Passageway 197 through base portion 131 of mounting body 129 includes a threaded outer end for receipt of screw 193, and has an enlarged internal portion sized to receive and retain spring 191 and head 195 of pin 189 but reduced size outlet opening at end 199 of base portion 131 (not shown) sized to allow passage therethrough of pin body 201 but not head 195. When secured in passageway 197, the end of pin body 201 extends from end 199 of base portion 131 and engages detent 203 at the end of slideway 154. Operating against the bias of spring 191, when mounting body 129 is slid onto receiver 127 in slideway 154 pin 201 compresses spring 191 as end 199 of body 131 is moved rearward. Latch 183 is located adjacent the lower undercut edge 155 of slideway 154 and is biased by spring 185 so that catch 205 is located in the track at edge 155 (see also FIG. 17). As mounting body 129 is moved rearward in slideway 154, catch 205 is engaged and depressed by the lower outer edge 207 of base portion 131 until the catch reaches notch 209. Catch 205 is then released under bias into notch 209 thereby allowing body 129 and tool head 135 to be held in a retracted position as shown in FIGS. 10 and 11.

Figure 12:
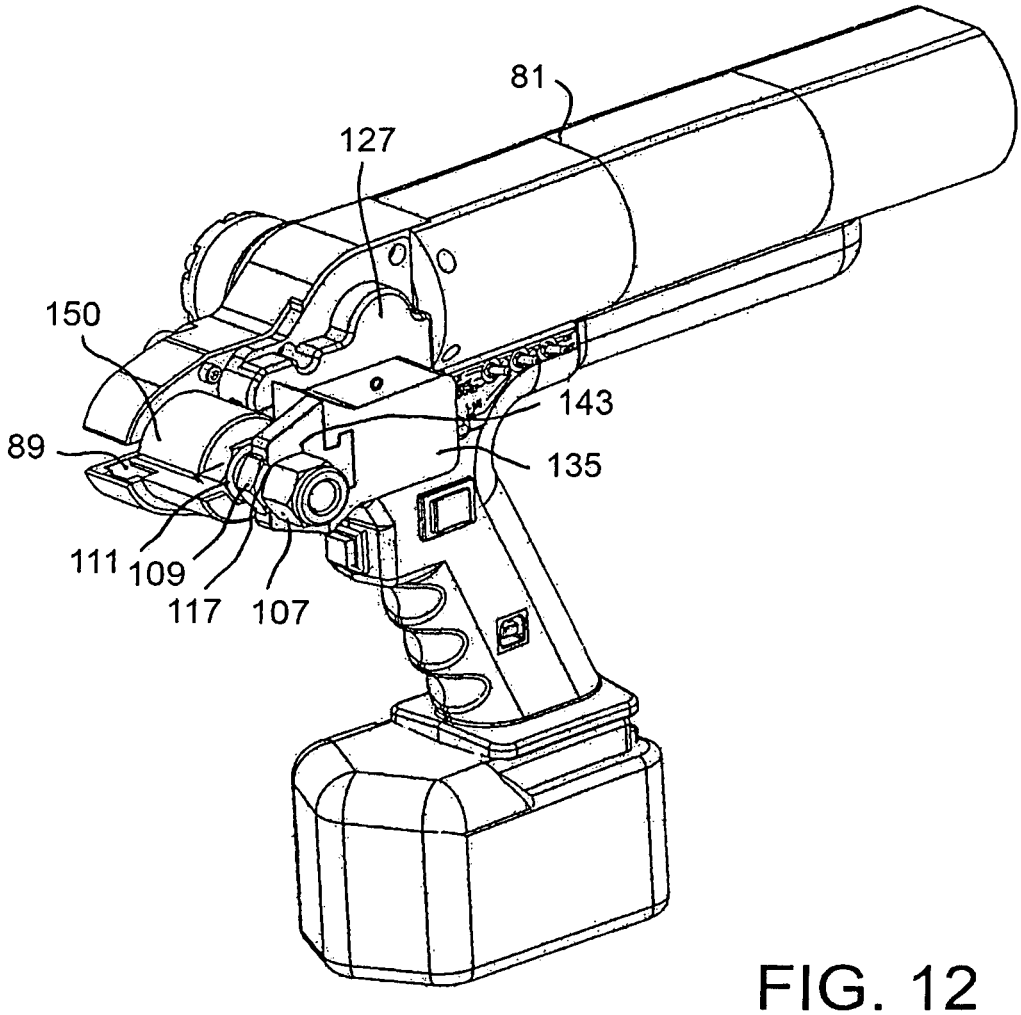
Figure 13:
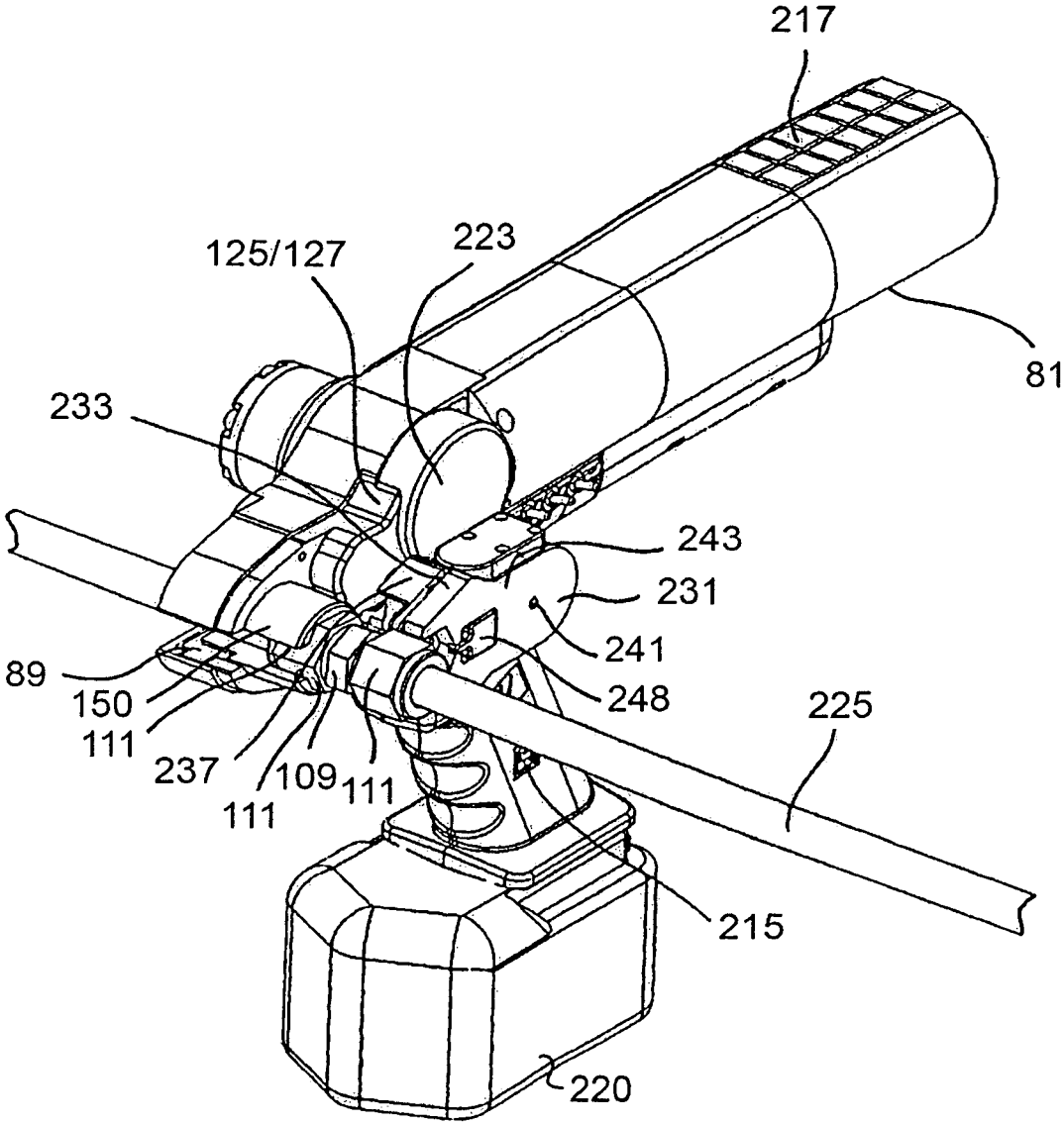
FIG. 13 is a perspective view of a second embodiment of this invention including means for nut to body gap measurement.
Figure 14:
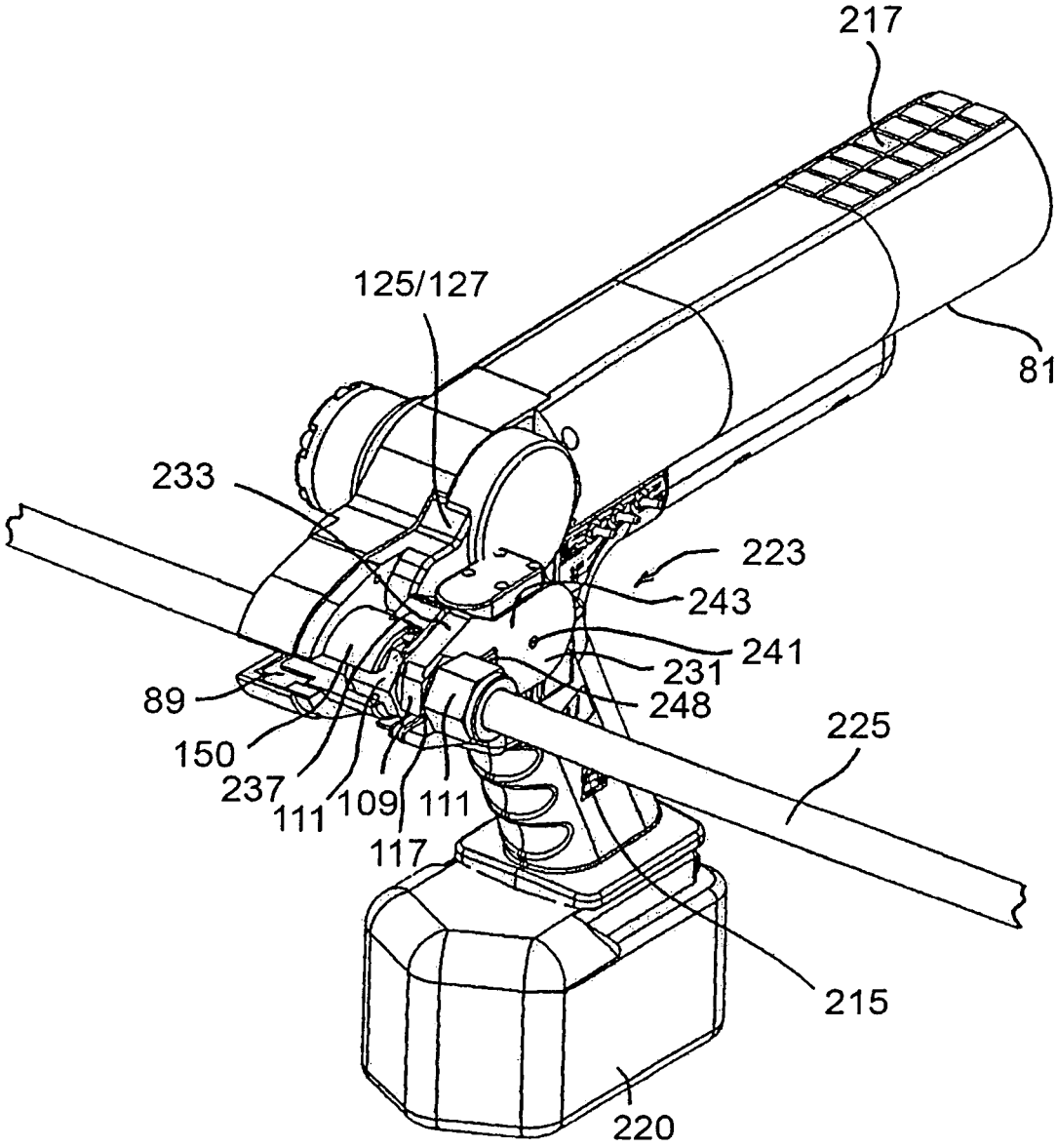
FIG. 14 is a perspective view showing the embodiment of FIG. 13 engaged.
Figure 15:
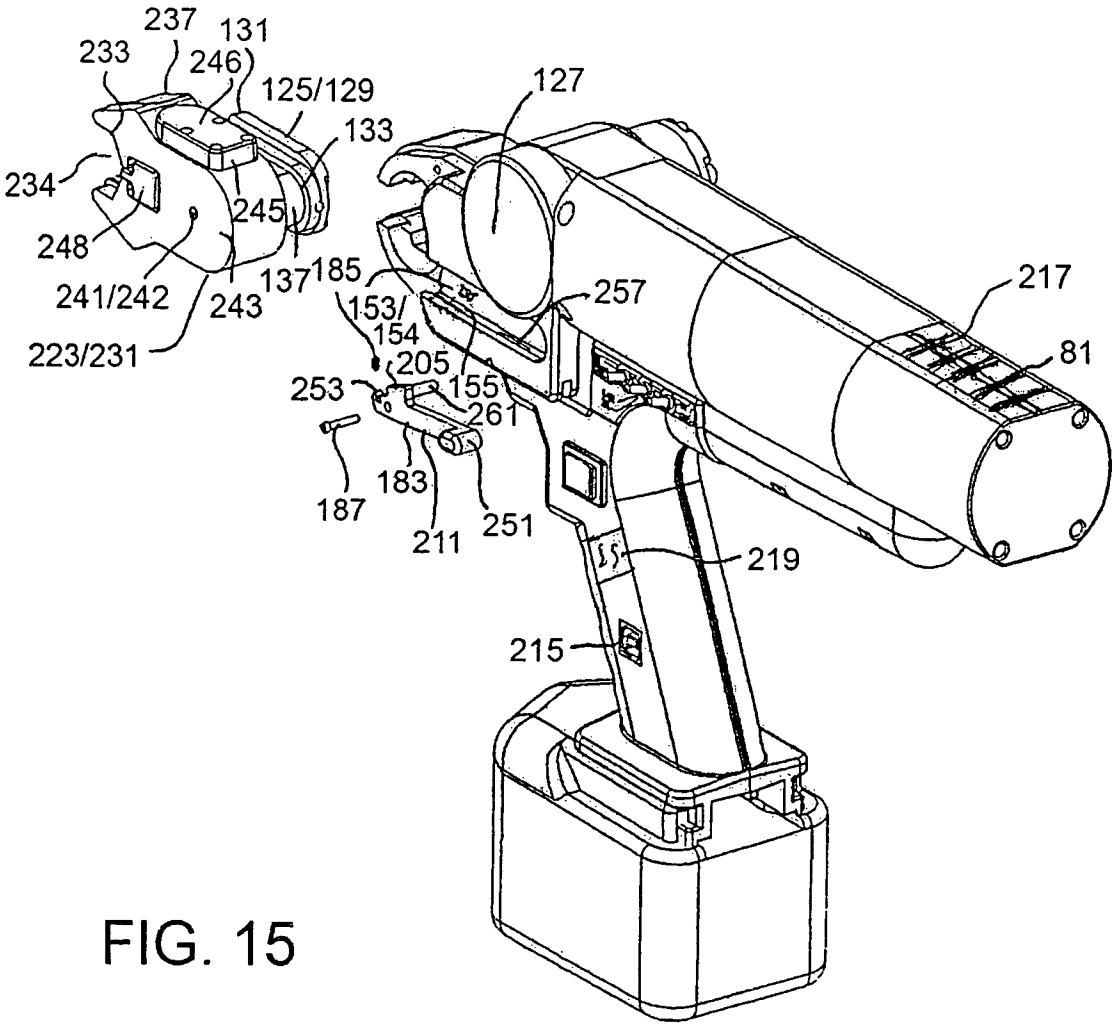
FIG. 15 is an exploded view of the embodiment of FIG. 13.
Figure 16:
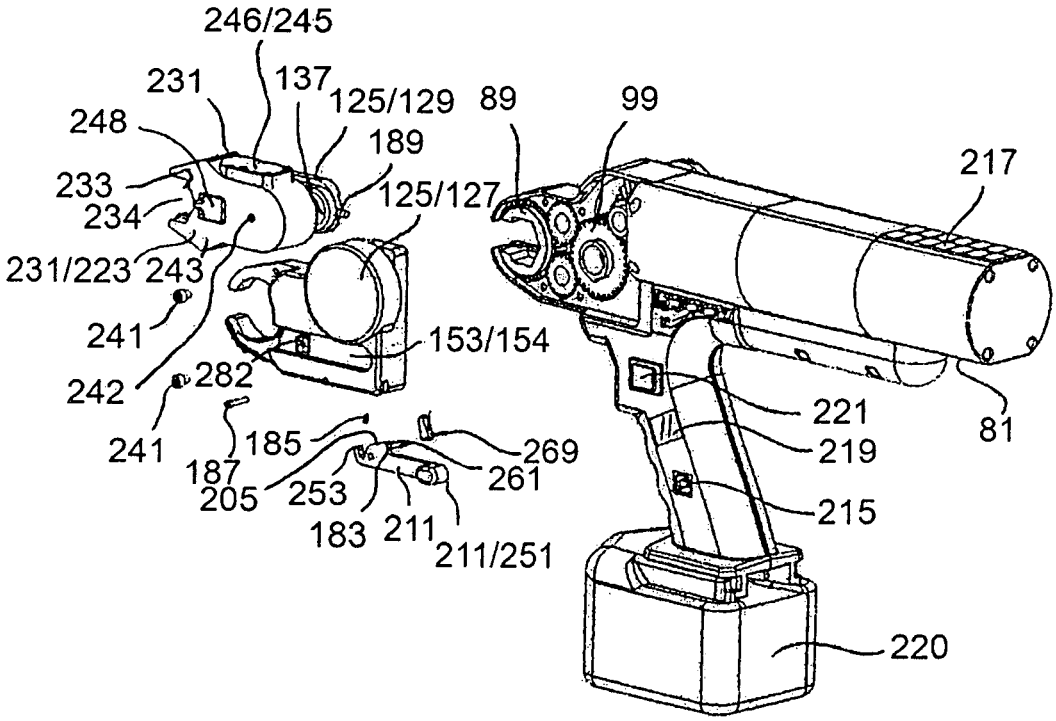
FIG. 16 is another exploded view of the embodiment of FIG. 13.

When blade unit 143 is positioned on tool head 135, lever arm 211 of latch 183 is depressed by the operator, thus rotating catch 205 against bias out of engagement in notch 209. When thus released, mounting body 129 is automatically biased toward engagement with fitting 107 by biasing assembly 181. As the fitting is rotated by socket 150, blade unit 143 continues to await proper presentation, riding against the fitting until portion 147 engages the facets of center nut 109 with blade 149 in gap 117 as shown in FIG. 12.

Another embodiment of a utility tool of this invention is illustrated in FIGS. 13 through 32 which incorporates electronic measuring utilizing a reaction utility tool of the type previously shown in combination with an arrangement functioning as a micrometer. For best possible utilization of this embodiment, several enhancements of tool 81 and its operating software/firmware are implemented (the structure of which will be addressed hereinafter). USB port 215, keypad input programming tool 217, and OLED (organic light emitting diode) screen 219 for graphical data presentation to the operator are provided. A battery pack Screen 219 is preferably a high bred color monitor for the display of nut to body gap, full color graphics, recorded presentations of the use of the tool and the like. Keypad 217 is utilized to analyze engineering formula to estimate torque through current draw, time calculations and the like. USB port 215 may be used for downloading quality assurance data, trouble shooting, and installation of instructions in any language, remote reprogramming of the tool via the internet and/or printer/label output. Other enhancements can be provided such as a Bluetooth remote for remote control actuation, network monitoring, computer tracking, and project updates. A standard battery pack 220 and operator controls 221 are provided.

A number of the features of this embodiment are similar to those heretofore described, including the features of adaptation 125, except as addressed herein. This utility tool 223 is received at tool 81 as heretofore described, and is particularly adapted as a precision electronic torque reaction unit communicating with onboard programming and operation of tool 81 to repeatedly achieve correct nut to body gap swaging of fitting 109 on tube 225. Tool 223 not only captures the fitting but also provides a mechanical linkage in concert with a potentiometer essentially integrating an electronic micrometer. As will be seen, the unit as a whole is properly placed on the fitting to capture non-rotating center nut 109 of the fitting body, various movable and stationary blades that comprise the micrometer are positioned between nut 111 that's rotating and stationary nut 109, the blades of the micrometer being biased apart from one another under spring tension to assure contact at both sides of fitting nut to body gap 117. Tool 223 remains out of the way during positioning of tool 81 drive socket 89 (or an extension socket of appropriate length 150) onto driven nut 111 of the fitting, tool 223 being capable of automatic deployment thereafter.

This measurement device/reaction unit combination tool 223 includes tool head 231 having mounting interface 136 at a bottom surface thereof (see FIG. 26) as heretofore described. Head 231 includes nut facet grasping portion 233 faceted at gapped jaw 234 having first micrometer blade 235 thereat, and second slidable/movable micrometer blade carriage 237 at gapped jaw 238 having blade 239 thereat (see FIG. 24). A tower height adjustment screw 241 is receivable through threaded opening 242 in top housing surface 243 may be provided for setting one limit of head 231 movement on station tower 137. Sector gear/electronics module 245 having cover 246 resides at one side of tool head 231 and trigger rod capture box 247 having cover 248 resides in surface 243.

As shown in FIGS. 15 through 22, latch 183 includes manipulable end 251 at the terminus of arm 211. Spring retainer tip 253 captures biasing spring 185 for biasing against the top surface of retainer slot 255 in receiver 127 adjacent lower undercut edge 155 of slideway 154. Latch 183 is pivotably located in slot 255 by pin 187 with catch 205 extendable through opening 257 between edge 155 and slot 255. Stem 261 having arcuate end 263 extends through inner receiver wall 265 from slot 255 through arcuate opening 267 (see FIG. 20). Lug 269 is secured to end 263 with screws 271.

In operation, as in the prior embodiment, when tool 223 is mounted to tool 81 for use as discussed hereinabove linear movement along slideway 154 to the end thereof move rod 189 and compresses spring 191. This compression reacts to push tool 223 mounting body 129 forward towards the slideway opening for engagement with a fitting. Prior to placement on a fitting it is useful to have the tool remain latched at the aft end of slideway 154 to avoid interference while positioning the tool during alignment with fitting 107. Engagement of catch 205 of latch 183 in notch 209 of base portion 131 of mounting body 129 accomplishes this, and release may occur by operator manipulation of end 251 of arm 211 of latch 183 as described hereinbefore (see FIGS. 18 and 19).

But with installation of lug 269 spring biased to a home position, and by providing a cam lobe 275 a main drive gear 99, catch 205 of latch 183 is moved automatically with normal operation of driver 81. Normal actuation of power driver 81 provides rotation to gear 99 which rotates cam lobe 275 positioned and timed relative to lug 269 for timed actuation and simultaneous release of tool 223 by imparting up and down movement of lug 269 thereby rotating latch 183 and displacing catch 205 to disengaging from notch 209 allowing biased movement of tool 223 from base portion 131 (see FIGS. 20 through 22).

Multiple element electrical strip connector 279 fits snugly in a pocket 281 of base portion 131 of mounting body 129 (retained by screws 282) for providing electrical connection with electronics of nut driver tool 81 through three point male slide connector 282 at slideway 154. Signals (variations in electrical resistance values from variable potentiometer 283 for example) are communicated via wiring passing through tool head opening 284 to interface opening 136, then to passageway 285 through body 129 to connector 287 at strip connector 279 (see FIGS. 23 and 26). Three wire systems could be utilized for serial communication, both asynchronous and synchronous (i.e., RS232 or IC2). Potentiometer 283 is wired at contacts 289 and mounted on mounting board 291. Cover 246 to electronics module 245 and board 291 are retained by screws 293.

Blade carriage 237 is biased away from tool head portion 233 by spring 297 received in opening 299 at bottom surface 301 of portion 233, and is slidably mounted on posts 303 received in slide openings 305. L-shaped contactor wall 307 had detent 309 thereat for locating the opposite end of spring 297, contact leg 311 movable slidable in slot 313 of portion 233 (see FIGS. 24 and 26). When inserted within a fitting gap 117, blade 239 moves in direct correspondence to movement of nut 111 of fitting 107 rotated on the thread of fitting body 110 during the swaging process. Spring 315 resides in opening 317 (FIG. 28) in station tower 137 to maintain the height of head portion 233 relative to the top of station tower 137 absent user intervention against spring bias. Slot 313 communicates through wall 319 to chamber 321 housing electronics module 245.

Trigger rod capture box 247 includes openings 322 for receipt of snap tabs of cover 248 and release trigger 323, a tab on the leading edge of the carriage box and its cover. Capture box 247 provides trigger and blade position control means for automatic blade relative position retention and release between operations to assure that the blades are easily positioned between nut and body of a fitting at the beginning of swaging operations. Control box 247 is biased forward in chamber 324 toward gapped jaw 234 with tab 323 extending thereinto through channel 325 by compression spring 327 biased against the back face of chamber 324 thus allowing slidable disposition of carriage box 247 in chamber 324 on slide opening guides 328. Slotted keyway 329 captures head 331 of rod 333 at enlarged portion 335 when a fitting received at 234 contacts trigger 323 after latch 183 release, thus sliding box 247 rearward in chamber 324 releasing blades 235 and 239 for deployment adjacent the rotatable body nut 109 and nut 111, respectively, under bias of spring 297. As blade 239 is moved towards tool head portion 233 during swaging, the surface of contactor wall 307 moves toward the end of rod 333 (see FIG. 27), eventually contacting and raising the rod. When rod head 331 rises within capture box chamber 337 to a point that head 331 is no longer retained at enlarged portion 335, box 247 is free to snap forward under bias of spring 327 once released from the fitting thus retaining the relative positions of blades 235 and 239 in relatively close proximity for insertion between the next nut/body nut combination. Tool head 231 is then manually recocked by a user until relatched at 183, held at the ready for the next operation. When a new fitting is located at the tool, and the latch released, tool head 231 is again biased forward into contact with the fitting and the process repeats.

Travel of blade 239 is measured by movement of sector gear 341 formed integral with a contact finger 343 biased by spring 345 (over gear pivot post 347, one leg of which is held in opening 349 and the other of which bears against one side of gear 341) into constant and continued engagement with surface 351 of leg 311 of blade carriage 237 (see FIGS. 26, 29 through 32). The linear travel of blade carriage 237 is thus converted into rotation of segment gear 341 in mesh at gear teeth 352 with a pinion gear 353 teeth 354 connected at output shaft 357 to output varying rotator 359 of variable potentiometer 283. Rotation of the potentiometer causes a change in electrical resistance as it rotates that can be directly calibrated to track and respond to positional changes of blade 239 relative to blade 235 indicative of the size of gap 361 (and thus fitting nut to body gap 117). Small pinion gear 353 is formed with a boss at its bottom surface that extends into and is held into operative position by a bearing.

This embodiment of the invention is calibrated by deploying blade 239 and carriage 237 on head portion 233 and expanding in a fitting correct nut to body gap of a known measured value. Potentiometer 283 is then manually adjusted with a small screw driver by rotating center pot rotator 359 to an electrical potential consistent with a register of values within a data base (preferably one on board the controller of tool 81) that corresponds to the known correct measured value.

A third embodiment of a utility tool of this invention for tube cutting is described with reference to FIGS. 33 through 38. As with all the utility tools of this invention, cutter tool 371 is mounted entirely at one side of nut driving tool 81. A number of the features of this embodiment are substantially similar to those heretofore described, including the features of adaptation 125, except as addressed herein.

Threaded pins 375 extend through holes 377 through platform 159 of station portion 133 of mounting body 129. Pins 375 then extend through a set of spaced apart holes 379 in floating guide tower 137 of station portion 133, extending from front surface thereof. Compression springs 381 are mounted over pins 375 and are held captive by a set of threaded nuts 383. Notch 209 is captured and released by latch/catch 183/205 as heretofore discussed for firmly holding the mounting. Since base portion 131 is captured against sliding and is secure within slideway 154, the entire tube cutting assembly housing 385 may be pulled out and away from receiver 127 of adaptation 125 against the bias of springs 381. Springs 381 assure snug contact of annular rim 391 extending from the periphery of guide tower 137 at the front face thereof and housing 385 adjacent to elongated slot/interface 136 receiving guide tower 137. Spring tension is maintained at a tension sufficient to hold the tube cutter in place during normal operation but compliant to the extent that, if the tube cutter is pulled away from receiver 127 of the tool, housing 385 will move away providing clearance between the housing and the drive tool (for example, to allow insertion of socket end 392 of one way roller clutch socket 393 in drive socket 89).

Guide tower 137 is slidably received in elongated interface 136 of tool head housing 385 with collar portion 395 thereof protruding through and rim 391 thereof restrained from movement through interface 136. Tubing cutting utility 397 (a blade and retaining block) is selectively locatable by user manipulable threaded positioner 399 in cavity 401 of housing 385. Cavity 401 has a cutting utility receiving track 403 at the sides thereof for slidable receipt of the guide edges of the blade retaining block of cutting utility 397 therein. Tubing 225 is positioned in a positioning portion defined at the bottom surface of cavity 401. Cavities defined within utility 397 rotatably retain a cutting wheel/axle 407 for tube cutting. Rollers at the base of cavity 401 and adjacent to the tubing positioning portion can be provided to allow tubing rotation.

One way roller clutch assembly 393 employs at least one and preferably two one-way roller clutches 409 (though any other means for slidably receiving tubing therethrough and holding the tubing therein to allow selective rotation of the tubing could be utilized). Use of a single roller clutch assembly provides for rotation of tubing received thereat in one direction o rotation and non-rotation of the tubing when rotated in the opposite direction. Use of a second one-way roller clutch in a back-to-back configuration with the first allows for the driving of tubing rotation both directions.

Once tool 371 and tubing 225 are positioned at the selected cutting position, positioner 399 is manipulated to tighten the cutting utility 397 with the blade in contact with the tubing. As tightening proceeds, tubing 225 is forced into position in cavity 401 as guide tower 137 slidably adjusts along interface 136 to accommodate tubing positioning. Tubing 225 is then rotated (in either direction) by activation of driving tool 81 as positioner 399 is continually tightened to effect tube cutting.

Figure 39:
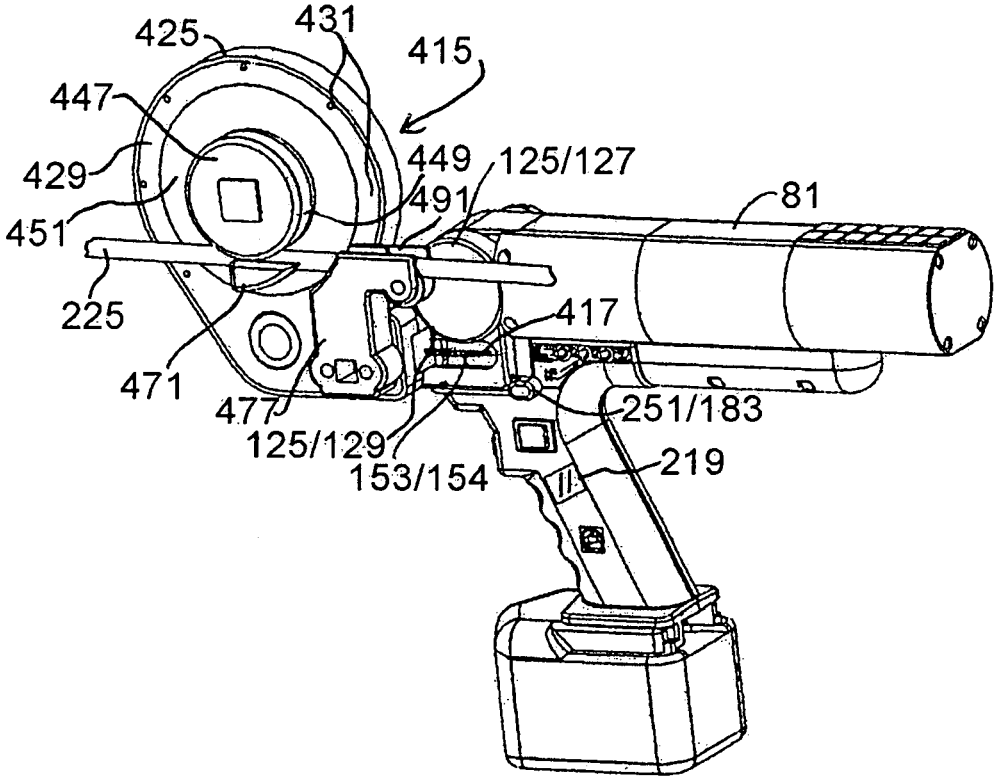
FIG. 39 is a perspective view of a fourth embodiment of this invention for tubing bending using a nut driving tool.
Figure 40:
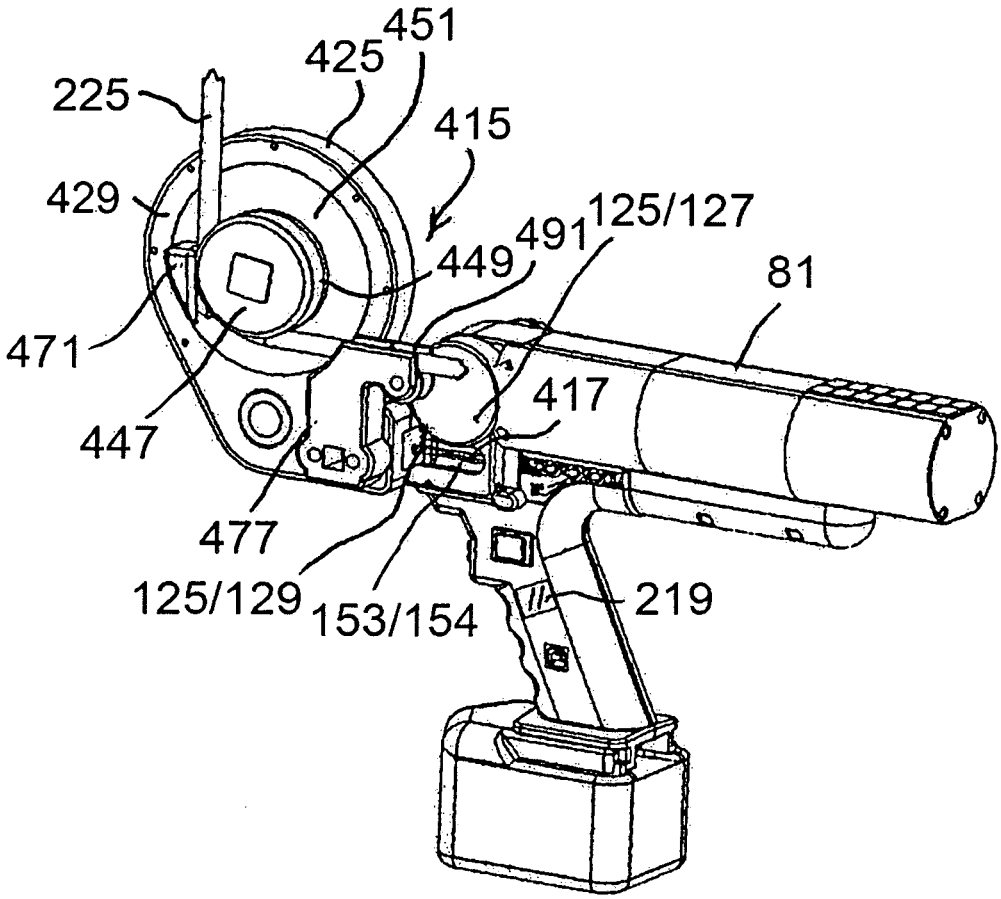
FIG. 40 is a second perspective view of the embodiment of FIG. 39 illustrating operation thereof.
Figure 41:
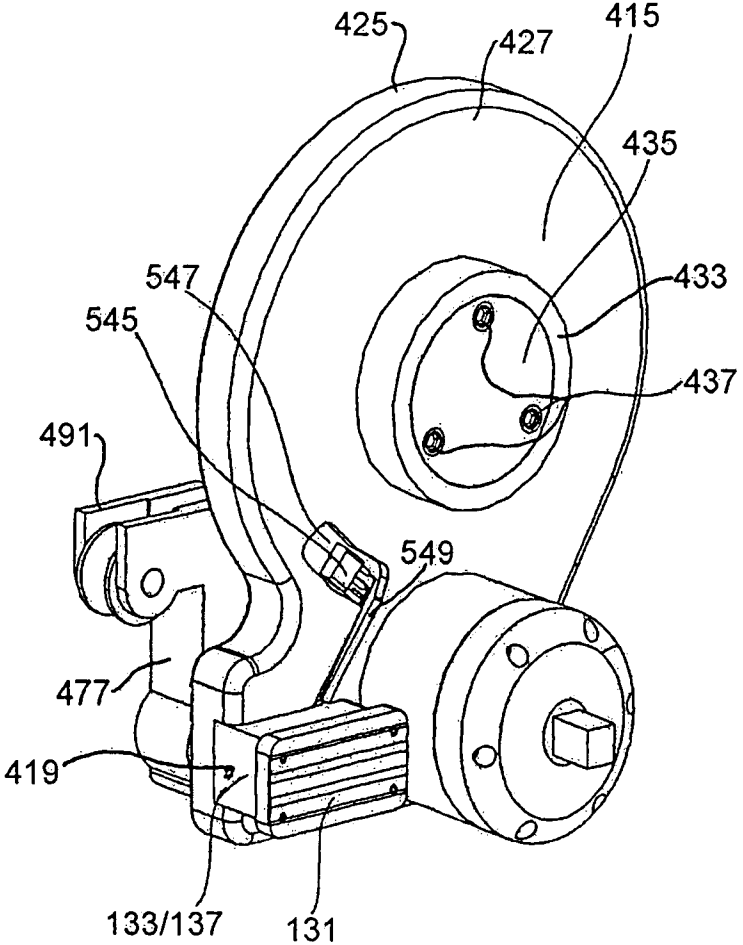
FIG. 41 is a perspective view of the tool head portion of the embodiment of FIG. 39.

A fourth embodiment of a utility tool of this invention for tube bending is shown in FIGS. 39 through 44. Bending utility tool 415 of this invention is mounted entirely at one side of nut driving tool 81 for bending tubing 225 as illustrated in FIGS. 39 and 40. As before, a number of the features of this embodiment are substantially similar to those heretofore described, including the features of adaptation 125, except as addressed herein.

Figure 42:
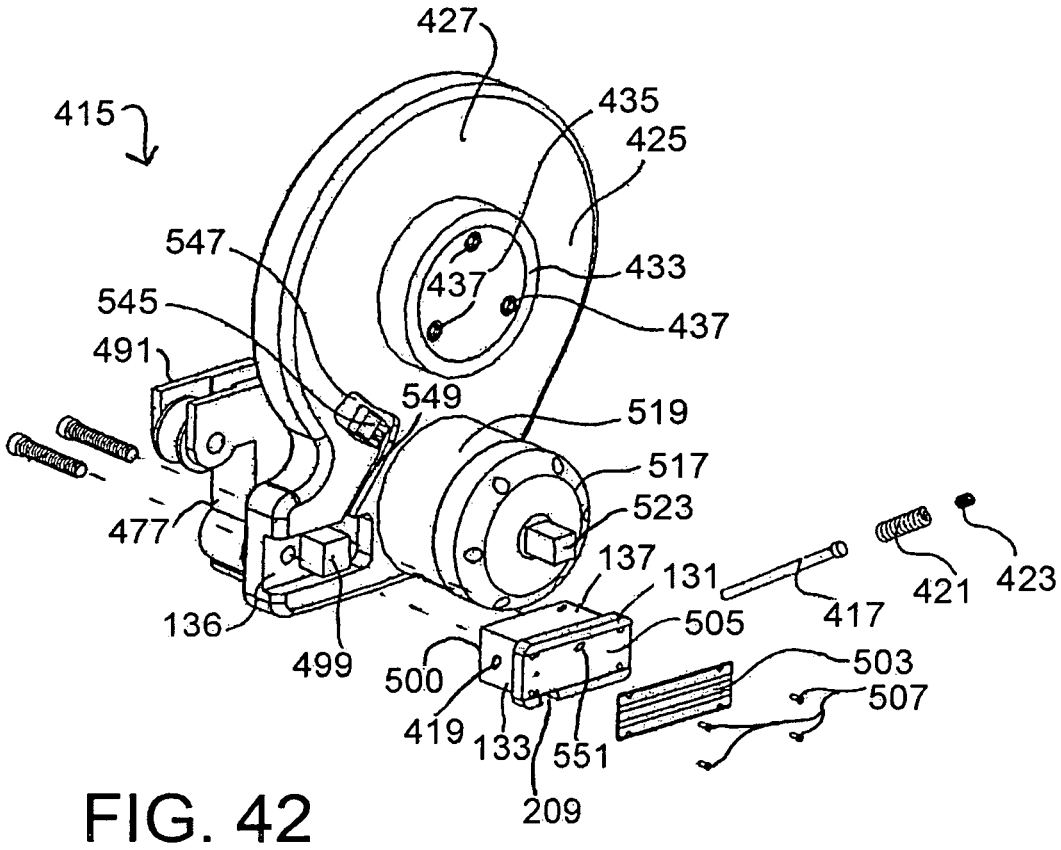
FIG. 42 is an exploded view of the portion shown in FIG. 41.
Figure 43:
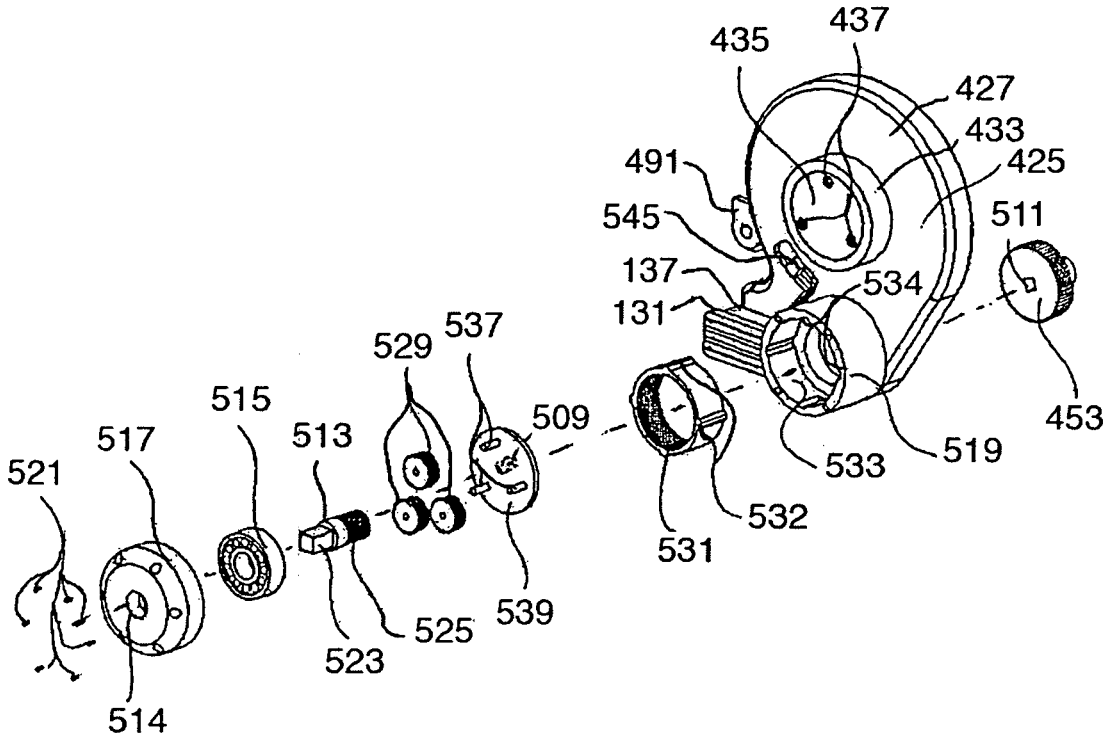
FIG. 43 is another exploded view of the portion shown in FIG. 41.
Figure 44:
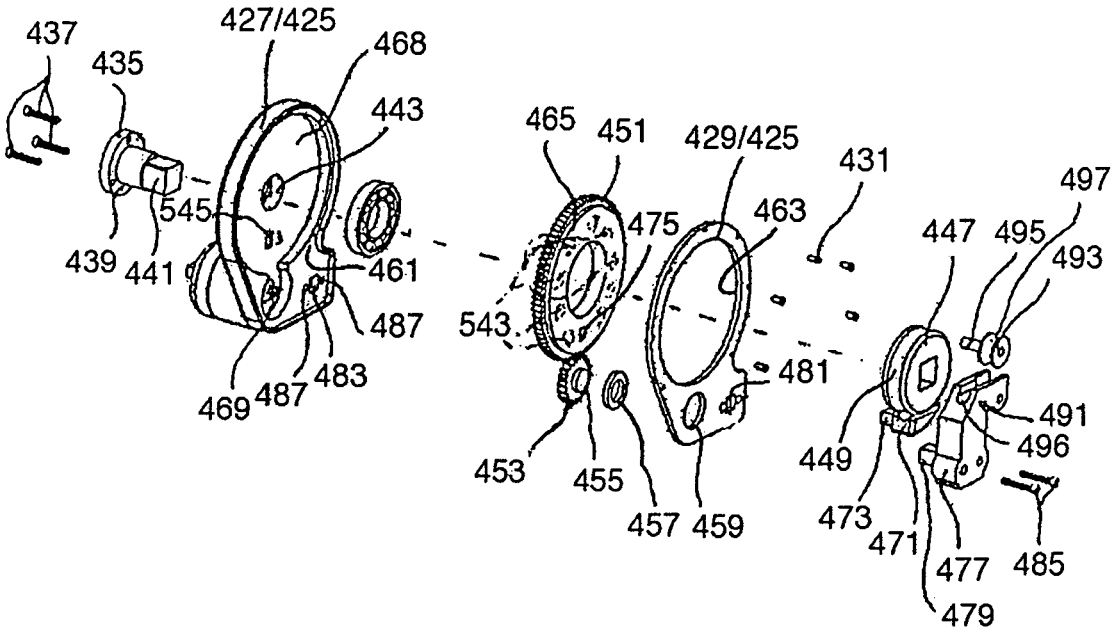
FIG. 44 is yet another exploded view of the portion shown in FIG. 41.
Figure 45:
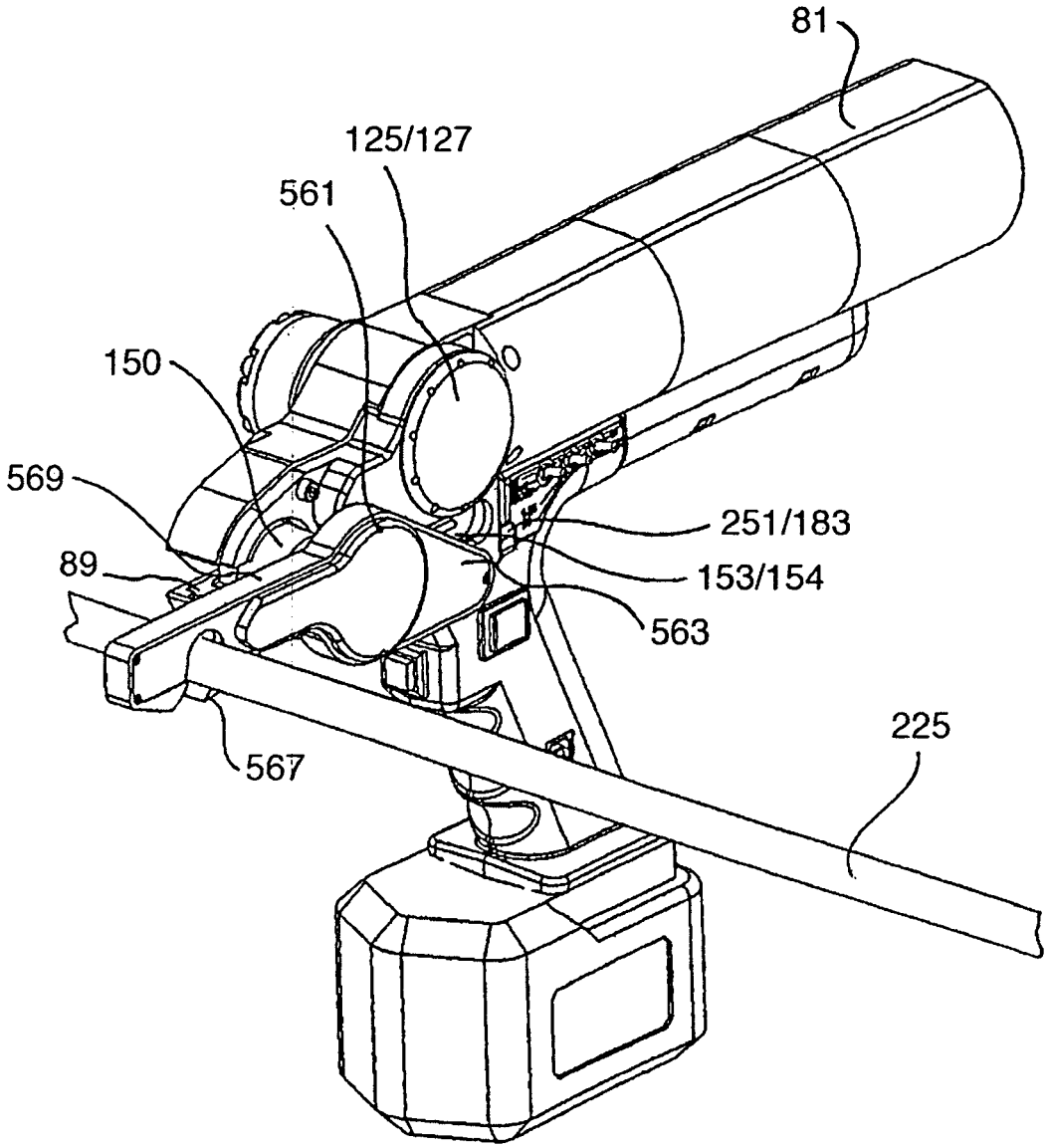
FIG. 45 is a perspective view of a fifth embodiment of this invention for tubing sawing using a nut driving tool.
Figure 46:
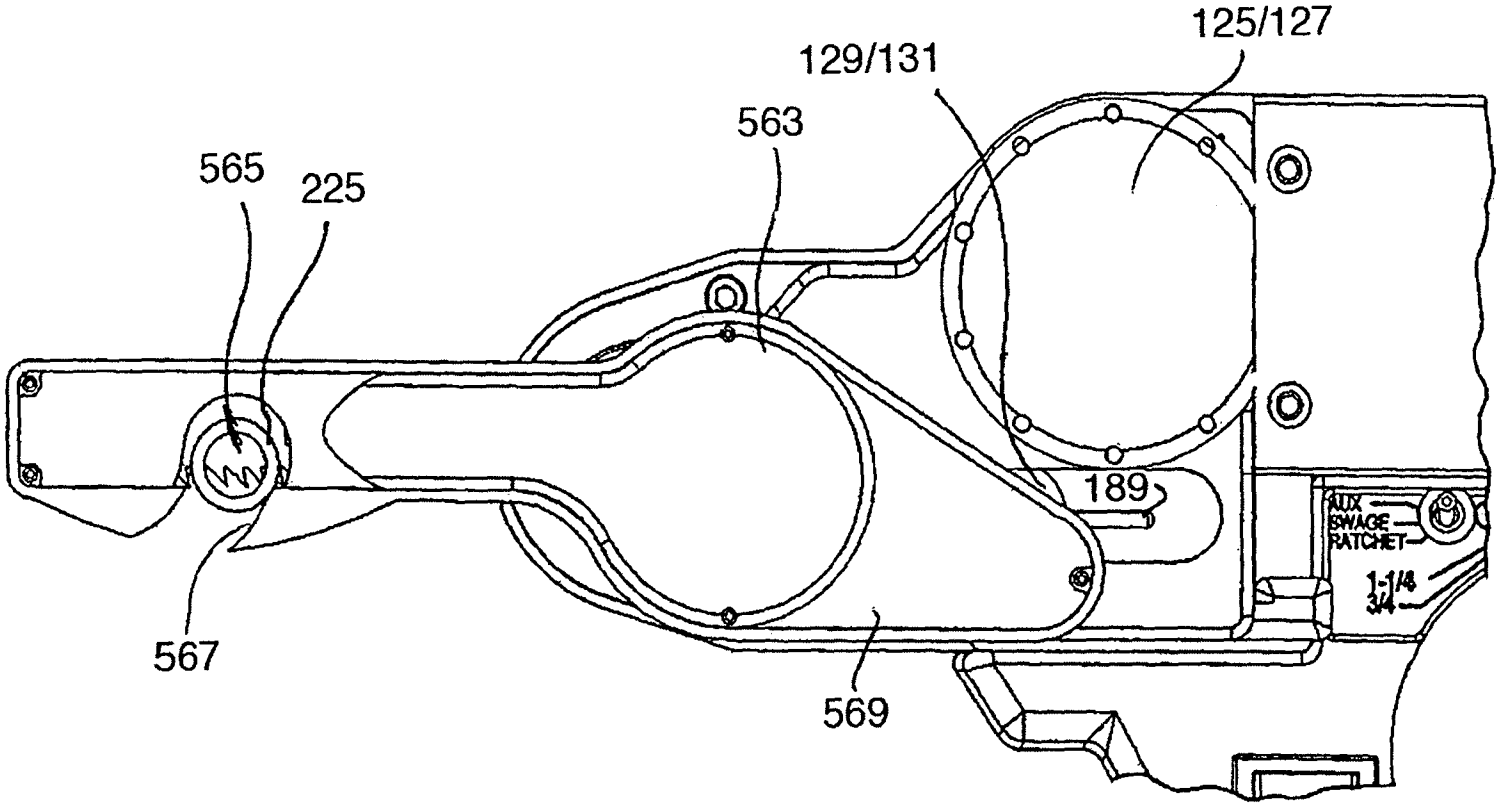
FIG. 46 is a side view of the embodiment of FIG. 45.
Figure 47:
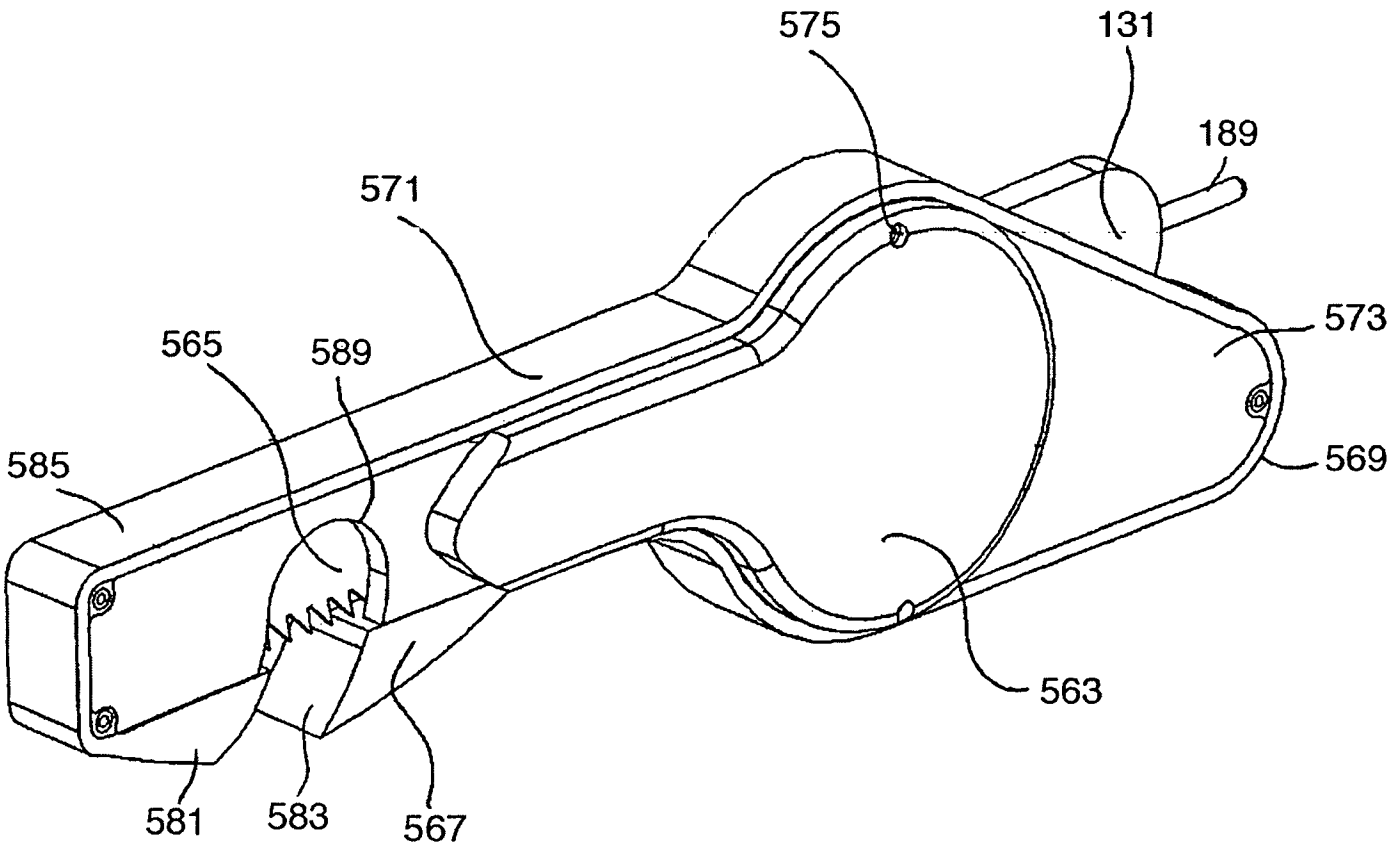
FIG. 47 is a perspective view of the tool head portion of the embodiment of FIG. 45.
Figure 48:
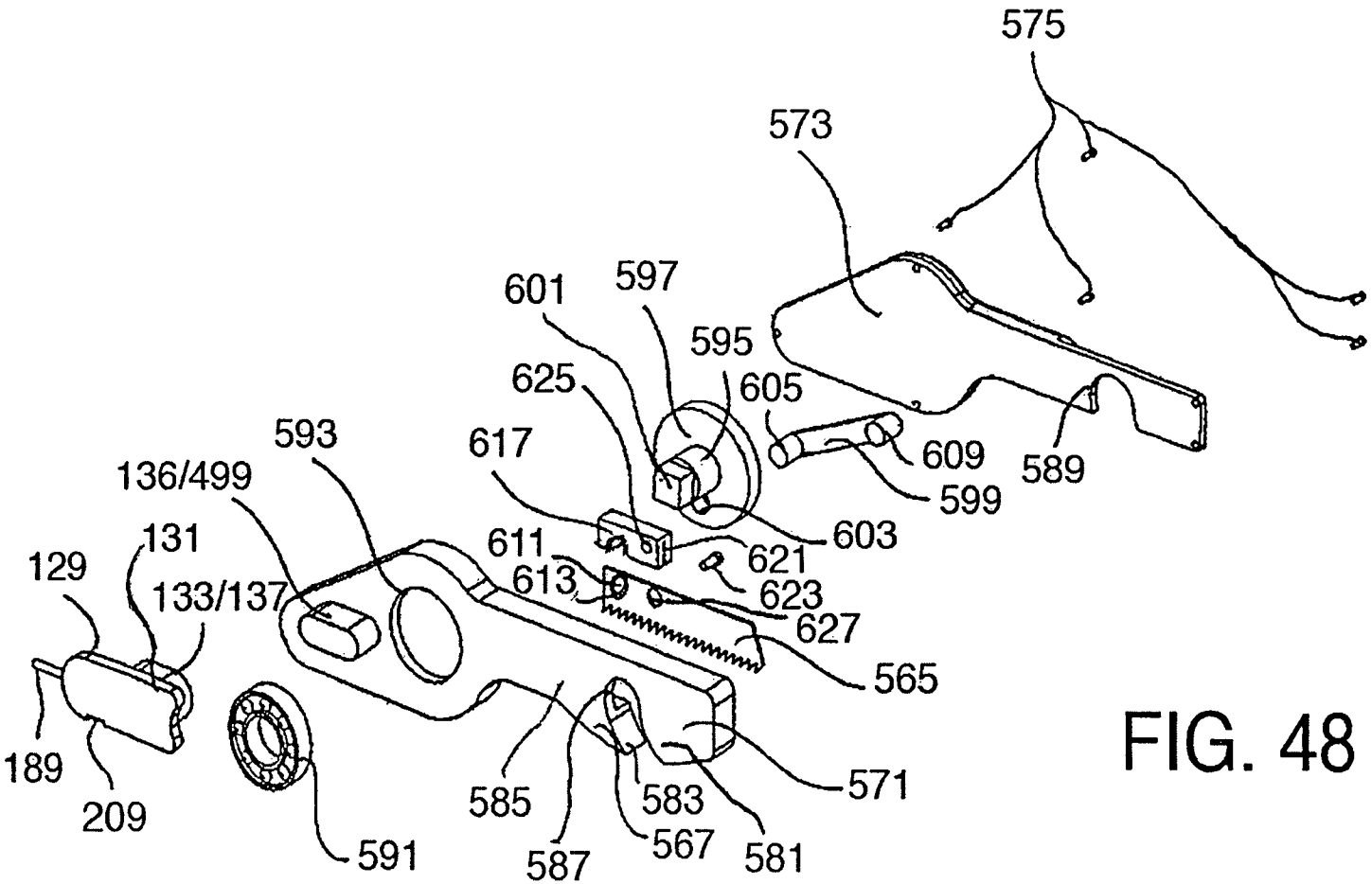
FIG. 48 is an exploded view of the embodiment of FIG. 45.
Figure 49:
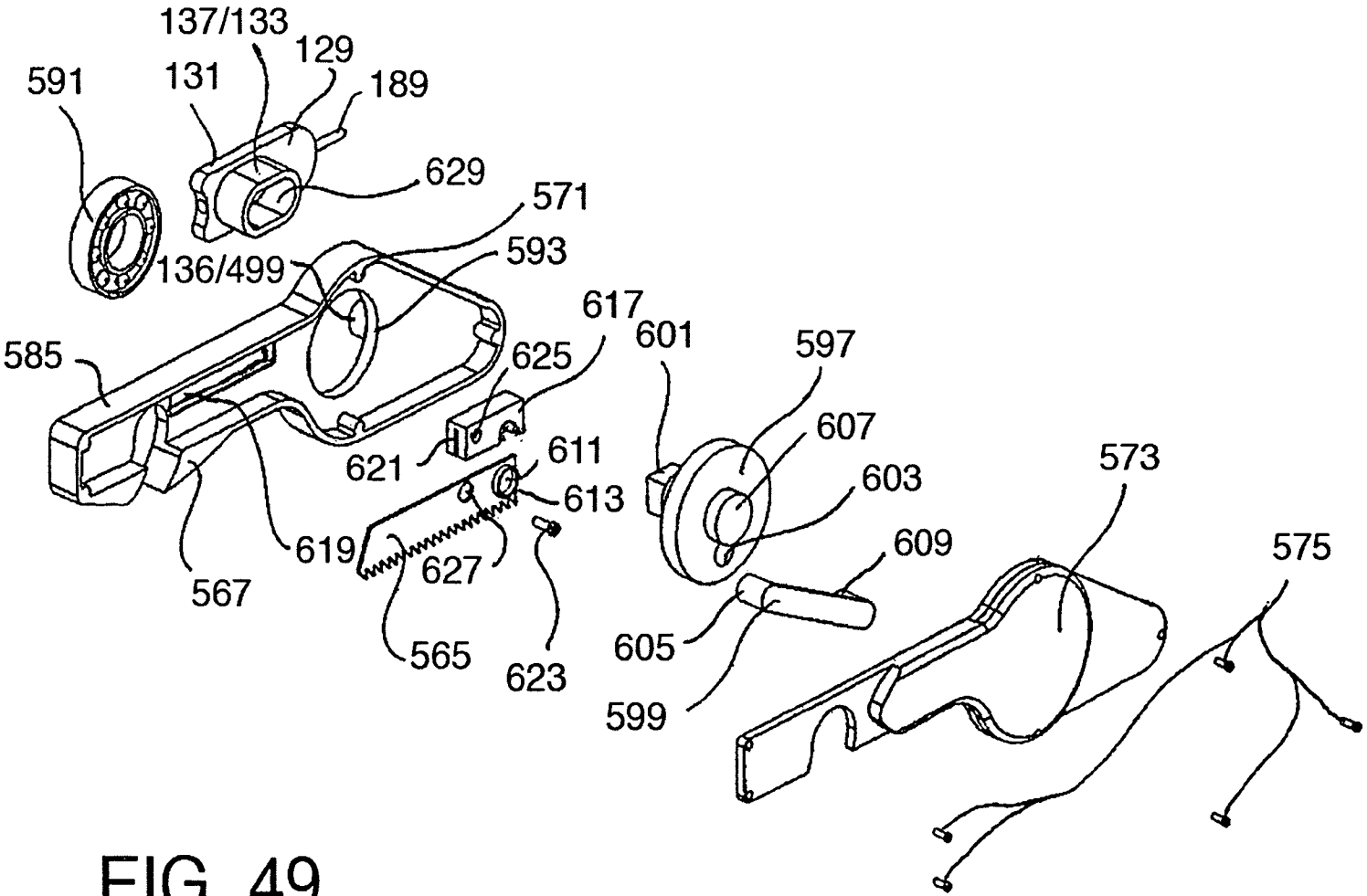
FIG. 49 is an opposite exploded view of the embodiment of FIG. 45.
Figure 50:
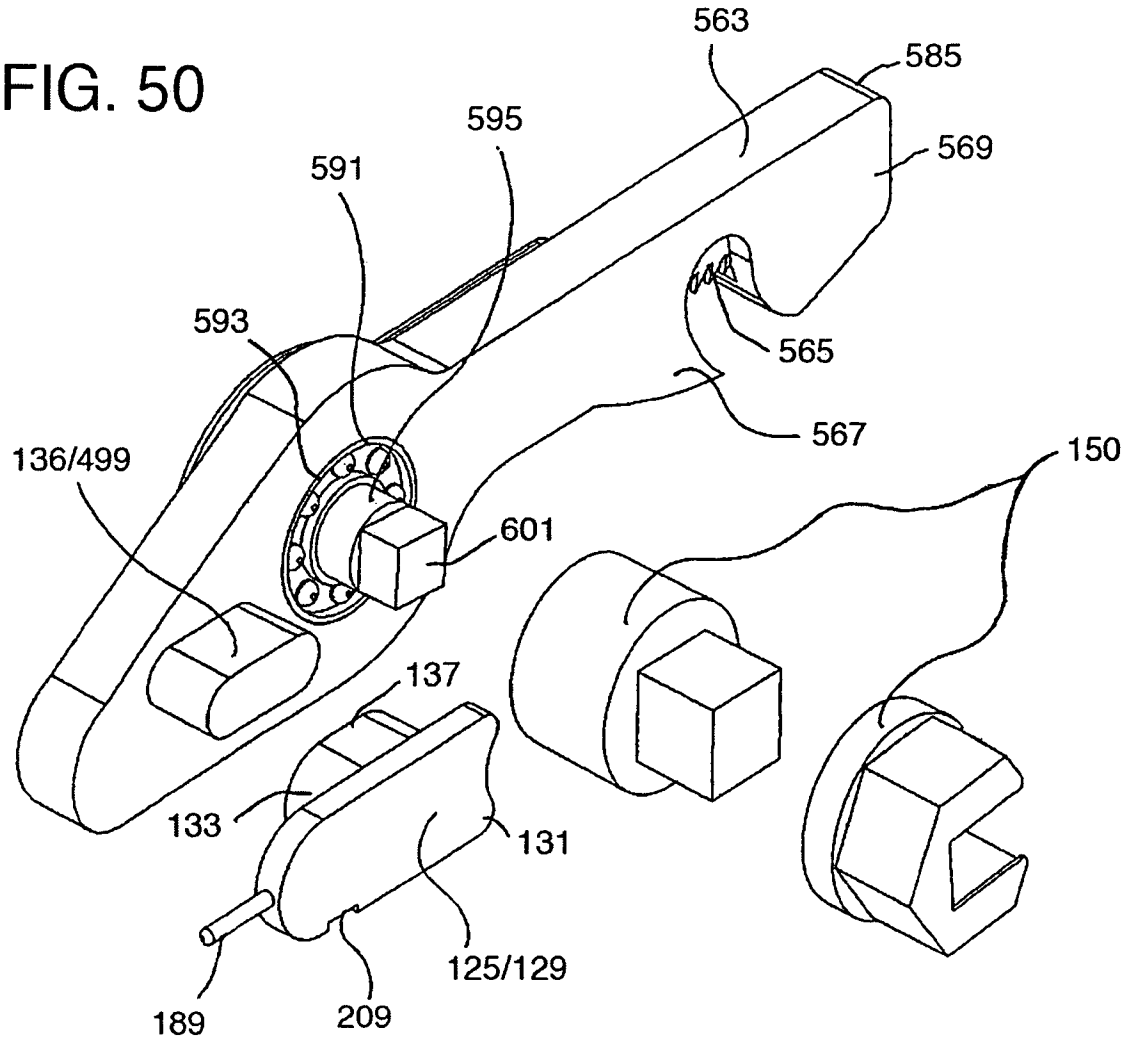
FIG. 50 is yet another exploded view of the embodiment of FIG. 45.
Figure 51:
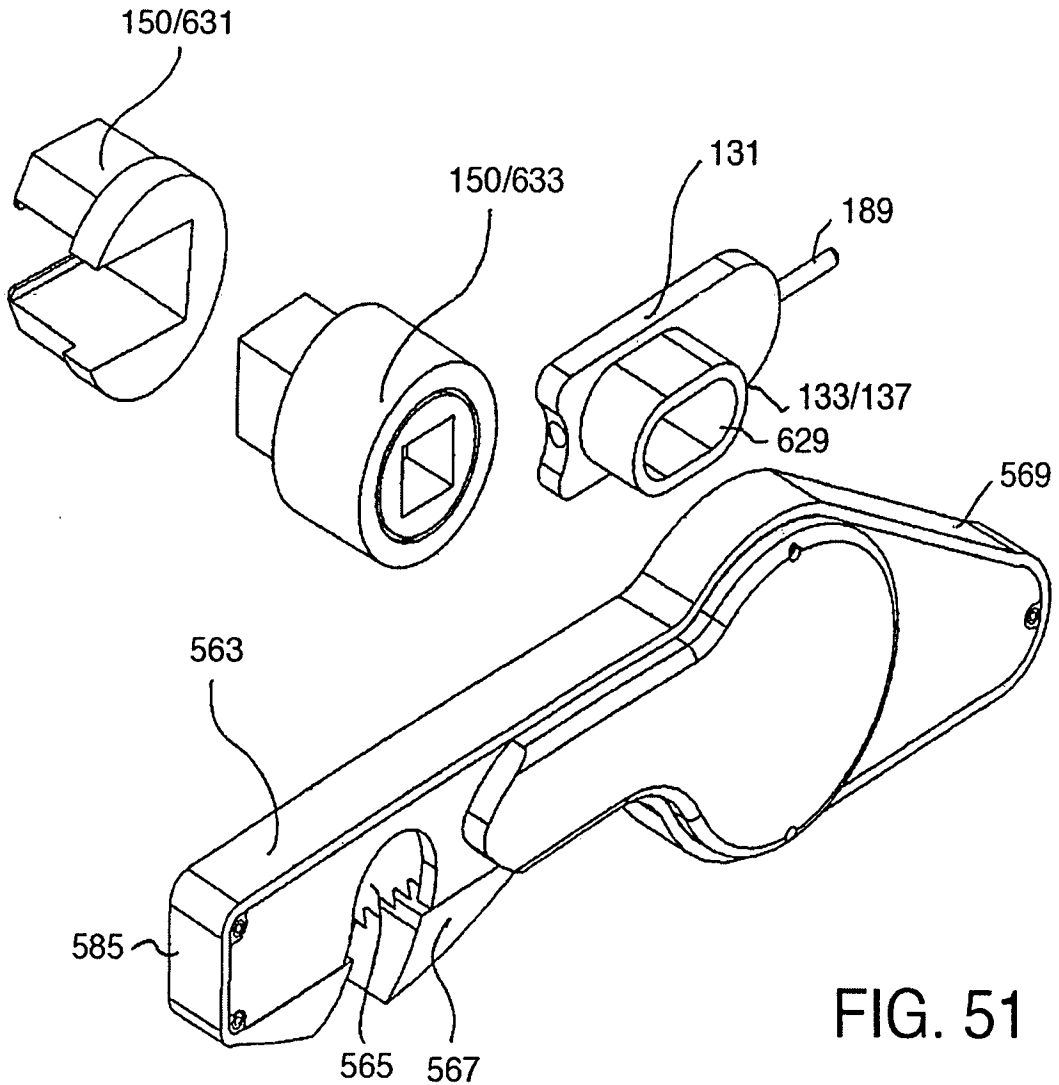
FIG. 51 is a reverse exploded view from FIG. 50.

Station portion 133 of mounting body 129 has spring biased rod 417 maintained in opening 419 therethrough and biased outwardly therein by spring 421 and set screw 423 (see FIG. 42). Rod 417 pushes against the end of slideway 154 to bias the tool toward the front adjacent to the output socket 89 of driver 81 (not shown). Bender tool head housing 425 includes retainer section 427 and cover section 429 held together by screws 431. Retainer section 427 has raised pocket 433 centrally located thereat, flanged hub 435 positioning in pocket 433 and secured thereat with cap screws 437. Hub 435 includes retaining flange 439 and squared shaft 441, shaft 441 received through opening 443 through housing retainer section 427 interior pocket 433, bearing set 445 and interchangeable static wheel 447 having appropriately sized tube facilitating circumferential arcuate trough 449 thereabout.

Bearing set 445 rotatably supports large spur gear 451 in meshed engagement with driving pinion gear 453. Boss 455 extends from the face of gear 453 and is stabilized and held in bearing 457 pressed into opening 459 at the tapered bottom end of cover section 429. Cover section 429 resides in perimeter pocket 461 of retainer section 427, inner aperture 463 of cover section 429 encircling shoulder 465 on the face of large spur gear 451, shoulder 465 projecting therethrough. Spur gear rotatably resides in cavity 468 and pinion gear 453 rotatably resides in cavity 469.

Tube bending cleat 471 includes post 473 receivable in recess 475 of gear 451, the post retained therein using appropriate means. Tubing guide holder 477 is secured to housing 425 on post 479 receivable through openings 481 and 483 and secured using screws 485 in threaded openings 487 in retainer section 427. Leg 491 has wheel guide 493 rotatably mounted therein on shaft 495, leg 491 having linear trough 496 at the top thereof and guide 493 having arcuate circumferential trough 497 thereabout to position and align a piece of tubing 225 with static wheel 447. In this way, tubing 225 is guided while gear 451 (and thus cleat 471) is rotated to bend the tubing.

As an alternative to tube bending cleat 471, a wheel with a tube shaped outer periphery mounted on a ball bearing supported ring and attached to an axel receivable in receivable in recess 475 of gear 451 could be utilized to further reduce likelihood of tube marring during operations. Wheel guide 493 could be configured with additional structure and motorized so that engagement of tubing thereat would allow for automatic linear advancement of tubing to predetermined (and, where provided, computer controlled) bend points. In computer controlled operations, instant determination of radial set-backs could thus be accommodated. Furthermore, additional structure could be provided for radial manipulation of tubing allowing tubing rotation accommodating tube bends in various directions and thus further facilitating formation of complex angles and bends calculated by an on-board computer where provided.

Tool head housing 425 is received on stabilizing post 499 located in interface 136. An opening (not shown) in rear face 500 of mounting body 129 at tower 137 receives post 499 as tower 137 is received in interface 136. Base portion 131 includes multiple element electrical strip connector 503 in bottom recess 505 thereof held by screws 507 for signal communication to and from tool 415 from driver 81 program control. Drive force to pinion gear 453 is supplied on shaft 509 received in opening 511 at the reverse side of gear 453 (see FIG. 43).

Amplified torque for rotation of pinion gear 453 is supplied through drive socket 89 from driver 81 engaging drive shaft 513 maintained through cap opening 514 on bearing 515 pressed into housing cap 517. Cap 517 is held on drive assembly retainer 519 by screws 521. Shaft 513 includes socket receivable end 523 engageble by drive socket 89 and sun gear end 525. Sun gear 525 is in driving engagement with the planet gears 529 of the internal torque multiplier. Hardened ring gear 531 having anti-rotation lugs 532 is pressed into shaped pocket 533 including lug receiving slots 534 in retainer 519 and is in mesh with radially disposed planet gears 529. Revolving needle bearings at the center of each gear 529 rotatably retain gears 529 on dowel pins 537 pressed into the face of the planet carrying carriage 539 having shaft 509 at the rear thereof. When under power, carriage 539 imparts rotation to pinion gear 453 supplying substantially amplified torque values to tube bender tool 415.

Computer controlled bending is facilitated by a series of pockets defined in output gear 451 equidistantly disposed around the perimeter of the gear, each pocket holding a magnet 543. The precision placed magnets 543 are monitored by on-board computer at driver 81 to maintain radial position of gear 451 by counting the magnets as they pass by Hall effects sensor 545 installed into cavity 547 of housing retainer portion 427 thereby allowing software resident in the tool to create precision bends in tubing. Hall effects sensor 545 is connected to female slide connector 503 via slot 549 extending between cavity 547 and interface 136 and through an opening in tower 137 terminating at connector 551. In this way, radial displacement of tubing 225 is programmable by the tools user with appropriate input. Tube bends may be visually selected by selecting the desired bend from a roster of choices presented on visual monitor 219 disposed on the outer case of the power tool. This provides the technician with the ability to select from multiple bending scenarios and mathematical calculations concerning tubing length calculations prior to bending a piece of tube.

A fifth embodiment of a utility tool of this invention for sawing tubing or other materials is described with reference to FIGS. 45 through 53. As with all the utility tools of this invention, reciprocating sawing utility tool 561 is mounted entirely at one side of nut driving tool 81. A number of the features of this embodiment are substantially similar to those heretofore described, including the features of adaptation 125, except as addressed herein.

Utility tool 561 is a reciprocating saw particularly adapted for cutting tubing in tightly packaged tubing arrays, such as manifolds and the like, without damaging adjacent tubing, wires, or structure. Tool head 563 features a short stroke reciprocating saw blade 565 and curved jaw tube trap 567. Tube trap 567 is configured to hold the tubing during the cutting processes.

Housing 569 includes retainer portion 571 and cover portion 573 assembled using screws 575 in retainer portion threaded opening 577. Curved jaw trap 567 includes forward and aft curved tube guideways 581 and 583, respectively, defined at housing retainer portion blade arm 585 leading to tube lodging saw exposure openings 587 and 589 in retainer portion and cover portion 571 and 573, respectively (see FIGS. 47 and 48).

Figure 52:
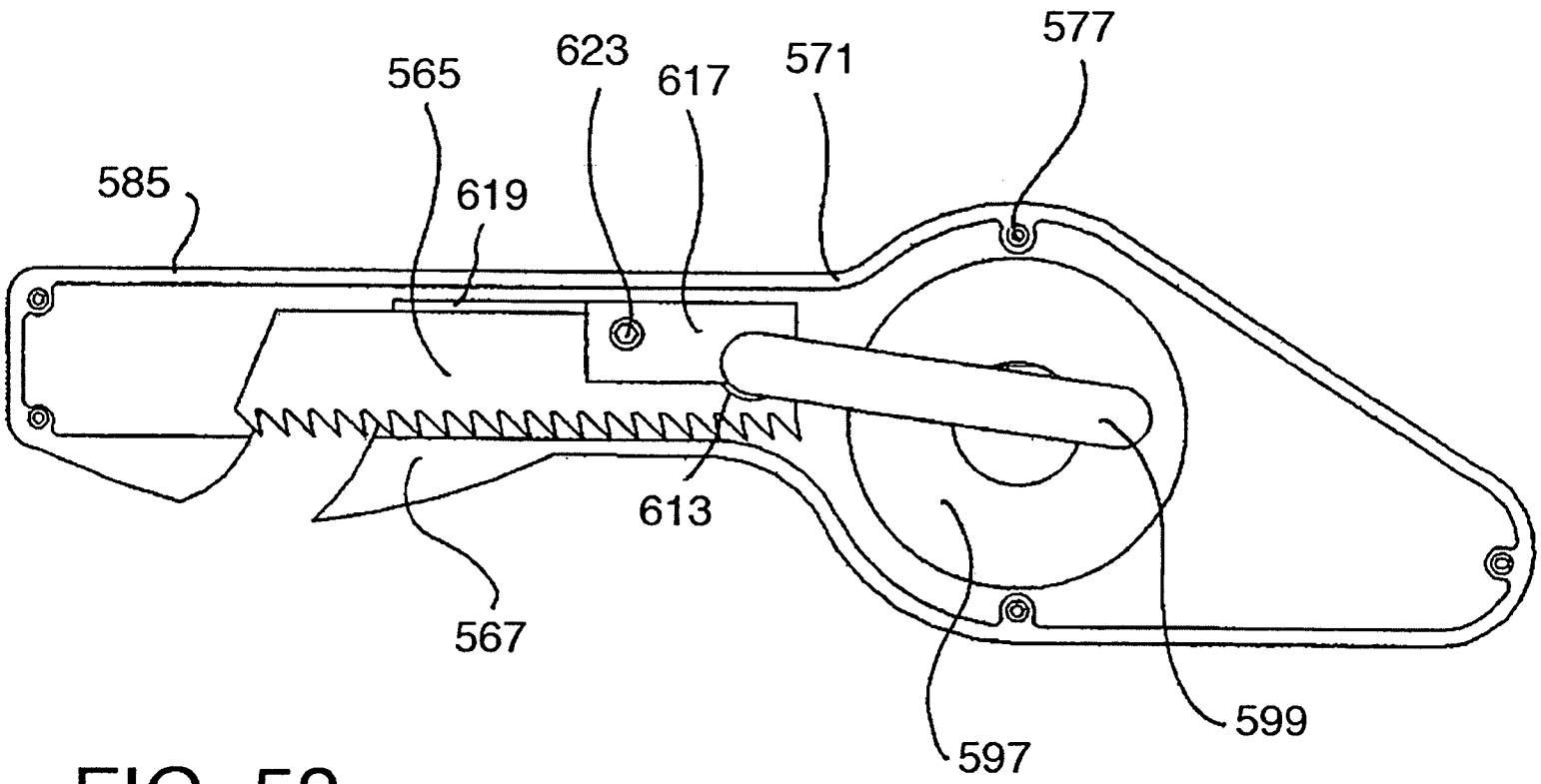
FIGS. 52 and 53 are side views illustrating reciprocating movement of the saw blade of the embodiment of FIG. 45.
Figure 53:
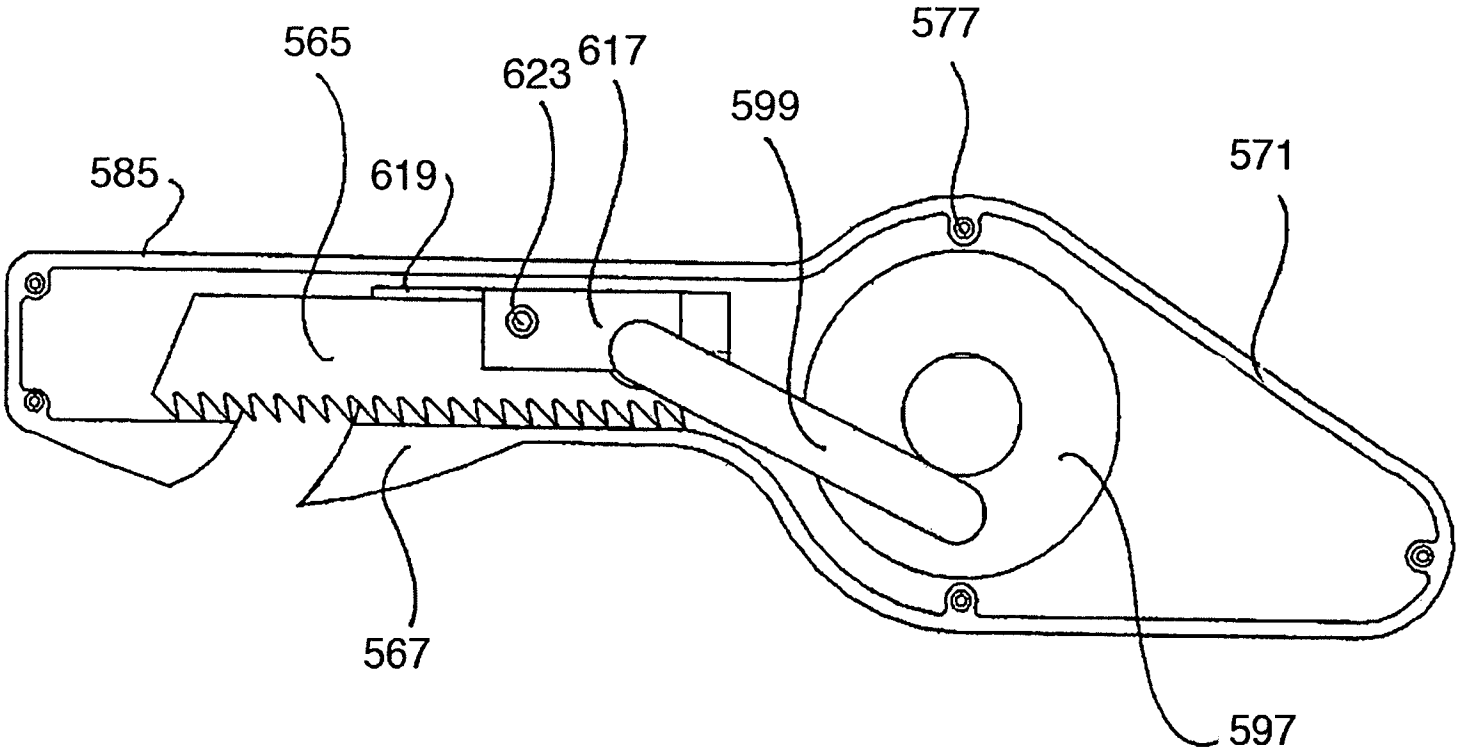
Figure 54:
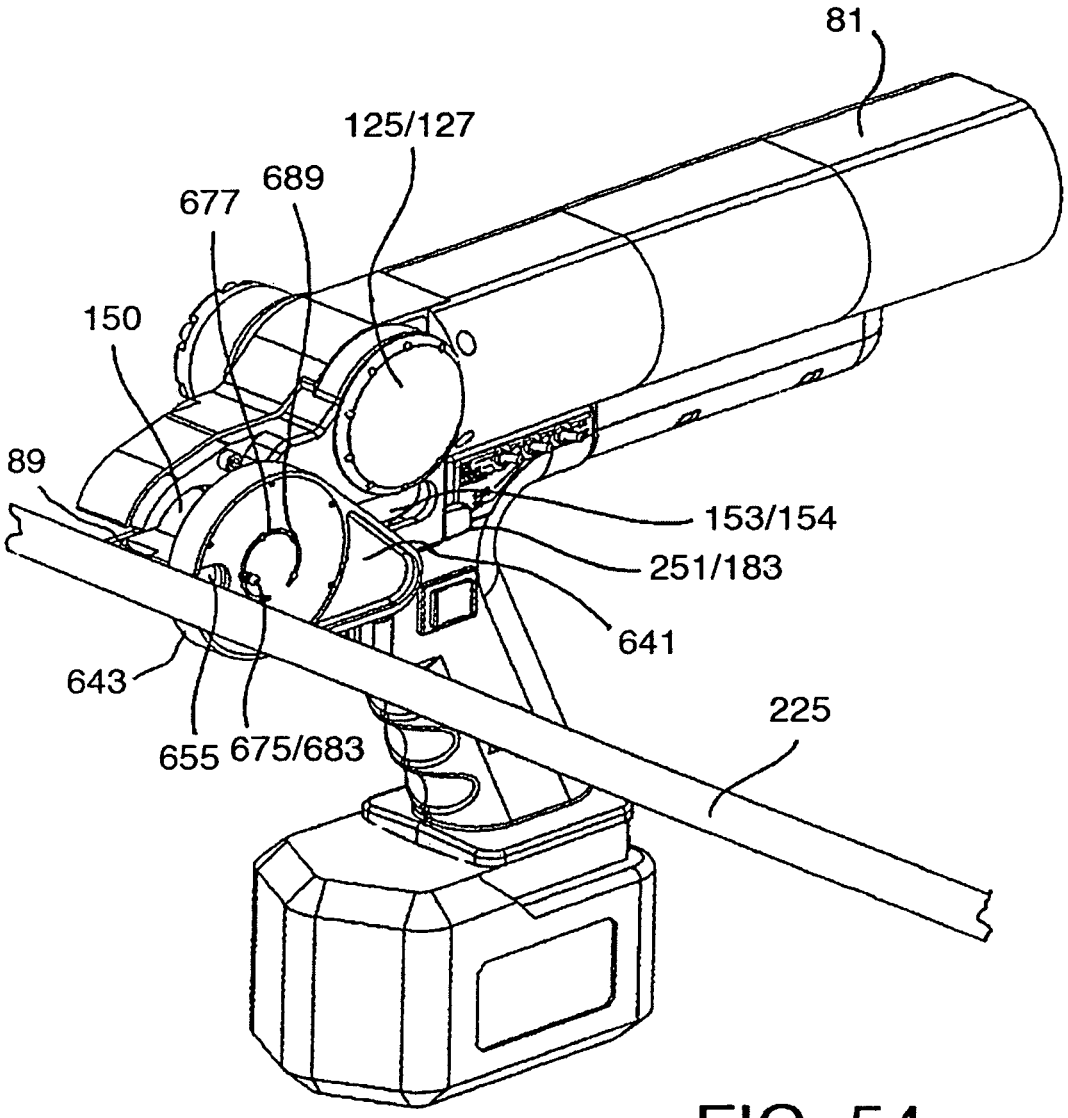
FIG. 54 is a perspective view of a sixth embodiment of this invention for rotary sawing of tubing using a nut driving tool.
Figure 55:
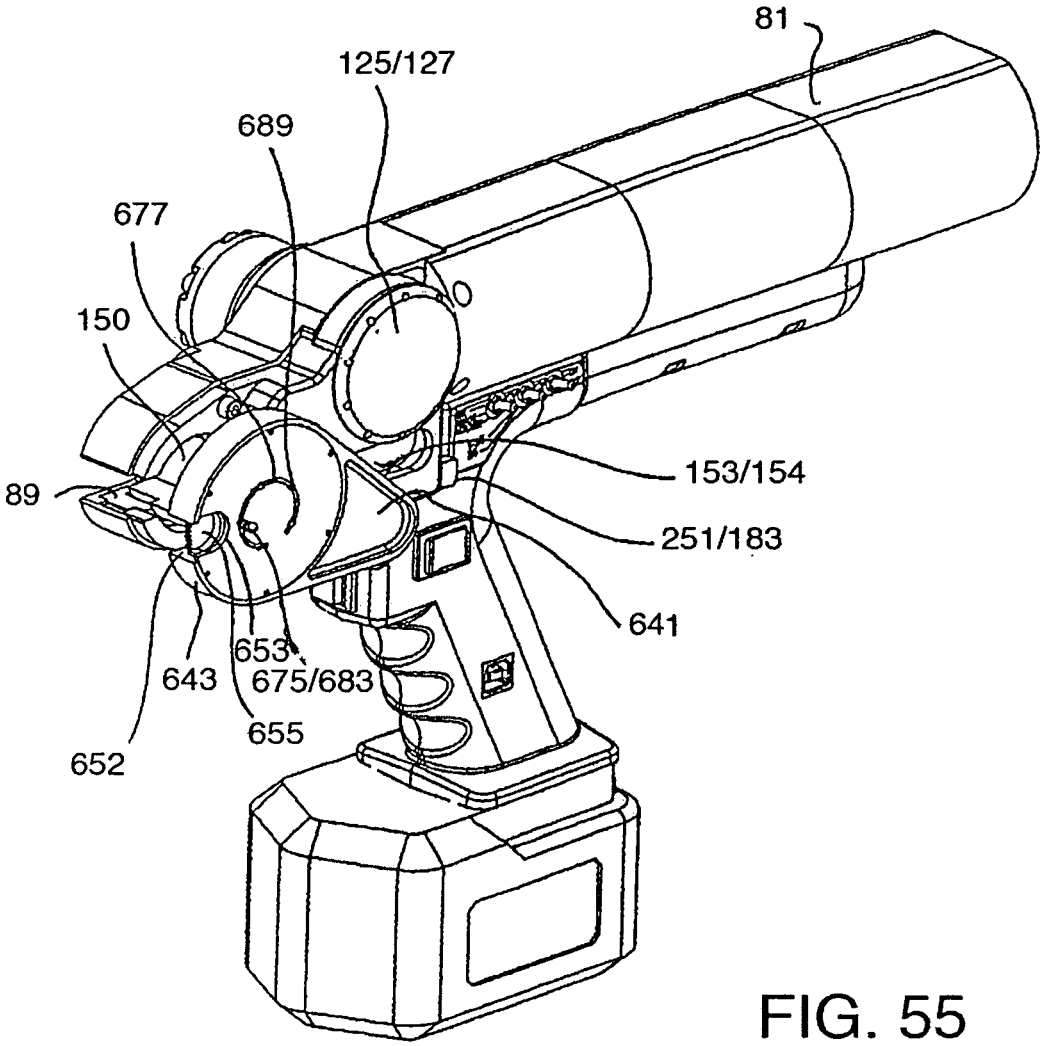
FIG. 55 is another perspective view of the embodiment of FIG. 54.
Figure 56:
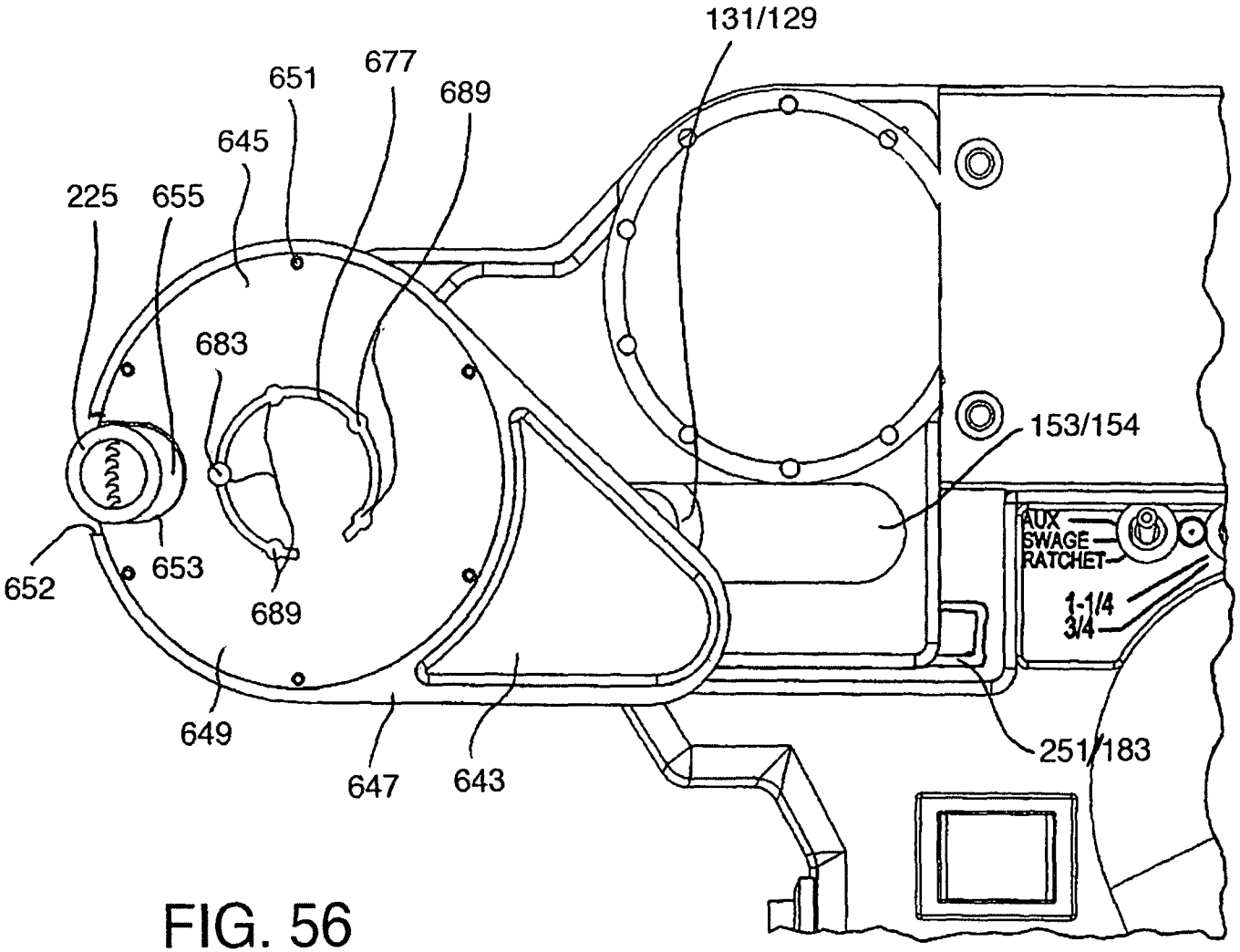
FIG. 56 is a side view of the embodiment of FIG. 54.
Figure 57:
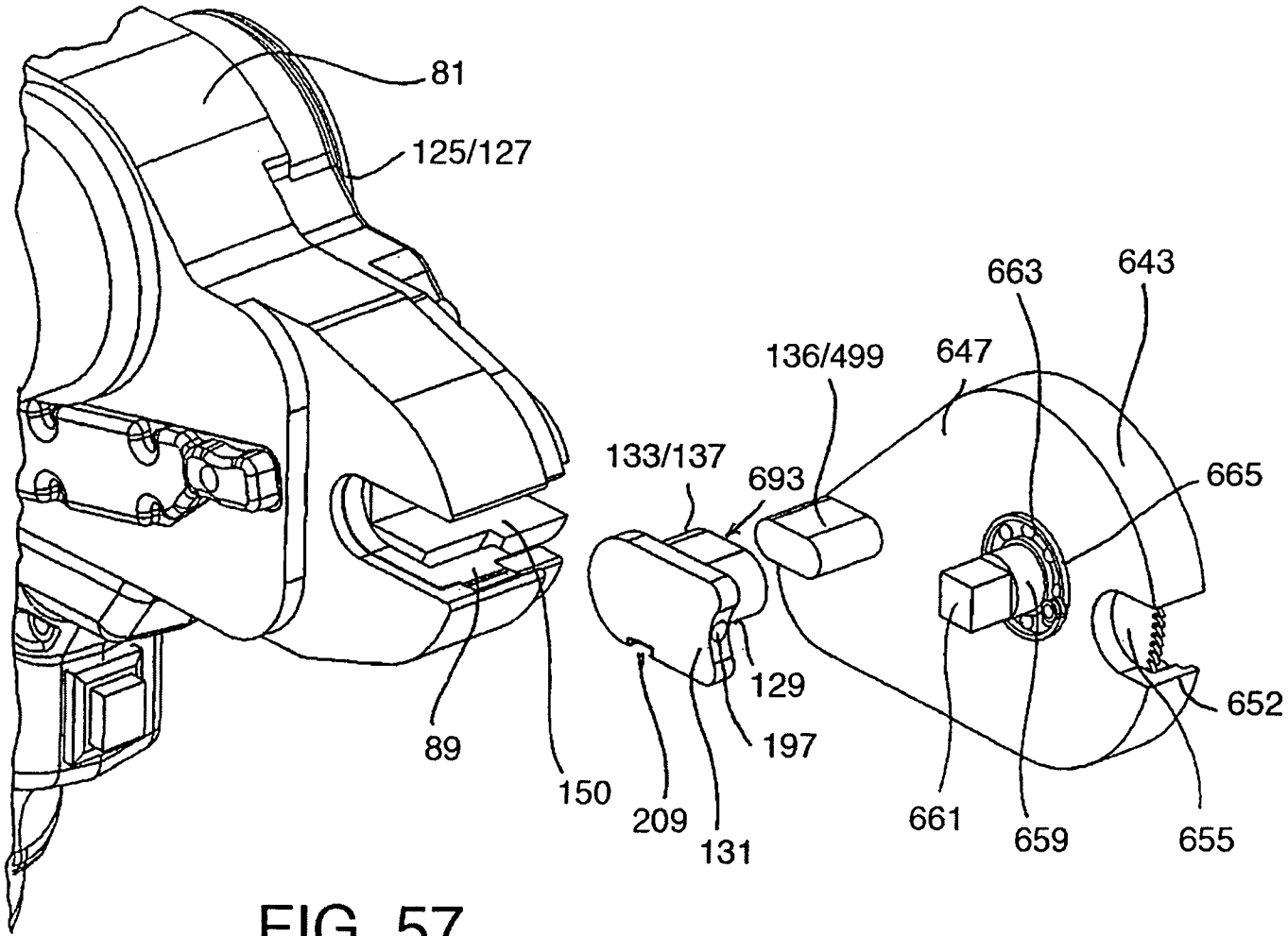
FIG. 57 is an exploded view of the embodiment of FIG. 54.

Ball bearing assembly 591 is pressed into housing retainer portion opening 593 and supports drive shaft 595 for operational rotation of crank arm wheel 597 in linked and pivotal cooperation with crank arm 599. Shaft 595 includes squared socket receivable end 601, crank arm wheel 597 having opening 603 therein for receipt of crank arm pivot leg 605 and central rear wall spacer hub 607. Crank arm 599 pivot leg 609 is received through opening 611 in the end of the saw blade 565, maintained there by standard "C" clips 613 or the like. Thus, rotation of drive shaft 595 translates to reciprocating motion of saw blade 565 as illustrated in FIGS. 52 and 53.

Saw blade 565 is guided and oriented by blade block 617 which in turn has its reciprocating motion guided in track cavity 619 in arm 585 of housing retainer portion 571. Cavity 619 serves to maintain blade alignment in portion 571 of housing 569 for correct blade location at the curved tube guide 567. Blade 565 is located in blade receiving channel 621, saw block attachment screw 623 being threadably received in opening 625 in block 617 and through opening 627 of blade 565.

Base portion 131 of mounting body 129 operates as set out hereinabove, notch 209 being engagable by latch 183, mounting body 129 being forward biased by spring loaded pin 189. Mounting interface 136/499 of tool head 563 is receivable in opening 629 of tower 137. Thus tool head 563 is elevation adjustable on tower 137 so that end 601 of drive shaft 595 may be directly received at drive socket 89 of driver 81, or may be received in extension socket 150 (a two piece 631 and 633 socket assembly shown in the FIGURES) receivable by drive socket 89 as illustrated herein.

A sixth embodiment of a utility tool of this invention, again for sawing tubing or other materials, is described with reference to FIGS. 54 through 58. Rotary blade sawing utility tool 641 is mounted entirely at one side of nut driving tool 81. As always, a number of the features of this embodiment are substantially similar to those heretofore described, including the features of adaptation 125, except as addressed herein.

Tool head 643 is particularly suitable for allowing tubing that is installed as part of an assembly to be cut and removed for replacement. Housing 645 includes retainer portion 647 and cover portion 649 assembled using screws 651 in corresponding retainer portion threaded openings. Forwardly disposed tube lodging saw exposure openings 652 and 653 in retainer portion and cover portion 647 and 649, respectively, provide tube cutting access to rotary saw blade 655 (see FIGS. 55 through 57).

Figure 58:
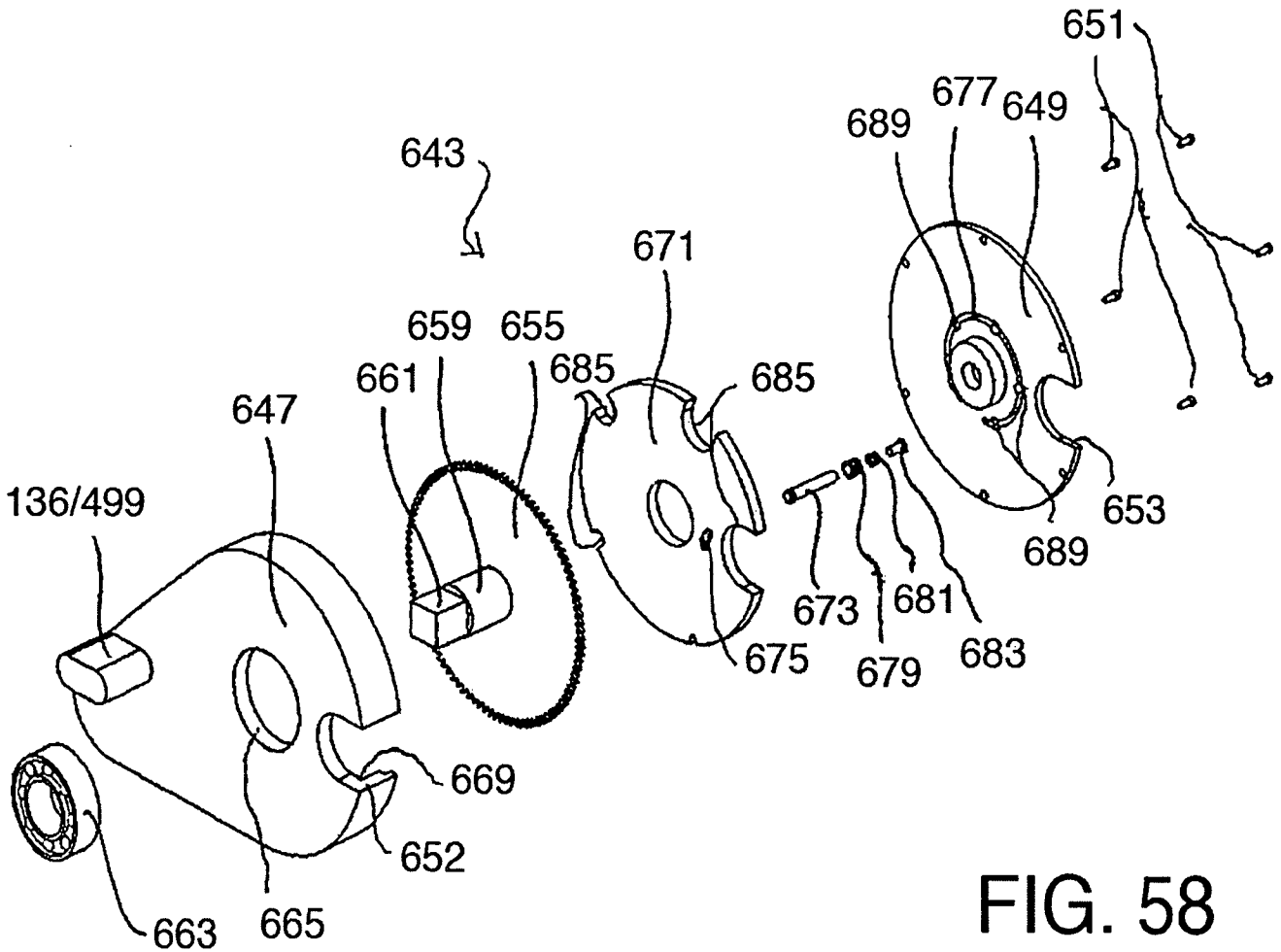
FIG. 58 is another exploded view of the embodiment of FIG. 54.
Figure 59:
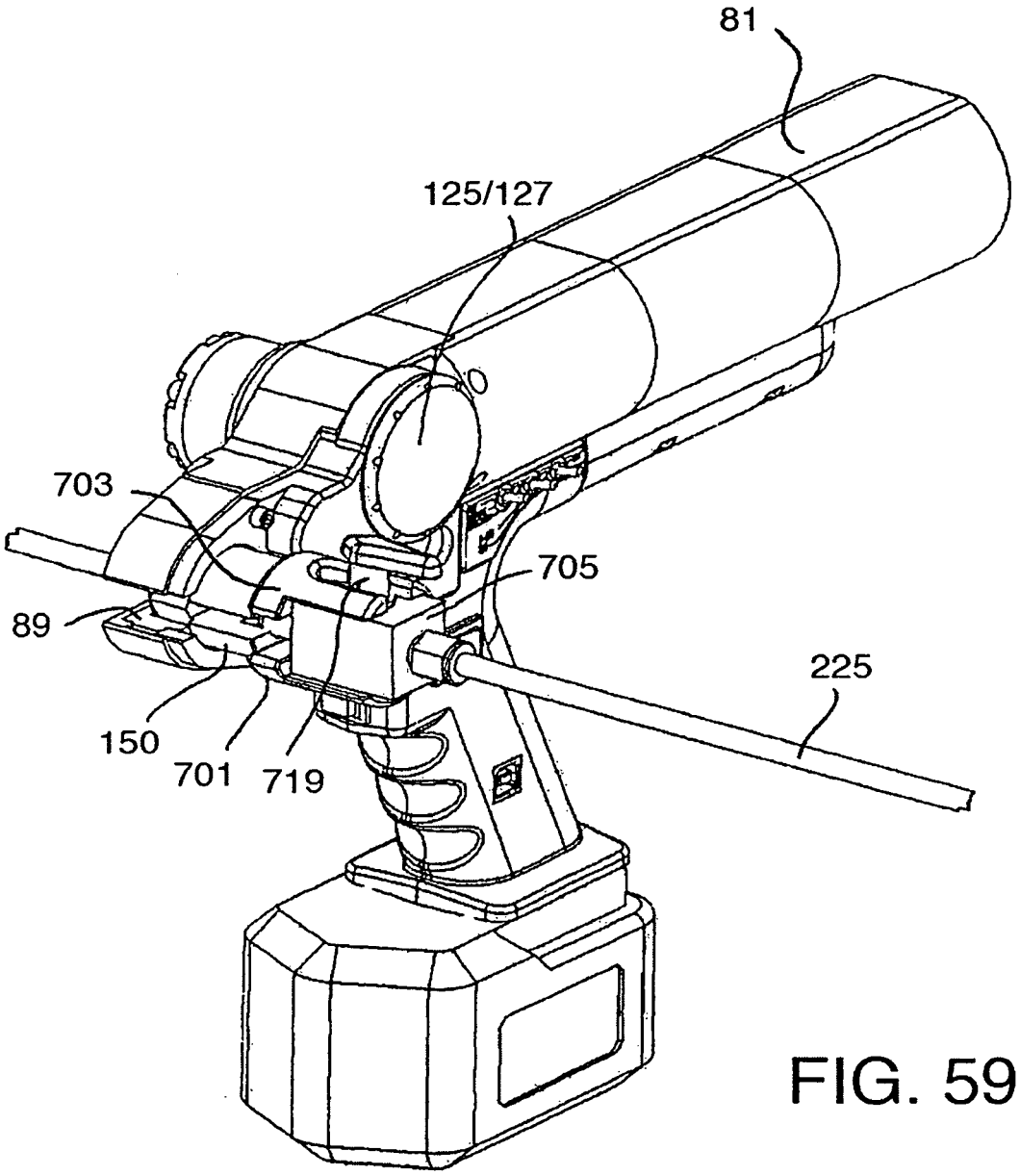
FIG. 59 is a perspective view of a seventh embodiment of this invention for grasping different types and/or sizes of fittings adjacent to a nut driving tool.
Figure 60:
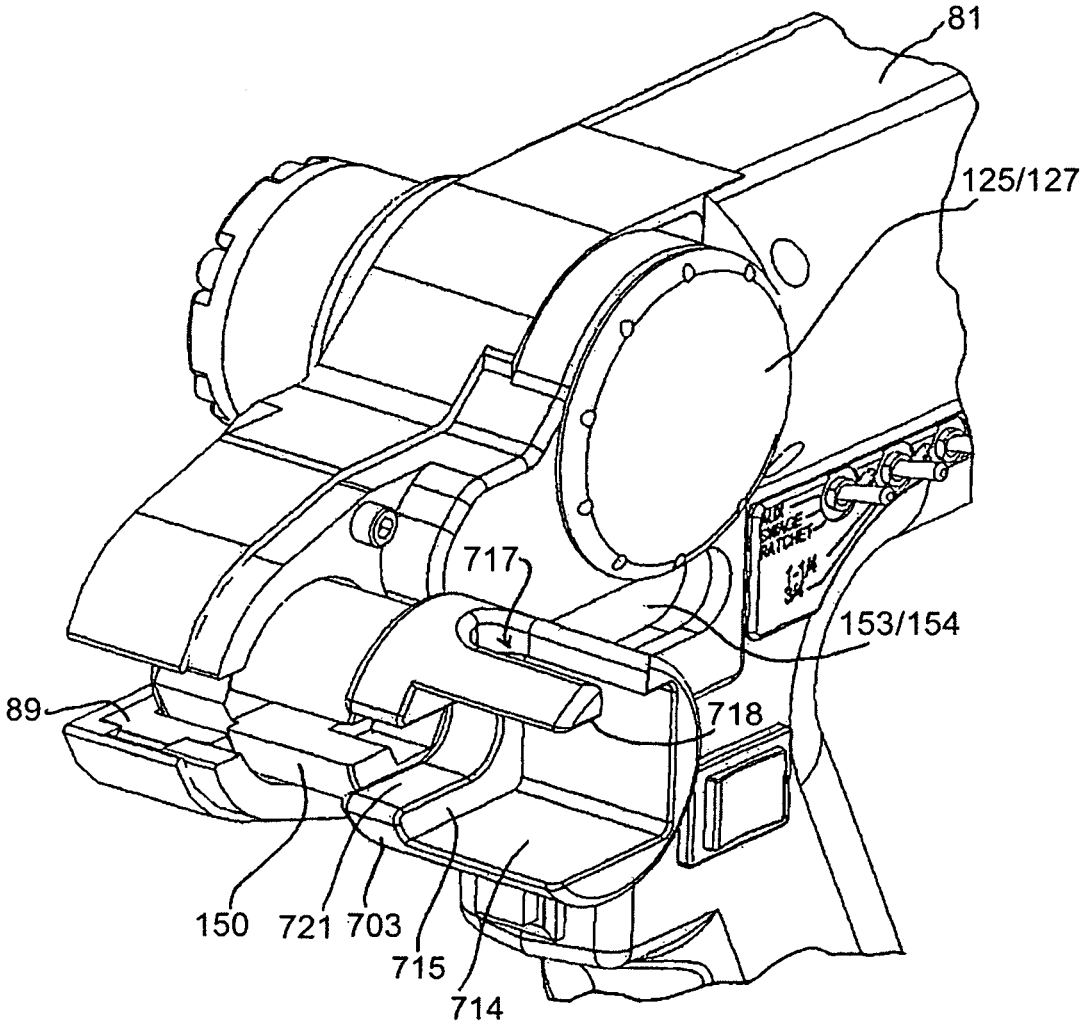
FIG. 60 is another perspective view of the embodiment of FIG. 59.
Figure 61:
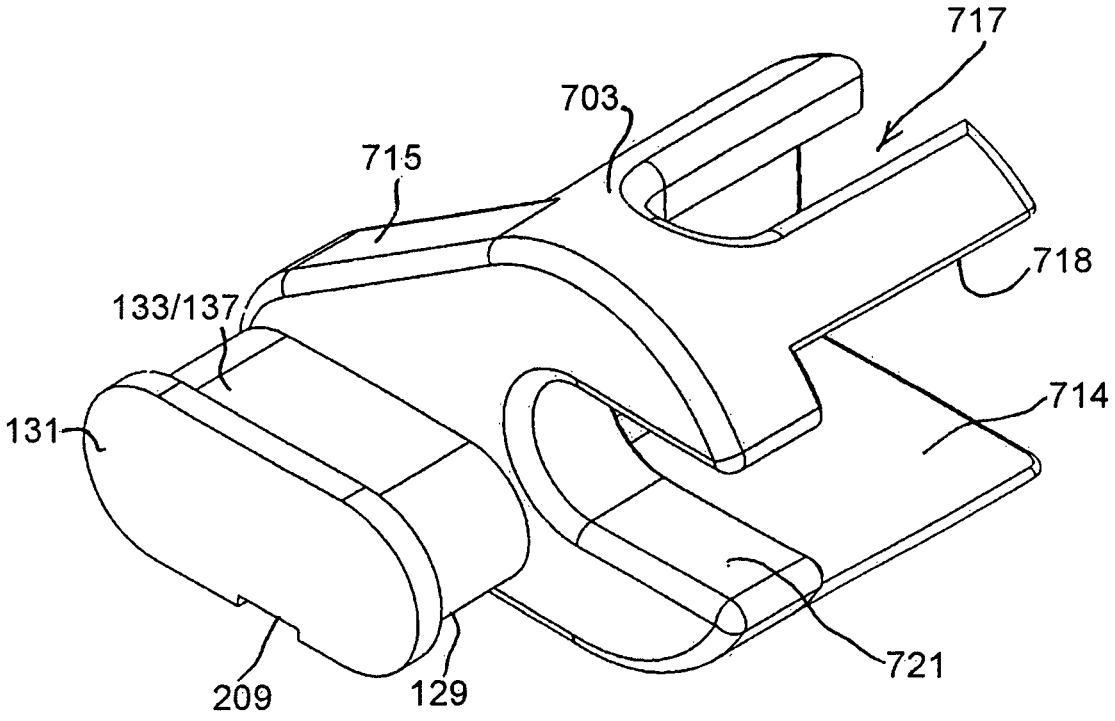
FIG. 61 is a reverse perspective view of one portion of the embodiment of FIG. 59.
Figure 62:
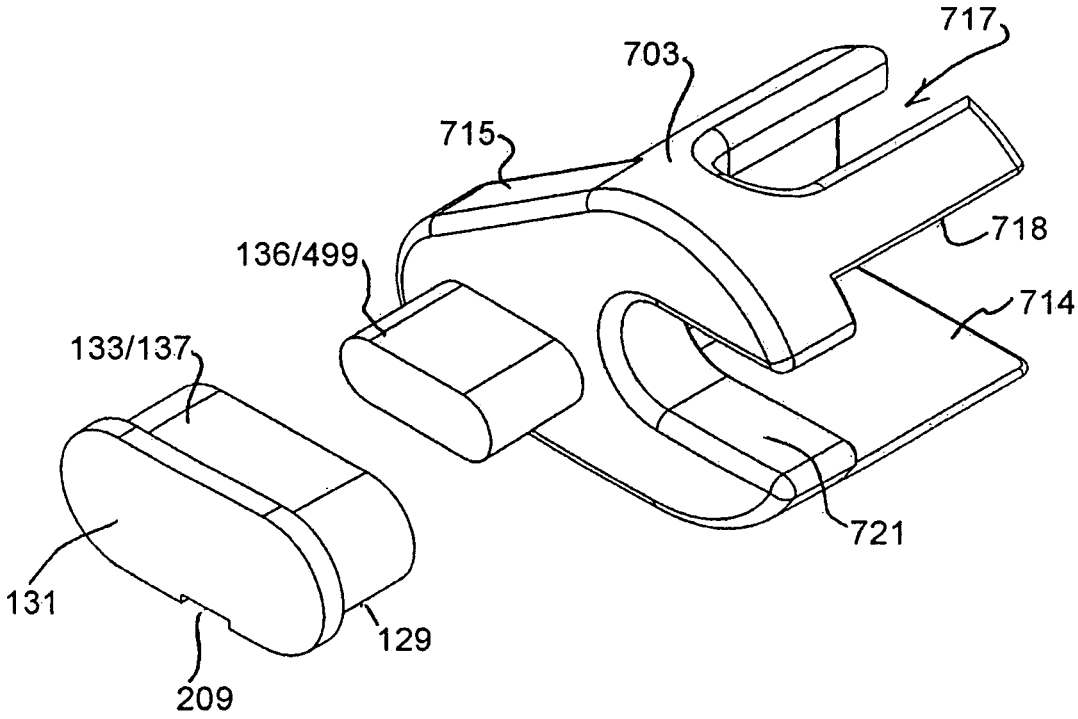
FIG. 62 is an exploded view of the portion of the embodiment of FIG. 59 shown in FIG. 61.

As shown in FIG. 58, saw blade 655 is integral with drive shaft 659 having squared socket receivable end 661. Drive shaft 659 is receivable in ball bearing set 663 press fit into bore 665 in the center of the housing retainer portion 647 thus supporting saw blade 655 for rotation within pocket 669 of housing retainer portion 647. Saw blade 655 is captured in the contoured pocket and sandwiched between rotatable tube size selector guide 671 and cover 649. Attached to the face of rotatable selector guide 671 is axel 673 received at one end in a threaded opening 675 in guide 671 which extends through actuate slot 677 in cover 649 at its opposite end to a position outside tool housing 645. Axel 673 has slidable barrel 679 mounted thereon and biased by spring 681 towards the face of cover 649. This assembly is retained by spring keeper 683. Together as an assembly, spring loaded barrel 679 provides a selector for user choice of a desired slot 685 diameter by providing disengagable locking in a radially arranged series of detents 689 along arcuate slot 677 corresponding to the diameter of tubing desired to cut. By withdrawing the barrel from an annular detent followed by user rotation of guide 671 to a new detent using axle 673, a new operative position is obtained suitable to a different size tubing.

Tool head 643 is attached to the face of the drive tool using base portion 131 of mounting body 129 as described previously. Notch 209 is engagable by latch 183 for tool stability and release and removal from slideway 154, mounting body 129 being forward biased by spring loaded pin received in opening 197 as discussed hereinabove. Mounting interface 136/499 of tool head 643 is receivable in opening 693 in the reverse face of tower 137, thus allowing elevation adjustment on tower 137 so that end 661 of drive shaft 659 may be directly received at drive socket 89 of driver 81, or may be received in extension socket 150 receivable by drive socket 89 as illustrated herein.

A seventh embodiment of a utility tool of this invention, for grasping different types and/or sizes of fittings for rotational stabilization thereof, is described with reference to FIGS. 59 through 68. Reaction utility tool 701 includes different tool heads for different engagements. Head 703 of FIGURES through 63 is adapted for use with valve bodies 705 while head 707 (FIGS. 64 through 68) is adapted for use with tube fitting tees (not shown), elbows 709 and crosses 711. Tool 701 is mounted entirely at one side of nut driving tool 81. As always, a number of the features of this embodiment are substantially similar to those heretofore described and may not be shown, including the features of adaptation 125, except as addressed herein.

Figure 63:
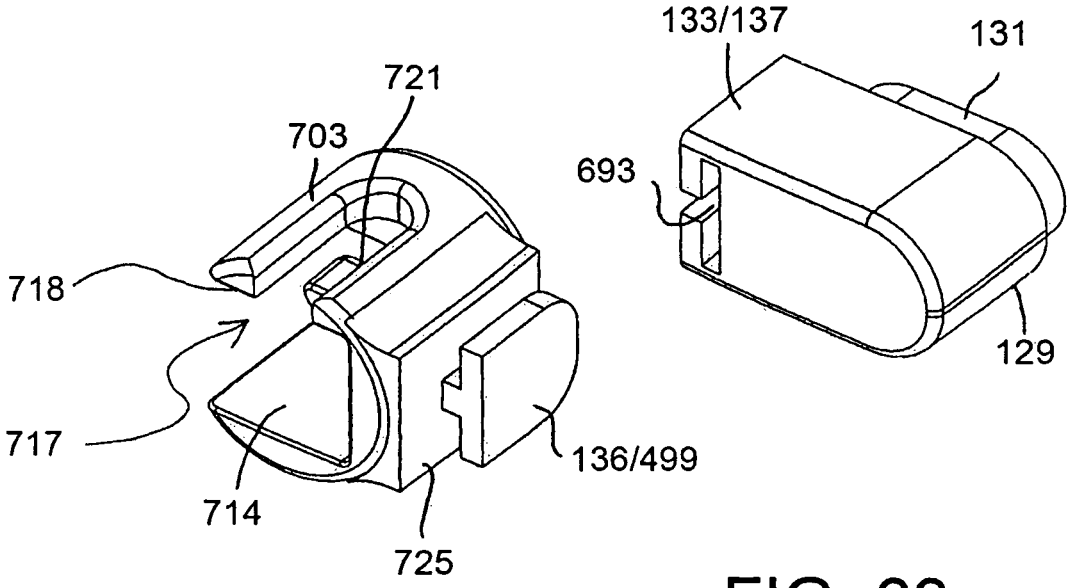
FIG. 63 is an alternative adaptation for mounting the embodiment of FIG. 59.
Figure 64:
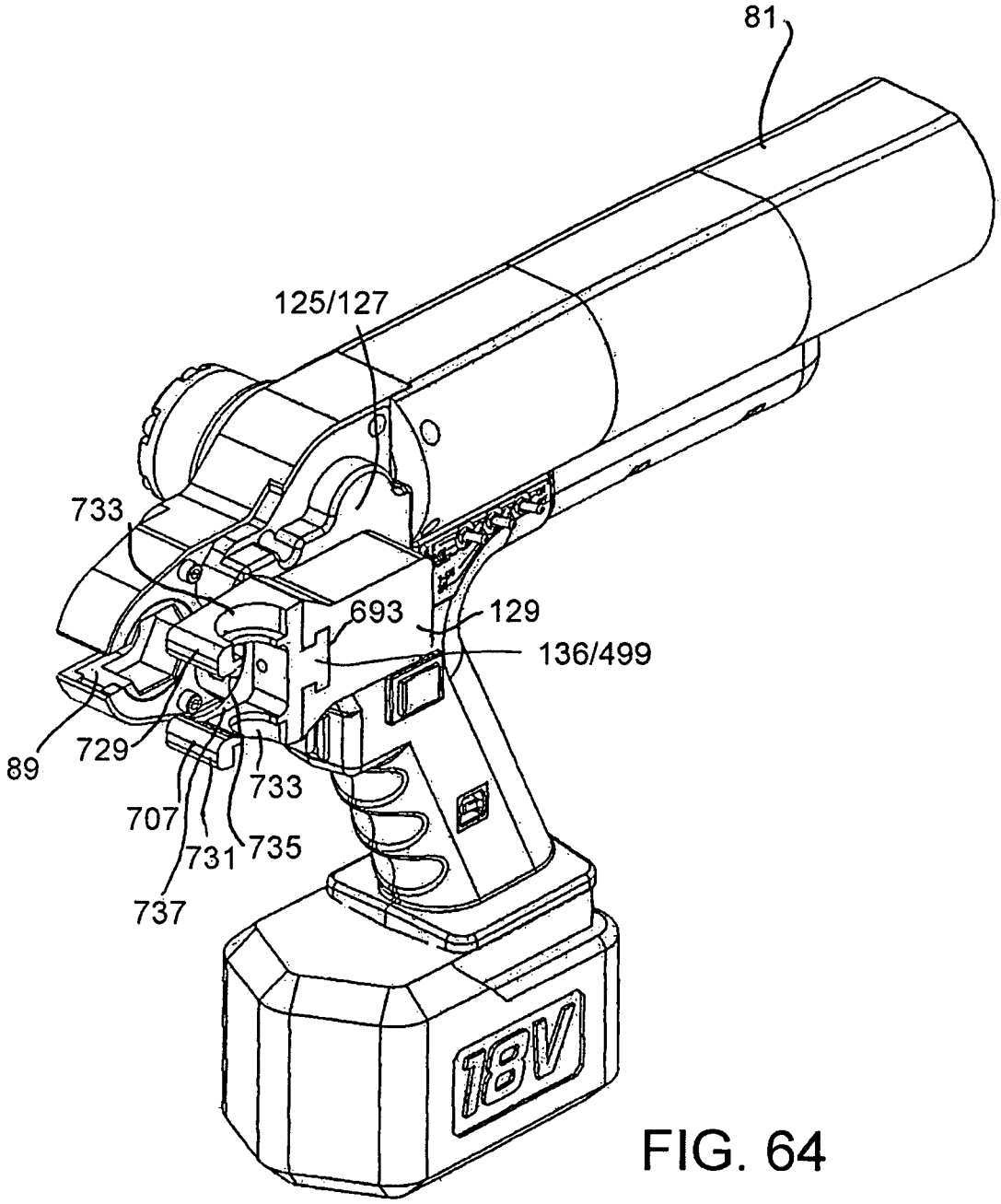
FIG. 64 is a perspective of another alternative adaptation of the embodiment of FIG. 59 showing a different tool head.
Figure 65:
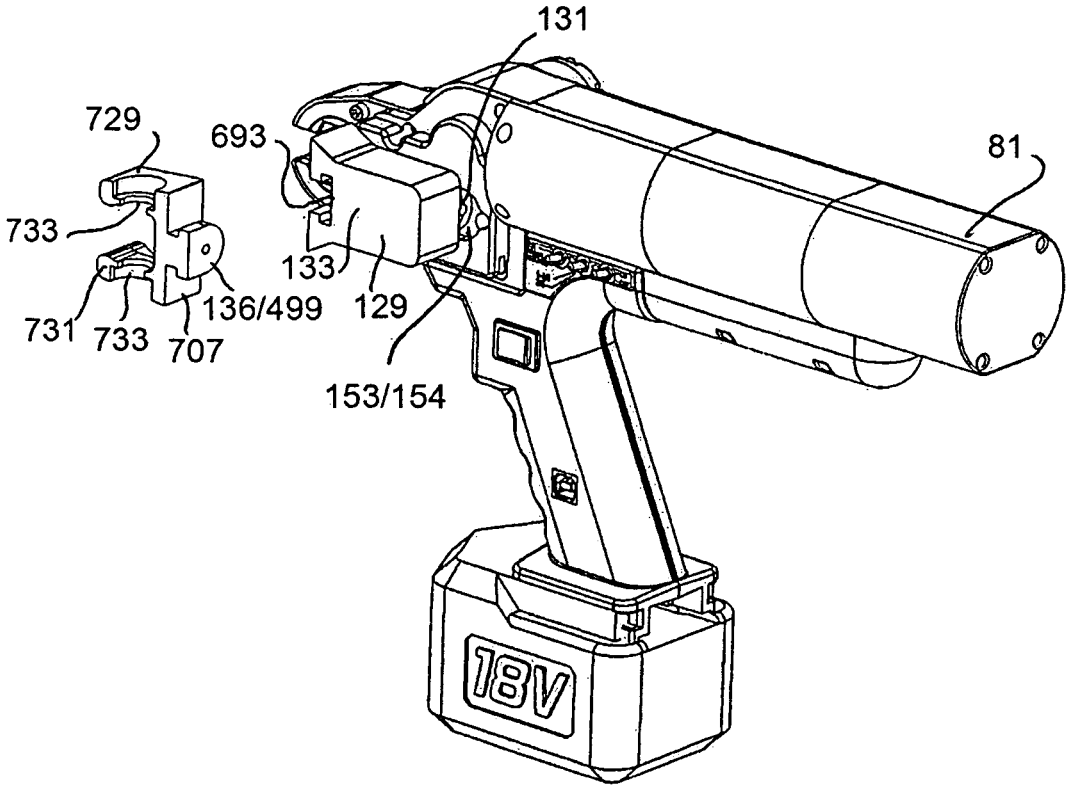
FIG. 65 is a perspective exploded view of the embodiment as illustrated in FIG. 64.

Tool head 703 includes open faced valve body receptacle 714 positioned at mounting interface platform 715 having slot 717 at facet 718 thereof for receipt of a valve stem 719 thereinto. Tubing guide slot 721 is located at platform 715 for receipt and stabilization of tubing 225. An alternative mounting and orientation of tool head 703 is illustrated in FIG. 63 wherein interface 136/499 is located on side located interface platform 725 and mounting body 129 provides positioning of mounting opening 693 accordingly at tower 137 of station portion 133.

Figure 66:
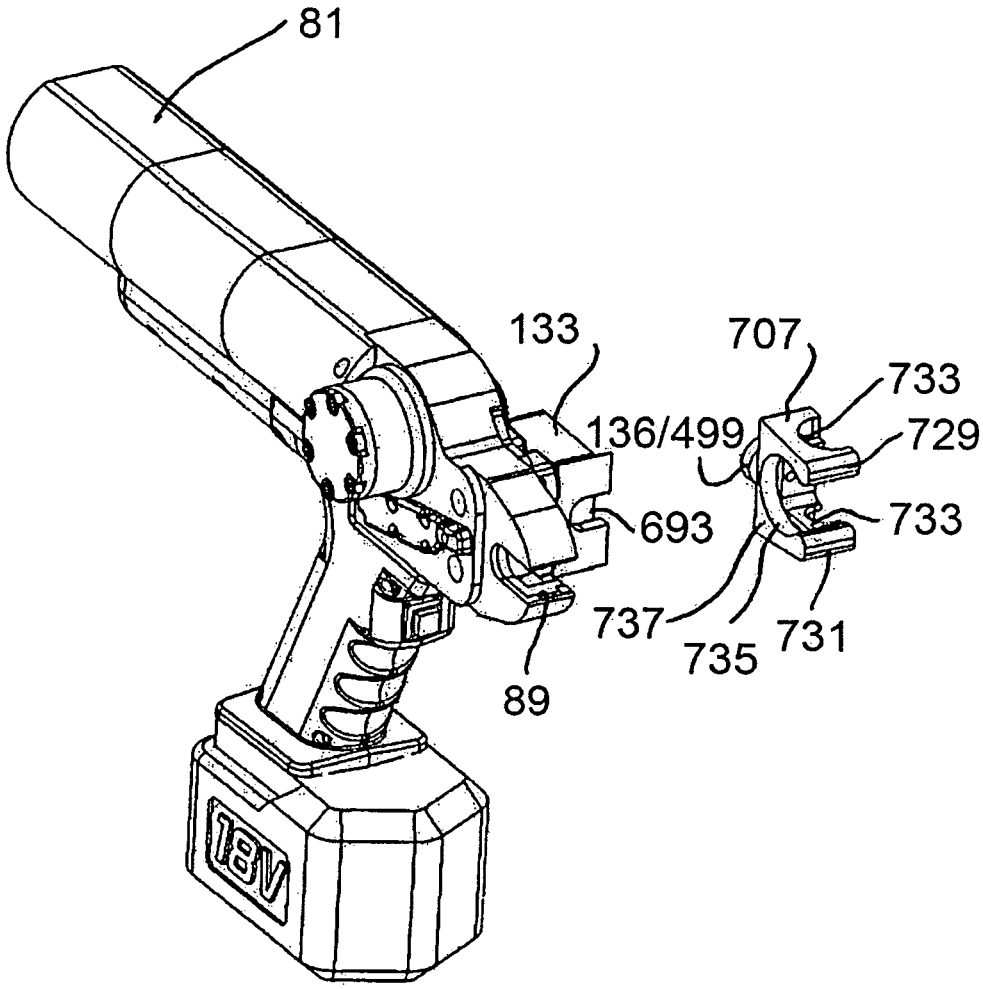
FIG. 66 is a reverse explode view of the embodiment as illustrated in FIG. 64.
Figure 67:
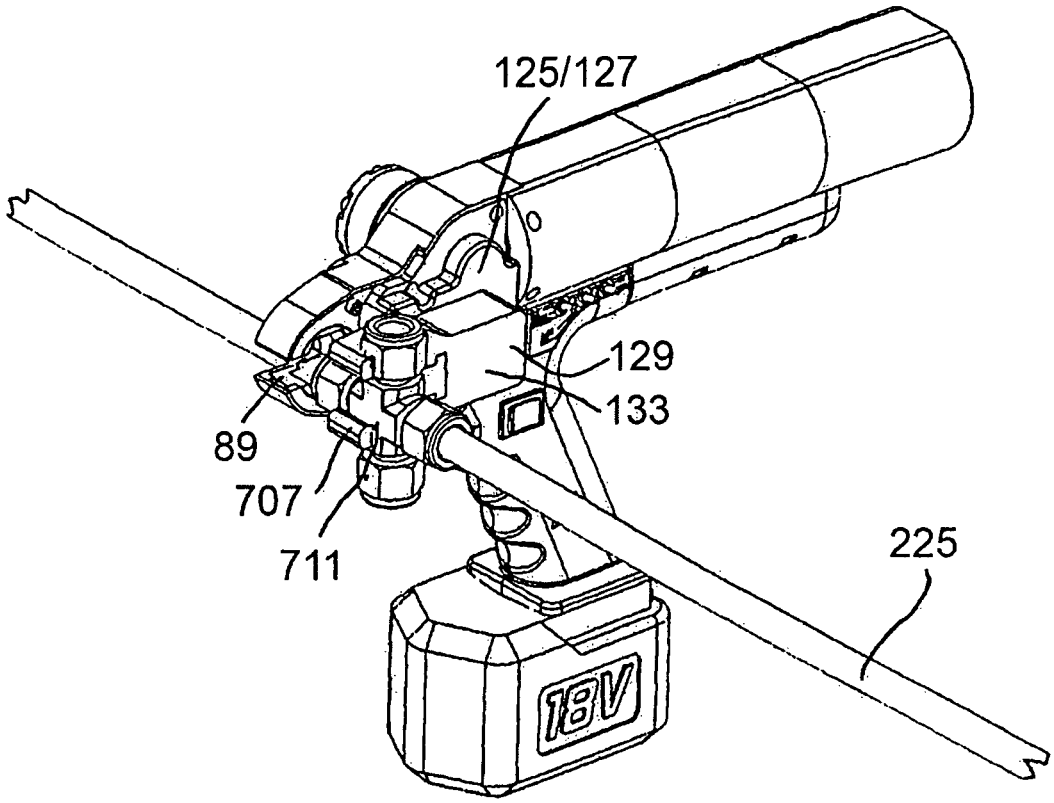
FIGS. 67 and 68 are perspective view showing use of the embodiment as illustrated in FIG. 64 on different fitting types.
Figure 68:
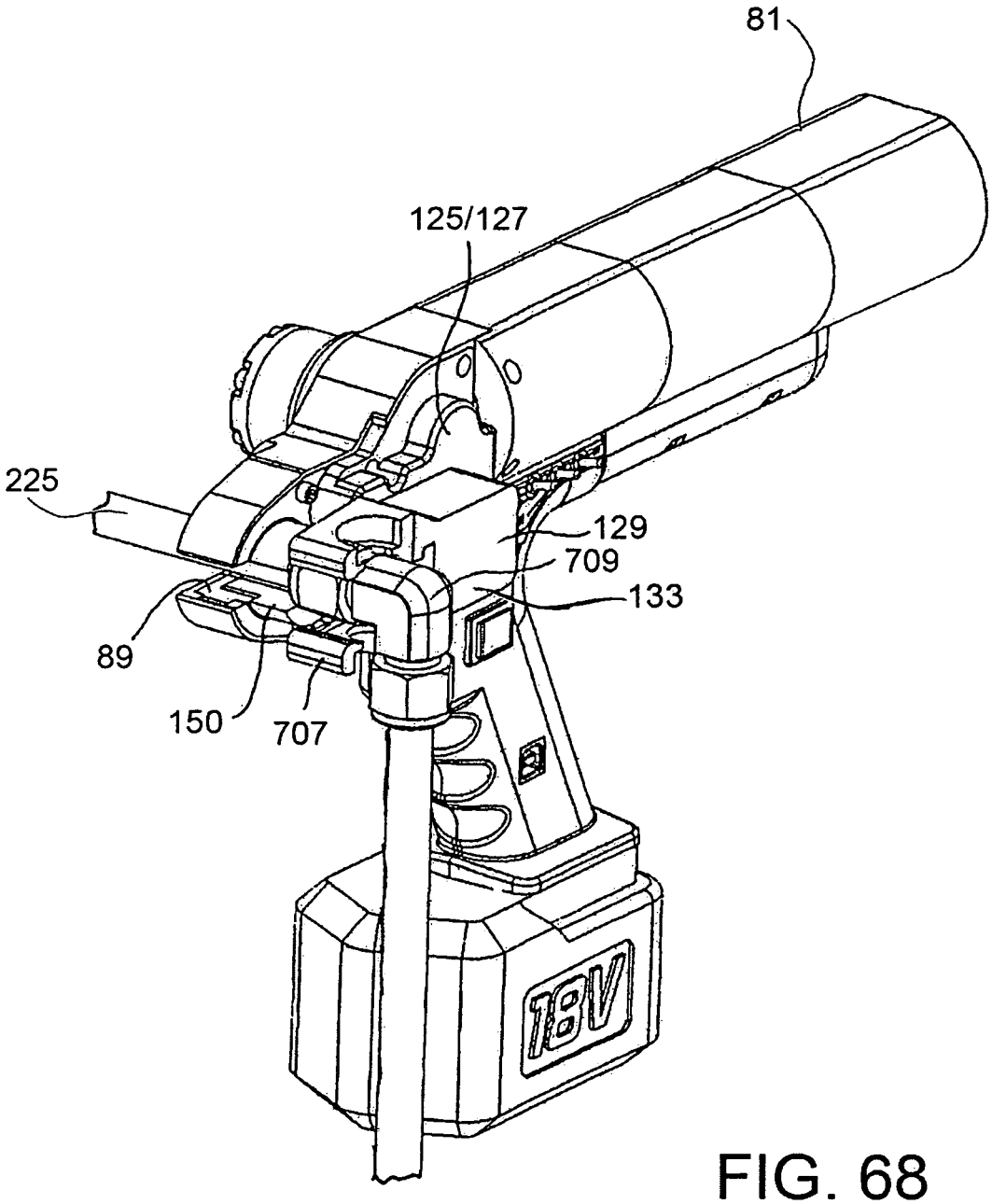
Figure 69:
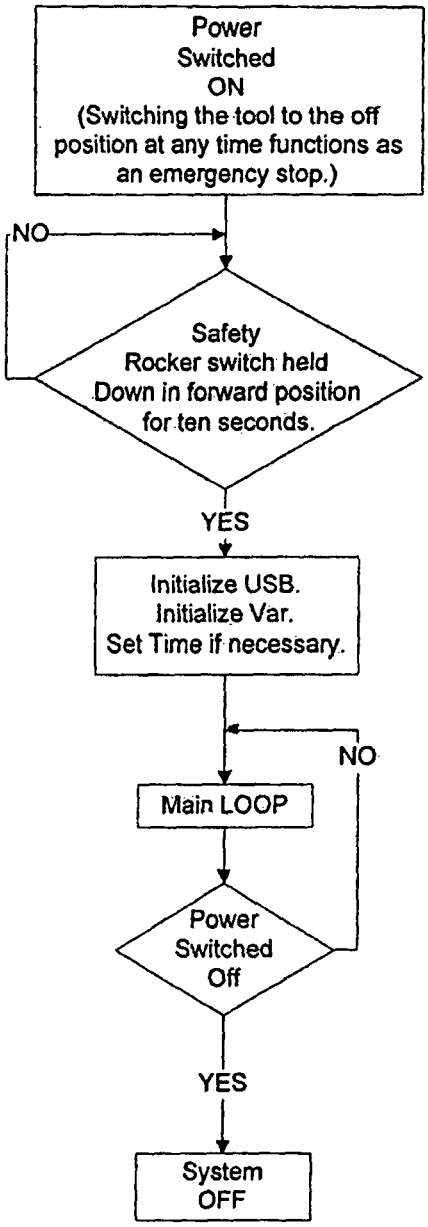
FIGS. 69 through 73 are flow charts illustrating program control of drivers and/or utility tools utilizing various ones of the embodiments of this invention.
Figure 70:
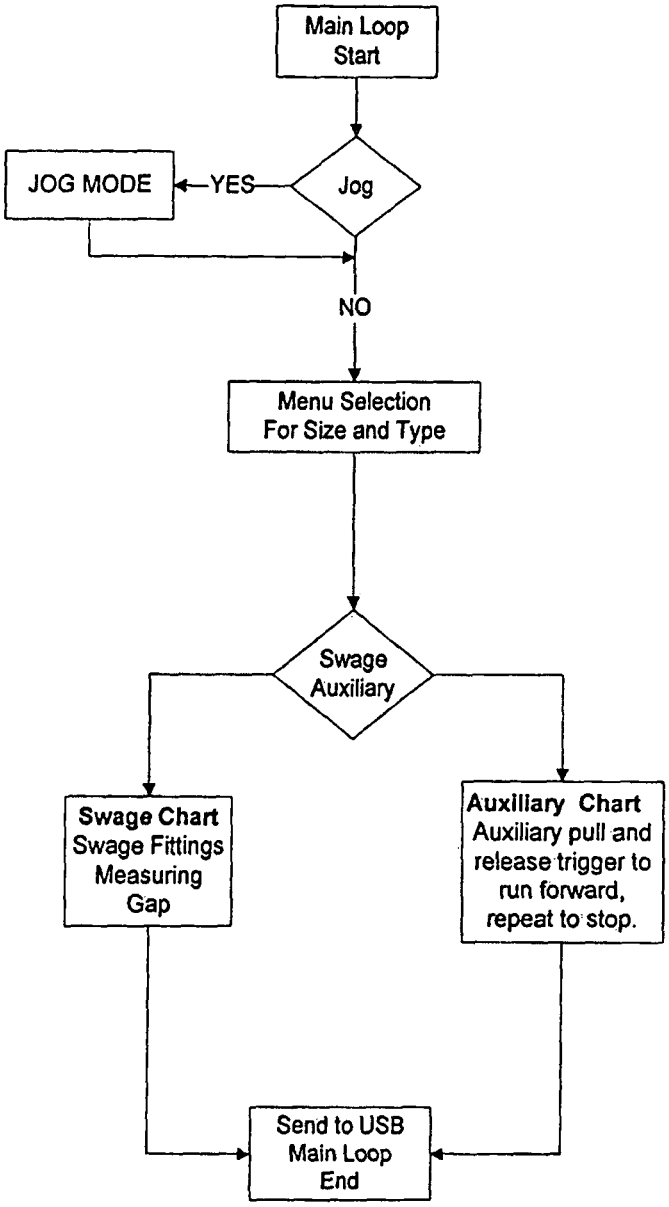

Tool head 707 is mounted on mounting body 129 at interface 136/499 in opening 693. Such heads can be provided for various sizes, and could be individually fashioned to accept specific tubing connection types. However, the universal design of head 707 shown herein is preferred. Head 707 includes fitting guide wings 729 and 731 each having an arcuate guide channel 733. Central tube/fitting passage 735 is defined at rear wall 737 (FIG. 66). This universal design can be used to accept fittings of a variety of sizes and configuration including tees, crosses 711 (FIG. 67), elbows 709 (FIG. 68), and others.

Program control at a processor on-board tool 81 is illustrated in FIGS. 69 through 73 for use with the various electronic utility tool embodiments of this invention (particularly reaction tool 223 illustrated in FIGS. 13 through 32).

Figure 71:
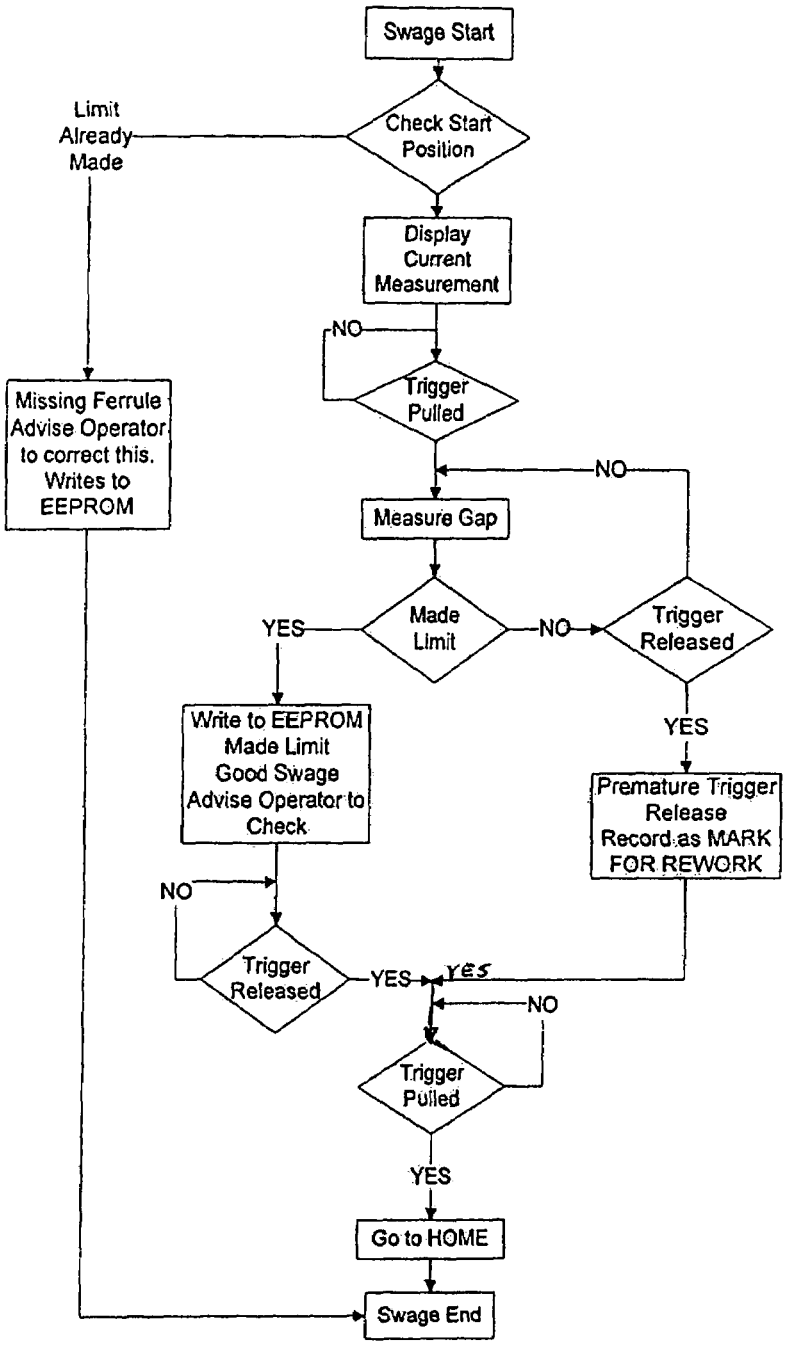

Tool 81 has various inputs shown in the drawings allowing the switching and inputs discussed hereinbelow. Once the driver is powered on, it is monitored for power-off at all times. Restarting in such case requires a safety switch to be held for a safe restart. Thereafter, various functions are initialized and the main loop is entered whereat the driver awaits operator input. Once awakened (FIG. 70), the control searches for jog function input, user selected fitting size and type input, and/or operational mode input (in this case, swage functions for nut to body gap measurement use, or auxiliary functions for use of the various other tool heads, are selected at appropriate switching). The jog function mode is used for operator relocation of the socket and/or reverse rotation operations. The jog function includes a high power and lower power operational modes used for different fittings and/or different installation manipulation tasks. Swaging operation control is shown in FIG. 71. A number and identifying indicia are assigned when the trigger is pulled. Further functions, such as blue tooth label printing functions could also be provided.

Figure 72:
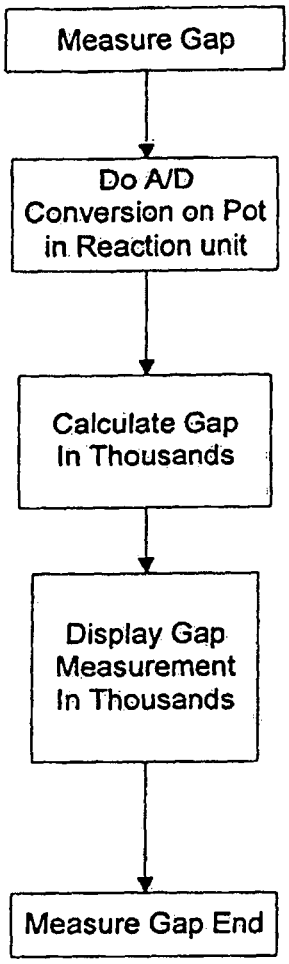
Figure 73:
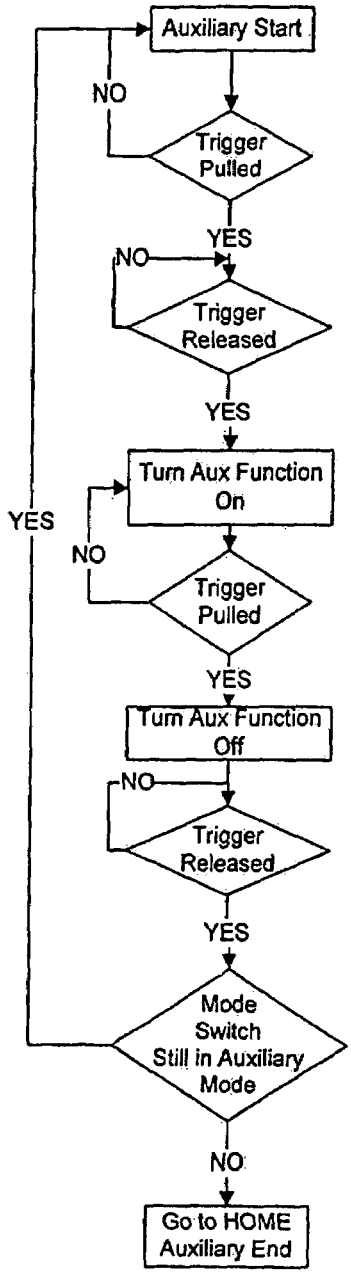

Selection of a particular mode enters individualized process loops related to the selected mode. In swage mode, functions related to both nut to body gap measurement, start position, and monitored relative movement of fastener nut and body are completed. If a ferule is missing, such is detected. Nut to body proximity is sensed and monitored, data indicative of various operations (trigger pull/release) and or limit achievement being written to EEPROM, certain assumptions related thereto noted for operator advisement. Gap measurement functions (from data sent from potentiometer 283 of tool 223 for example) are illustrated in FIG. 72, gap measurement being displayable accordingly at monitor 219, for example. Gap measurement signals are A/D converted leading to a gap calculation obtained from an on-board look-up table created from prior made calibrations. Auxiliary functions related to sawing, cutting and bending are facilitated in a more general manner as shown in FIG. 73.

Other control options to help assure proper fastener integrity could be utilized. For example, power consumption data during a tightening operation can be monitored and reported (for example, using motor 261 current draw) and plotted versus time interval and/or drive gear tooth count to seek the exact point between 400° and 540° that power draw ramps up to a peak and then falls off slightly (indicating the a tube fitting ferrule has begun to yield), thereafter ramping up and peaking again (indicating full ferrule compression). This correlation can be used to cease driver operation at the first peak and fall off to further assuring proper fitting tightness. This same data can be utilized to determine dynamic torque as it is applied, to spot missing ferrules or otherwise defective fittings, driver malfunction (binding or the like), and operator errors. Additionally, fitting inventory may be automatically updated based on completed swages counted.

As may be appreciated from the foregoing, highly adaptable tools are disclosed herein for performing various sorts of operations related to fluid carrying lines, fittings and facilities. Ease of use and prevention of operations error are facilitated, and adaptability to a variety of installation circumstances is achieved.

What is claimed is:

1. An adaptation for mounting and positioning a selected utility tool at one side of a nut driving tool adjacent to a socket driver of the nut driving tool, the nut driving tool of the type including a main drive gear operationally associated with the a socket driver, said adaptation comprising:

a receiver adapted for connection to the one side of the nut driving tool and including an open ended slot structure defining a slideway extending linearly along one side of said receiver;

a utility tool mounting body receivable at said receiver and including a base portion slidably receivable in said slideway of said receiver and a station portion extending from said base portion and releasably engageable with the selected utility tool; and a latch for securement and release of said base portion at said receiver.

2. The adaptation of claim 1 wherein said slideway has a length sufficient to extend from an area adjacent to the main drive gear to an area adjacent to the socket driver when said receiver is connected to the one side of the nut driving tool .

3. The adaptation of claim 2 wherein said mounting body base portion includes a biasing assembly to accommodate biased movement of said mounting body along said slideway.

4. The adaptation of claim of 2 wherein said station includes a tower, the utility tool slidably receivable at said tower.

5. The adaptation of claim 2 wherein said base portion of said mounting body includes a slide receivable in undercut edges of said slideway.

6. The adaptation of claim 5 wherein said station portion includes a platform having edges which are receivable between said undercut edges to extend said mounting body above said receiver.

7. The adaptation of claim 1 wherein the utility tool is a reaction unit for engaging a fitting body, wherein the nut driving tool is of the type used for driving a nut on the fitting body and thereby changing a nut to body gap to achieve a selected remaining nut to body gap, said adaptation further comprising means at said mounting body and said receiver for measuring and reporting operational parameters relating to the nut to body gap.

8. The adaptation of claim 1 further comprising biasing means at said base portion for biasing said base portion toward disengagement from said receiver.

9. A utility tool maintainable entirely at one side of a nut driving tool adjacent to a socket driver of the nut driving tool, a main drive gear operationally associated with the socket driver, said utility tool comprising:

a receiver adapted for connection to the one side of the nut driving tool and including an open ended slot structure defining a slideway extending linearly along one side of said receiver;

a utility tool head having a mounting interface;

a mounting body including a base portion and a station portion, said base portion slidably receivable in said slideway of said receiver for selected utility tool head positioning at a location relative to said receiver along said slideway and thereby the socket driver when said receiver is connected to the nut driving tool, and said station portion extending from said base portion and releasably engageable with said mounting interface of said utility tool head;

a latch located adjacent to said slot structure of said receiver for securement and release of said base portion at said receiver; and a biasing assembly associated with said base portion and said latch for biasing said base portion toward disengagement from said receiver along said slideway.

10. The utility tool of claim 9 wherein said receiver is integrally located with a nut driving tool cover.

11. The utility tool of claim 9 wherein said utility tool head is a reaction unit for engaging a nut or a fitting body.

12. The utility tool of claim 9 wherein said biasing assembly includes a pin and biasing spring maintained in said base portion, said pin extending therefrom and engageable at a detent at a closed end of said slot structure, said biasing assembly upon actuation of said latch biasing said mounting body toward engagement with a work unit engaged at the socket driver.

13. The utility tool of claim 11 wherein the nut driving tool is of the type used for driving the nut on the fitting body and thereby changing a nut to body gap to achieve a selected remaining nut to body gap, said utility tool further comprising means for measuring and reporting operational parameters relating to the nut to body gap via electronic contacts located at said base portion of said mounting body provided for communication with electronic contacts located at said receiver.

14. The utility tool of claim 13 wherein said measuring and reporting means includes relatively movable blades at said utility tool head positionable between the nut and the fitting body and movable with movement of the nut by the socket driver.

15. The utility tool of claim 14 further comprising a potentiometer at said tool head responsive to one of said blades for measuring a change to nut to body gap.

16. The utility tool of claim of 14 wherein said blades include surfaces for engagement of different features of a tube connection fitting, said tool head further comprising trigger means for automatic blade relative position retention and release between operations.

17. The utility tool of claim 13 wherein said base portion includes a slide receivable in a said slideway, said electronic contacts located at said base portion maintained at said slide, and said electronic contacts at said receiver maintained at said slideway.

18. The utility tool of claim 9 wherein said latch includes a spring biased lever arm mounted adjacent to said slideway and a catch at said lever arm configured to extend into said slideway, said lever arm user operable for securement and release of said base portion.

19. The utility tool of claim 9 wherein said head is a tubing cutter.

20. The utility tool of claim 9 wherein said head is a tubing bender.

21. The utility tool of claim 9 wherein said head is one of a reciprocating saw or a rotary saw.

22. The utility tool of claim 9 wherein said head is adapted for stabilizing at least one of tee fittings, cross fitting, elbow fittings, or valve bodies.

* * * * *